US006831618B1

(12) United States Patent
Suzuki et al.

(10) Patent No.: US 6,831,618 B1
(45) Date of Patent: Dec. 14, 2004

(54) METHOD FOR DRIVING A PLASMA DISPLAY PANEL

(75) Inventors: Masahiro Suzuki, Yamanashi (JP); Nobuhiko Saegusa, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/518,370

(22) Filed: Mar. 3, 2000

(30) Foreign Application Priority Data

Mar. 4, 1999 (JP) ..... 11-057685

(51) Int. Cl.[7] ..... G09G 3/28

(52) U.S. Cl. ..... 345/60; 345/63; 345/68; 345/89; 345/77; 345/76; 345/690; 345/691; 345/692; 345/693; 345/64; 345/212; 345/214; 345/204

(58) Field of Search ..... 345/63, 89, 68, 345/77, 76, 149, 690, 691, 692, 693, 213, 211, 204, 212, 214, 64

(56) References Cited

U.S. PATENT DOCUMENTS 6,222,512 B1 * 4/2001 Tajima et al. ..... 345/63
6,243,073 B1 * 6/2001 Kawamura et al. ..... 345/213
6,249,265 B1 * 6/2001 Tajima ..... 345/63
6,249,268 B1 * 6/2001 Tachibana et al. ..... 345/204
6,323,880 B1 * 11/2001 Yamada ..... 345/63

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

A method for driving a display panel which enables changing of the refresh rate, without degrading display quality, of a display panel employing the matrix display scheme for carrying out gray-scale drive by using the sub-field method. By the method, the number of sub-fields to be executed within a unit display period is changed in response to the vertical synchronization frequency of an input video signal.

13 Claims, 47 Drawing Sheets

FIG. 5

| D | | $HD_P$ | | D | | $HD_P$ | |
|---|---|---|---|---|---|---|---|
| BRIGHT-NESS | 0 ~ 7 | BRIGHT-NESS | 0 ~ 7 | BRIGHT-NESS | 0 ~ 7 | BRIGHT-NESS | 0 ~ 7 |
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG. 6

| D | | $HD_P$ | | D | | $HD_P$ | |
|---|---|---|---|---|---|---|---|
| BRIGHT-NESS | 0 ~ 7 | BRIGHT-NESS | 0 ~ 7 | BRIGHT-NESS | 0 ~ 7 | BRIGHT-NESS | 0 ~ 7 |
| 128 | 10000000 | 112 | 0111 0000 | 192 | 11000000 | 168 | 10101000 |
| 129 | 10000001 | 113 | 0111 0001 | 193 | 11000001 | 169 | 10101001 |
| 130 | 10000010 | 114 | 0111 0010 | 194 | 11000010 | 170 | 10101010 |
| 131 | 10000011 | 115 | 0111 0011 | 195 | 11000011 | 171 | 10101011 |
| 132 | 10000100 | 115 | 0111 0011 | 196 | 11000100 | 172 | 10101100 |
| 133 | 10000101 | 116 | 0111 0100 | 197 | 11000101 | 173 | 10101101 |
| 134 | 10000110 | 117 | 0111 0101 | 198 | 11000110 | 173 | 10101101 |
| 135 | 10000111 | 118 | 0111 0110 | 199 | 11000111 | 174 | 10101110 |
| 136 | 10001000 | 119 | 0111 0111 | 200 | 11001000 | 175 | 10101111 |
| 137 | 10001001 | 120 | 0111 1000 | 201 | 11001001 | 176 | 10110000 |
| 138 | 10001010 | 121 | 0111 1001 | 202 | 11001010 | 177 | 10110001 |
| 139 | 10001011 | 122 | 0111 1010 | 203 | 11001011 | 178 | 10110010 |
| 140 | 10001100 | 122 | 0111 1010 | 204 | 11001100 | 179 | 10110011 |
| 141 | 10001101 | 123 | 0111 1011 | 205 | 11001101 | 180 | 10110100 |
| 142 | 10001110 | 124 | 0111 1100 | 206 | 11001110 | 180 | 10110100 |
| 143 | 10001111 | 125 | 0111 1101 | 207 | 11001111 | 181 | 10110101 |
| 144 | 10010000 | 126 | 0111 1110 | 208 | 11010000 | 182 | 10110110 |
| 145 | 10010001 | 127 | 0111 1111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11011000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 1111 0000 | 210 | 11010010 |
| 177 | 10110001 | 155 | 10011011 | 241 | 1111 0001 | 211 | 11010011 |
| 178 | 10110010 | 156 | 10011100 | 242 | 1111 0010 | 212 | 11010100 |
| 179 | 10110011 | 157 | 10011101 | 243 | 1111 0011 | 213 | 11010101 |
| 180 | 10110100 | 158 | 10011110 | 244 | 1111 0100 | 214 | 11010110 |
| 181 | 10110101 | 158 | 10011110 | 245 | 1111 0101 | 215 | 11010111 |
| 182 | 10110110 | 159 | 10011111 | 246 | 1111 0110 | 216 | 11011000 |
| 183 | 10110111 | 160 | 10010000 | 247 | 1111 0111 | 216 | 11011000 |
| 184 | 10111000 | 161 | 10100001 | 248 | 1111 1000 | 217 | 11011001 |
| 185 | 10111001 | 162 | 10100010 | 249 | 1111 1001 | 218 | 11011010 |
| 186 | 10111010 | 163 | 10100011 | 250 | 1111 1010 | 219 | 11011011 |
| 187 | 10111011 | 164 | 10100100 | 251 | 1111 1011 | 220 | 11011100 |
| 188 | 10111100 | 165 | 10100101 | 252 | 1111 1100 | 221 | 11011101 |
| 189 | 10111101 | 166 | 10100110 | 253 | 1111 1101 | 222 | 11011110 |
| 190 | 10111110 | 166 | 10100110 | 254 | 1111 1110 | 223 | 11011111 |
| 191 | 10111111 | 167 | 10100111 | 255 | 1111 1111 | 224 | 11100000 |

FIG. 12

VF ≦ 60 [Hz]

(SELECTIVE ERASING)

| CONVERSION TABLE A | | | | | | | | | | | | | | |
|---|---|---|---|---|---|---|---|---|---|---|---|---|---|---|
| Ds | CONVERSION DATA | | | | | | | | | | | | | |
| | 1 | 2 | 3 | 4 | 5 | 6 | 7 | 8 | 9 | 10 | 11 | 12 | 13 | 14 |
| 0000 | 1 | 0 | 0 | 0 | 0 | 0 | 0 | 0 | 0 | 0 | 0 | 0 | 0 | 0 |
| 0001 | 0 | 1 | 0 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 13

60 [Hz] < VF ≦ 65 [Hz]

(SELECTIVE ERASING)

| CONVERSION TABLE B | | | | | | | | | | | | | | |
|---|---|---|---|---|---|---|---|---|---|---|---|---|---|---|
| Ds | CONVERSION DATA | | | | | | | | | | | | | |
| | 1 | 2 | 3 | 4 | 5 | 6 | 7 | 8 | 9 | 10 | 11 | 12 | 13 | 14 |
| 0000 | 1 | 1 | 0 | 0 | 0 | 0 | 0 | 0 | 0 | 0 | 0 | 0 | 0 | 0 |
| 0001 | 0 | 1 | 0 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 14

65 [Hz] < VF ≦ 75 [Hz]

(SELECTIVE ERASING)

| CONVERSION TABLE C | | | | | | | | | | | | | | |
|---|---|---|---|---|---|---|---|---|---|---|---|---|---|---|
| Ds | CONVERSION DATA | | | | | | | | | | | | | |
| | 1 | 2 | 3 | 4 | 5 | 6 | 7 | 8 | 9 | 10 | 11 | 12 | 13 | 14 |
| 0000 | 1 | 0 | 1 | 0 | 0 | 0 | 0 | 0 | 0 | 0 | 0 | 0 | 0 | 0 |
| 0001 | 0 | 1 | 1 | 0 | 0 | 0 | 0 | 0 | 0 | 0 | 0 | 0 | 0 | 0 |
| 0010 | 0 | 0 | 1 | 0 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 15

75 [Hz] < VF ≦ 85 [Hz]

(SELECTIVE ERASING)

| CONVERSION TABLE D | | | | | | | | | | | | | | |
|---|---|---|---|---|---|---|---|---|---|---|---|---|---|---|
| Ds | CONVERSION DATA | | | | | | | | | | | | | |
| | 1 | 2 | 3 | 4 | 5 | 6 | 7 | 8 | 9 | 10 | 11 | 12 | 13 | 14 |
| 0000 | 1 | 0 | 0 | 1 | 0 | 0 | 0 | 0 | 0 | 0 | 0 | 0 | 0 | 0 |
| 0001 | 0 | 1 | 0 | 1 | 0 | 0 | 0 | 0 | 0 | 0 | 0 | 0 | 0 | 0 |
| 0010 | 0 | 0 | 1 | 1 | 0 | 0 | 0 | 0 | 0 | 0 | 0 | 0 | 0 | 0 |
| 0011 | 0 | 0 | 0 | 1 | 0 | 0 | 0 | 0 | 0 | 0 | 0 | 0 | 0 | 0 |
| 0100 | 0 | 0 | 0 | 0 | 1 | 0 | 0 | 0 | 0 | 0 | 0 | 0 | 0 | 0 |
| 0101 | 0 | 0 | 0 | 0 | 0 | 1 | 0 | 0 | 0 | 0 | 0 | 0 | 0 | 0 |
| 0110 | 0 | 0 | 0 | 0 | 0 | 0 | 1 | 0 | 0 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 0 | 0 | 1 | 0 | 0 | 0 | 0 | 0 |
| 1001 | 0 | 0 | 0 | 0 | 0 | 0 | 0 | 0 | 0 | 1 | 0 | 0 | 0 | 0 |
| 1010 | 0 | 0 | 0 | 0 | 0 | 0 | 0 | 0 | 0 | 0 | 1 | 0 | 0 | 0 |
| 1011 | 0 | 0 | 0 | 0 | 0 | 0 | 0 | 0 | 0 | 0 | 0 | 1 | 0 | 0 |
| 1100 | 0 | 0 | 0 | 0 | 0 | 0 | 0 | 0 | 0 | 0 | 0 | 0 | 1 | 0 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

FIG. 18

VF ≦ 60

| HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 1 | 2 | 3 | 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 1 | 0 | 0 | 0 | 0 | 0 | 0 | 0 | 0 | 0 | 0 | 0 | 0 | 0 | ● | | | | | | | | | | | | | | ● | | | | | | | | | | | | | | | | 0 | 0 |
| 0 | 1 | 0 | 0 | 0 | 0 | 0 | 0 | 0 | 0 | 0 | 0 | 0 | 0 | ○ | ● | | | | | | | | | | | | | ○ | ● | | | | | | | | | | | | | | | 1 | 1 |
| 0 | 0 | 1 | 0 | 0 | 0 | 0 | 0 | 0 | 0 | 0 | 0 | 0 | 0 | ○ | ○ | ● | | | | | | | | | | | | ○ | ○ | ● | | | | | | | | | | | | | | 4 | 4 |
| 0 | 0 | 0 | 1 | 0 | 0 | 0 | 0 | 0 | 0 | 0 | 0 | 0 | 0 | ○ | ○ | ○ | ● | | | | | | | | | | | ○ | ○ | ○ | ● | | | | | | | | | | | | | 9 | 9 |
| 0 | 0 | 0 | 0 | 1 | 0 | 0 | 0 | 0 | 0 | 0 | 0 | 0 | 0 | ○ | ○ | ○ | ○ | ● | | | | | | | | | | ○ | ○ | ○ | ○ | ● | | | | | | | | | | | | 17 | 17 |
| 0 | 0 | 0 | 0 | 0 | 1 | 0 | 0 | 0 | 0 | 0 | 0 | 0 | 0 | ○ | ○ | ○ | ○ | ○ | ● | | | | | | | | | ○ | ○ | ○ | ○ | ○ | ● | | | | | | | | | | | 27 | 27 |
| 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | ○ | ○ | ○ | ○ | ○ | ○ | ● | | | | | | | | | | 40 | 40 |
| 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | ○ | ○ | ○ | ○ | ○ | ○ | ○ | ● | | | | | | | | | 56 | 56 |
| 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | ○ | ○ | ○ | ○ | ○ | ○ | ○ | ○ | ● | | | | | | | | 75 | 75 |
| 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | ○ | ○ | ○ | ○ | ○ | ○ | ○ | ○ | ○ | ● | | | | | | | 97 | 97 |
| 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | ○ | ○ | ○ | ○ | ○ | ○ | ○ | ○ | ○ | ○ | ● | | | | | | 122 | 122 |
| 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | ○ | ○ | ○ | ○ | ○ | ○ | ○ | ○ | ○ | ○ | ○ | ● | | | | | 150 | 150 |
| 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | ○ | ○ | ○ | ○ | ○ | ○ | ○ | ○ | ○ | ○ | ○ | ○ | ● | | | 182 | 182 |
| 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | ● | 217 | 217 |
| 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 19

60 < VF ≦ 65

| HD 1 | 2 | 3 | 4 | 5 | 6 | 7 | 8 | 9 | 10 | 11 | 12 | 13 | 14 | SF 1 | 2 | 3 | 4 | 5 | 6 | 7 | 8 | 9 | 10 | 11 | 12 | 13 | 14 | SF 2 | 3 | 4 | 5 | 6 | 7 | 8 | 9 | 10 | 11 | 12 | 13 | 14 | FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 1 | 1 | 0 | 0 | 0 | 0 | 0 | 0 | 0 | 0 | 0 | 0 | 0 | 0 | ● | ● | | | | | | | | | | | | | ● | | | | | | | | | | | | | 0 | 0 |
| 0 | 1 | 0 | 0 | 0 | 0 | 0 | 0 | 0 | 0 | 0 | 0 | 0 | 0 | ○ | ● | | | | | | | | | | | | | ● | | | | | | | | | | | | | 1 | 0 |
| 0 | 0 | 1 | 0 | 0 | 0 | 0 | 0 | 0 | 0 | 0 | 0 | 0 | 0 | ○ | ○ | ● | | | | | | | | | | | | ○ | ● | | | | | | | | | | | | 4 | 4 |
| 0 | 0 | 0 | 1 | 0 | 0 | 0 | 0 | 0 | 0 | 0 | 0 | 0 | 0 | ○ | ○ | ○ | ● | | | | | | | | | | | ○ | ○ | ● | | | | | | | | | | | 9 | 9 |
| 0 | 0 | 0 | 0 | 1 | 0 | 0 | 0 | 0 | 0 | 0 | 0 | 0 | 0 | ○ | ○ | ○ | ○ | ● | | | | | | | | | | ○ | ○ | ○ | ● | | | | | | | | | | 17 | 17 |
| 0 | 0 | 0 | 0 | 0 | 1 | 0 | 0 | 0 | 0 | 0 | 0 | 0 | 0 | ○ | ○ | ○ | ○ | ○ | ● | | | | | | | | | ○ | ○ | ○ | ○ | ● | | | | | | | | | 27 | 27 |
| 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | ○ | ○ | ○ | ○ | ○ | ● | | | | | | | | 40 | 40 |
| 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | ○ | ○ | ○ | ○ | ○ | ○ | ● | | | | | | | 56 | 56 |
| 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | ○ | ○ | ○ | ○ | ○ | ○ | ○ | ● | | | | | | 75 | 75 |
| 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | ○ | ○ | ○ | ○ | ○ | ○ | ○ | ○ | ● | | | | | 97 | 97 |
| 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | ○ | ○ | ○ | ○ | ○ | ○ | ○ | ○ | ○ | ● | | | | 122 | 122 |
| 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | ○ | ○ | ○ | ○ | ○ | ○ | ○ | ○ | ○ | ○ | ● | | | 150 | 150 |
| 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | ○ | ○ | ○ | ○ | ○ | ○ | ○ | ○ | ○ | ○ | ○ | ● | | 182 | 182 |
| 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ● | 217 | 217 |
| 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

LIGHT-EMISSION DRIVE PATTERN IN THE DISPLAY PERIOD OF TWO FIELDS: FIRST DRIVE PERIOD; SECOND DRIVE PERIOD

LIGHT-EMISSION BRIGHTNESS: FIRST DRIVE; SECOND DRIVE

BLACK CIRCLE : SELECTIVE ERASE DISCHARGE
WHITE CIRCLE : LIGHT-EMISSION

FIG. 20

65 < VF ≦ 75

| HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 3 | 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 1 | 0 | 1 | 0 | 0 | 0 | 0 | 0 | 0 | 0 | 0 | 0 | 0 | 0 | ● | | ● | | | | | | | | | | | | ● | | | | | | | | | | | | 0 | 0 |
| 0 | 1 | 1 | 0 | 0 | 0 | 0 | 0 | 0 | 0 | 0 | 0 | 0 | 0 | ○ | ● | ● | | | | | | | | | | | | ● | | | | | | | | | | | | 1 | 0 |
| 0 | 0 | 1 | 0 | 0 | 0 | 0 | 0 | 0 | 0 | 0 | 0 | 0 | 0 | ○ | ○ | ● | | | | | | | | | | | | ● | | | | | | | | | | | | 4 | 0 |
| 0 | 0 | 0 | 1 | 0 | 0 | 0 | 0 | 0 | 0 | 0 | 0 | 0 | 0 | ○ | ○ | ○ | ● | | | | | | | | | | | ○ | ● | | | | | | | | | | | 9 | 9 |
| 0 | 0 | 0 | 0 | 1 | 0 | 0 | 0 | 0 | 0 | 0 | 0 | 0 | 0 | ○ | ○ | ○ | ○ | ● | | | | | | | | | | ○ | ○ | ● | | | | | | | | | | 17 | 17 |
| 0 | 0 | 0 | 0 | 0 | 1 | 0 | 0 | 0 | 0 | 0 | 0 | 0 | 0 | ○ | ○ | ○ | ○ | ○ | ● | | | | | | | | | ○ | ○ | ○ | ● | | | | | | | | | 27 | 27 |
| 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | ○ | ○ | ○ | ○ | ● | | | | | | | | 40 | 40 |
| 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | ○ | ○ | ○ | ○ | ○ | ● | | | | | | | 56 | 56 |
| 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | ○ | ○ | ○ | ○ | ○ | ○ | ● | | | | | | 75 | 75 |
| 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | ○ | ○ | ○ | ○ | ○ | ○ | ○ | ● | | | | | 97 | 97 |
| 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | ○ | ○ | ○ | ○ | ○ | ○ | ○ | ○ | ● | | | | 122 | 122 |
| 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | ○ | ○ | ○ | ○ | ○ | ○ | ○ | ○ | ○ | ● | | | 150 | 150 |
| 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | ○ | ○ | ○ | ○ | ○ | ○ | ○ | ○ | ○ | ○ | ● | | 182 | 182 |
| 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ● | 217 | 217 |
| 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 21

$75 < VF \leqq 85$

| HD 1 | | | | | | | | | | | | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|
| 1 | 0 | 0 | 1 | 0 | 0 | 0 | 0 | 0 | 0 | 0 | 0 | 0 | ● | | | ● | | | | | | | | | | | ● | | | | | | | | | | | 0 | 0 |
| 0 | 1 | 0 | 1 | 0 | 0 | 0 | 0 | 0 | 0 | 0 | 0 | 0 | ○ | ● | | ● | | | | | | | | | | | ● | | | | | | | | | | | 1 | 0 |
| 0 | 0 | 1 | 1 | 0 | 0 | 0 | 0 | 0 | 0 | 0 | 0 | 0 | ○ | ○ | ● | ● | | | | | | | | | | | ● | | | | | | | | | | | 4 | 0 |
| 0 | 0 | 0 | 1 | 0 | 0 | 0 | 0 | 0 | 0 | 0 | 0 | 0 | ○ | ○ | ○ | ● | | | | | | | | | | | ● | | | | | | | | | | | 9 | 0 |
| 0 | 0 | 0 | 0 | 1 | 0 | 0 | 0 | 0 | 0 | 0 | 0 | 0 | ○ | ○ | ○ | ○ | ● | | | | | | | | | | ○ | ● | | | | | | | | | | 17 | 17 |
| 0 | 0 | 0 | 0 | 0 | 1 | 0 | 0 | 0 | 0 | 0 | 0 | 0 | ○ | ○ | ○ | ○ | ○ | ● | | | | | | | | | ○ | ○ | ● | | | | | | | | | 27 | 27 |
| 0 | 0 | 0 | 0 | 0 | 0 | 1 | 0 | 0 | 0 | 0 | 0 | 0 | ○ | ○ | ○ | ○ | ○ | ○ | ● | | | | | | | | ○ | ○ | ○ | ● | | | | | | | | 40 | 40 |
| 0 | 0 | 0 | 0 | 0 | 0 | 0 | 1 | 0 | 0 | 0 | 0 | 0 | ○ | ○ | ○ | ○ | ○ | ○ | ○ | ● | | | | | | | ○ | ○ | ○ | ○ | ● | | | | | | | 56 | 56 |
| 0 | 0 | 0 | 0 | 0 | 0 | 0 | 0 | 1 | 0 | 0 | 0 | 0 | ○ | ○ | ○ | ○ | ○ | ○ | ○ | ○ | ● | | | | | | ○ | ○ | ○ | ○ | ○ | ● | | | | | | 75 | 75 |
| 0 | 0 | 0 | 0 | 0 | 0 | 0 | 0 | 0 | 1 | 0 | 0 | 0 | ○ | ○ | ○ | ○ | ○ | ○ | ○ | ○ | ○ | ● | | | | | ○ | ○ | ○ | ○ | ○ | ○ | ● | | | | | 97 | 97 |
| 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ● | | | | ○ | ○ | ○ | ○ | ○ | ○ | ○ | ● | | | | 122 | 122 |
| 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ● | | | ○ | ○ | ○ | ○ | ○ | ○ | ○ | ○ | ● | | | 150 | 150 |
| 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ● | | ○ | ○ | ○ | ○ | ○ | ○ | ○ | ○ | ○ | ● | | 182 | 182 |
| 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ● | 217 | 217 |
| 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 24

VF ≦ 60

| Ds | HD 14 | | | | | | | | | | | | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | 2 | 1 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | | | | | | | | | | | | | | | | | | | | | | | | | | | | | | | 0 | 0 |
| 0001 | 0 | 0 | 0 | 0 | 0 | 0 | 0 | 0 | 0 | 0 | 0 | 0 | 1 | | | | | | | | | | | | | | ● | | | | | | | | | | | | | | | | ● | 1 | 1 |
| 0010 | 0 | 0 | 0 | 0 | 0 | 0 | 0 | 0 | 0 | 0 | 0 | 1 | 0 | | | | | | | | | | | | | ● | ○ | | | | | | | | | | | | | | ● | ○ | 4 | 4 |
| 0011 | 0 | 0 | 0 | 0 | 0 | 0 | 0 | 0 | 0 | 0 | 1 | 0 | 0 | | | | | | | | | | | | ● | ○ | ○ | | | | | | | | | | | | ● | ○ | ○ | 9 | 9 |
| 0100 | 0 | 0 | 0 | 0 | 0 | 0 | 0 | 0 | 0 | 1 | 0 | 0 | 0 | | | | | | | | | | | ● | ○ | ○ | ○ | | | | | | | | | | | ● | ○ | ○ | ○ | 17 | 17 |
| 0101 | 0 | 0 | 0 | 0 | 0 | 0 | 0 | 0 | 1 | 0 | 0 | 0 | 0 | | | | | | | | | | ● | ○ | ○ | ○ | ○ | | | | | | | | | | ● | ○ | ○ | ○ | ○ | 27 | 27 |
| 0110 | 0 | 0 | 0 | 0 | 0 | 0 | 0 | 1 | 0 | 0 | 0 | 0 | 0 | | | | | | | | | ● | ○ | ○ | ○ | ○ | ○ | | | | | | | | | ● | ○ | ○ | ○ | ○ | ○ | 40 | 40 |
| 0111 | 0 | 0 | 0 | 0 | 0 | 0 | 1 | 0 | 0 | 0 | 0 | 0 | 0 | | | | | | | | ● | ○ | ○ | ○ | ○ | ○ | ○ | | | | | | | | ● | ○ | ○ | ○ | ○ | ○ | ○ | 56 | 56 |
| 1000 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | | | | | | | ● | ○ | ○ | ○ | ○ | ○ | ○ | ○ | 75 | 75 |
| 1001 | 0 | 0 | 0 | 0 | 0 | 1 | 0 | 0 | 0 | 0 | 0 | 0 | 0 | | | | | | ● | ○ | ○ | ○ | ○ | ○ | ○ | ○ | ○ | | | | | | ● | ○ | ○ | ○ | ○ | ○ | ○ | ○ | ○ | 97 | 97 |
| 1010 | 0 | 0 | 0 | 0 | 1 | 0 | 0 | 0 | 0 | 0 | 0 | 0 | 0 | | | | | ● | ○ | ○ | ○ | ○ | ○ | ○ | ○ | ○ | ○ | | | | | ● | ○ | ○ | ○ | ○ | ○ | ○ | ○ | ○ | ○ | 122 | 122 |
| 1011 | 0 | 0 | 0 | 1 | 0 | 0 | 0 | 0 | 0 | 0 | 0 | 0 | 0 | | | | ● | ○ | ○ | ○ | ○ | ○ | ○ | ○ | ○ | ○ | ○ | | | | ● | ○ | ○ | ○ | ○ | ○ | ○ | ○ | ○ | ○ | ○ | 150 | 150 |
| 1100 | 0 | 0 | 1 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | | | ● | ○ | ○ | ○ | ○ | ○ | ○ | ○ | ○ | ○ | ○ | ○ | 182 | 182 |
| 1101 | 0 | 1 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | | ● | ○ | ○ | ○ | ○ | ○ | ○ | ○ | ○ | ○ | ○ | ○ | ○ | 217 | 217 |
| 1110 | 1 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | 256 | 256 |

(SELECTIVE WRITE)

BLACK CIRCLE : SELECTIVE WRITE DISCHARGE AND LIGHT-EMISSION
WHITE CIRCLE : LIGHT-EMISSION

FIG. 25

60 < VF ≦ 65

| Ds | HD 14 | 13 | 12 | 11 | 10 | 9 | 8 | 7 | 6 | 5 | 4 | 3 | 2 | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | 2 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | | | | | | | | | | | | | | | 0 | 0 |
| 0001 | 0 | 0 | 0 | 0 | 0 | 0 | 0 | 0 | 0 | 0 | 0 | 0 | 0 | 1 | | | | | | | | | | | | ● | | | | | | | | | | | | | | | | | 1 | 0 |
| 0010 | 0 | 0 | 0 | 0 | 0 | 0 | 0 | 0 | 0 | 0 | 0 | 0 | 1 | 0 | | | | | | | | | | | ● | ○ | | | | | | | | | | | | | | | ● | | 4 | 4 |
| 0011 | 0 | 0 | 0 | 0 | 0 | 0 | 0 | 0 | 0 | 0 | 0 | 1 | 0 | 0 | | | | | | | | | | ● | ○ | ○ | | | | | | | | | | | | | | ● | ○ | | 9 | 9 |
| 0100 | 0 | 0 | 0 | 0 | 0 | 0 | 0 | 0 | 0 | 0 | 1 | 0 | 0 | 0 | | | | | | | | | ● | ○ | ○ | ○ | | | | | | | | | | | | | ● | ○ | ○ | | 17 | 17 |
| 0101 | 0 | 0 | 0 | 0 | 0 | 0 | 0 | 0 | 0 | 1 | 0 | 0 | 0 | 0 | | | | | | | | ● | ○ | ○ | ○ | ○ | | | | | | | | | | | | ● | ○ | ○ | ○ | | 27 | 27 |
| 0110 | 0 | 0 | 0 | 0 | 0 | 0 | 0 | 0 | 1 | 0 | 0 | 0 | 0 | 0 | | | | | | | ● | ○ | ○ | ○ | ○ | ○ | | | | | | | | | | ● | ○ | ○ | ○ | ○ | ○ | | 40 | 40 |
| 0111 | 0 | 0 | 0 | 0 | 0 | 0 | 0 | 1 | 0 | 0 | 0 | 0 | 0 | 0 | | | | | | ● | ○ | ○ | ○ | ○ | ○ | ○ | | | | | | | | | ● | ○ | ○ | ○ | ○ | ○ | ○ | | 56 | 56 |
| 1000 | 0 | 0 | 0 | 0 | 0 | 0 | 1 | 0 | 0 | 0 | 0 | 0 | 0 | 0 | | | | | | ● | ○ | ○ | ○ | ○ | ○ | ○ | ○ | | | | | | | ● | ○ | ○ | ○ | ○ | ○ | ○ | ○ | | 75 | 75 |
| 1001 | 0 | 0 | 0 | 0 | 0 | 1 | 0 | 0 | 0 | 0 | 0 | 0 | 0 | 0 | | | | | ● | ○ | ○ | ○ | ○ | ○ | ○ | ○ | ○ | ○ | | | | | ● | ○ | ○ | ○ | ○ | ○ | ○ | ○ | ○ | | 97 | 97 |
| 1010 | 0 | 0 | 0 | 0 | 1 | 0 | 0 | 0 | 0 | 0 | 0 | 0 | 0 | 0 | | | | ● | ○ | ○ | ○ | ○ | ○ | ○ | ○ | ○ | ○ | ○ | | | | ● | ○ | ○ | ○ | ○ | ○ | ○ | ○ | ○ | ○ | ○ | 122 | 122 |
| 1011 | 0 | 0 | 0 | 1 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | | | ● | ○ | ○ | ○ | ○ | ○ | ○ | ○ | ○ | ○ | ○ | ○ | 150 | 150 |
| 1100 | 0 | 0 | 1 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | | ● | ○ | ○ | ○ | ○ | ○ | ○ | ○ | ○ | ○ | ○ | ○ | ○ | 182 | 182 |
| 1101 | 0 | 1 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | 217 | 217 |
| 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | 256 | 256 |

(SELECTIVE WRITE)

BLACK CIRCLE : SELECTIVE WRITE DISCHARGE AND LIGHT-EMISSION
WHITE CIRCLE : LIGHT-EMISSION

FIG. 26

65 < VF ≦ 75

| Ds | HD 14 | 13 | 12 | 11 | 10 | 9 | 8 | 7 | 6 | 5 | 4 | 3 | 2 | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | | | | | | | | | | | | | 0 | 0 |
| 0001 | 0 | 0 | 0 | 0 | 0 | 0 | 0 | 0 | 0 | 0 | 0 | 0 | 0 | 1 | | | | | | | | | | | | | ● | | | | | | | | | | | | | | 1 | 0 |
| 0010 | 0 | 0 | 0 | 0 | 0 | 0 | 0 | 0 | 0 | 0 | 0 | 0 | 1 | 0 | | | | | | | | | | | | | ● | ○ | | | | | | | | | | | | | 4 | 0 |
| 0011 | 0 | 0 | 0 | 0 | 0 | 0 | 0 | 0 | 0 | 0 | 0 | 1 | 0 | 0 | | | | | | | | | | | | ● | ○ | ○ | | | | | | | | | | | | ● | 9 | 9 |
| 0100 | 0 | 0 | 0 | 0 | 0 | 0 | 0 | 0 | 0 | 0 | 1 | 0 | 0 | 0 | | | | | | | | | | | ● | ○ | ○ | ○ | | | | | | | | | | | ● | ○ | 17 | 17 |
| 0101 | 0 | 0 | 0 | 0 | 0 | 0 | 0 | 0 | 0 | 1 | 0 | 0 | 0 | 0 | | | | | | | | | | ● | ○ | ○ | ○ | ○ | | | | | | | | | | ● | ○ | ○ | 27 | 27 |
| 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | | | | | | | | | ● | ○ | ○ | ○ | 40 | 40 |
| 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | | | | | | | | ● | ○ | ○ | ○ | ○ | 56 | 56 |
| 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | | | | | | | ● | ○ | ○ | ○ | ○ | ○ | 75 | 75 |
| 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | | | | | | ● | ○ | ○ | ○ | ○ | ○ | ○ | 97 | 97 |
| 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | | | | | ● | ○ | ○ | ○ | ○ | ○ | ○ | ○ | 122 | 122 |
| 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | | | | ● | ○ | ○ | ○ | ○ | ○ | ○ | ○ | ○ | 150 | 150 |
| 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | | | ● | ○ | ○ | ○ | ○ | ○ | ○ | ○ | ○ | ○ | 182 | 182 |
| 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | | ● | ○ | ○ | ○ | ○ | ○ | ○ | ○ | ○ | ○ | ○ | 217 | 217 |
| 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | 256 | 256 |

(SELECTIVE WRITE)

BLACK CIRCLE : SELECTIVE WRITE DISCHARGE AND LIGHT-EMISSION
WHITE CIRCLE : LIGHT-EMISSION $75 < VF \leqq 85$

| Ds | HD 14 | 13 | 12 | 11 | 10 | 9 | 8 | 7 | 6 | 5 | 4 | 3 | 2 | 1 |
|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 |
| 0001 | 0 | 0 | 0 | 0 | 0 | 0 | 0 | 0 | 0 | 0 | 0 | 0 | 0 | 1 |
| 0010 | 0 | 0 | 0 | 0 | 0 | 0 | 0 | 0 | 0 | 0 | 0 | 0 | 1 | 0 |
| 0011 | 0 | 0 | 0 | 0 | 0 | 0 | 0 | 0 | 0 | 0 | 0 | 1 | 0 | 0 |
| 0100 | 0 | 0 | 0 | 0 | 0 | 0 | 0 | 0 | 0 | 0 | 1 | 0 | 0 | 0 |
| 0101 | 0 | 0 | 0 | 0 | 0 | 0 | 0 | 0 | 0 | 1 | 0 | 0 | 0 | 0 |
| 0110 | 0 | 0 | 0 | 0 | 0 | 0 | 0 | 0 | 1 | 0 | 0 | 0 | 0 | 0 |
| 0111 | 0 | 0 | 0 | 0 | 0 | 0 | 0 | 1 | 0 | 0 | 0 | 0 | 0 | 0 |
| 1000 | 0 | 0 | 0 | 0 | 0 | 0 | 1 | 0 | 0 | 0 | 0 | 0 | 0 | 0 |
| 1001 | 0 | 0 | 0 | 0 | 0 | 1 | 0 | 0 | 0 | 0 | 0 | 0 | 0 | 0 |
| 1010 | 0 | 0 | 0 | 0 | 1 | 0 | 0 | 0 | 0 | 0 | 0 | 0 | 0 | 0 |
| 1011 | 0 | 0 | 0 | 1 | 0 | 0 | 0 | 0 | 0 | 0 | 0 | 0 | 0 | 0 |
| 1100 | 0 | 0 | 1 | 0 | 0 | 0 | 0 | 0 | 0 | 0 | 0 | 0 | 0 | 0 |
| 1101 | 0 | 1 | 0 | 0 | 0 | 0 | 0 | 0 | 0 | 0 | 0 | 0 | 0 | 0 |
| 1110 | 1 | 0 | 0 | 0 | 0 | 0 | 0 | 0 | 0 | 0 | 0 | 0 | 0 | 0 |

(SELECTIVE WRITE)

LIGHT-EMISSION DRIVE PATTERN IN THE DISPLAY PERIOD OF TWO FIELDS

| LIGHT-EMISSION BRIGHTNESS: FIRST DRIVE | LIGHT-EMISSION BRIGHTNESS: SECOND DRIVE |
|---|---|
| 0 | 0 |
| 1 | 0 |
| 4 | 0 |
| 9 | 0 |
| 17 | 17 |
| 27 | 27 |
| 40 | 40 |
| 56 | 56 |
| 75 | 75 |
| 97 | 97 |
| 122 | 122 |
| 150 | 150 |
| 182 | 182 |
| 217 | 217 |
| 256 | 256 |

BLACK CIRCLE : SELECTIVE WRITE DISCHARGE AND LIGHT-EMISSION
WHITE CIRCLE : LIGHT-EMISSION

FIG. 28

VF ≦ 60

| Ds | HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 1 | 2 | 3 | 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 1 | 1 | 0 | 0 | 0 | 0 | 0 | 0 | 0 | 0 | 0 | 0 | 0 | 0 | ● | ● | | | | | | | | | | | | | ● | ● | | | | | | | | | | | | | 0 | 0 |
| 0001 | 0 | 1 | 1 | 0 | 0 | 0 | 0 | 0 | 0 | 0 | 0 | 0 | 0 | 0 | ○ | ● | ● | | | | | | | | | | | | ○ | ● | ● | | | | | | | | | | | | 1 | 1 |
| 0010 | 0 | 0 | 1 | 1 | 0 | 0 | 0 | 0 | 0 | 0 | 0 | 0 | 0 | 0 | ○ | ○ | ● | ● | | | | | | | | | | | ○ | ○ | ● | ● | | | | | | | | | | | 4 | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | ○ | ○ | ○ | ● | ● | | | | | | | | | | 9 | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | ○ | ○ | ○ | ○ | ● | ● | | | | | | | | | 17 | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | ○ | ○ | ○ | ○ | ○ | ● | ● | | | | | | | | 27 | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | ○ | ○ | ○ | ○ | ○ | ○ | ● | ● | | | | | | | 40 | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | ○ | ○ | ○ | ○ | ○ | ○ | ○ | ● | ● | | | | | | 56 | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | ○ | ○ | ○ | ○ | ○ | ○ | ○ | ○ | ● | ● | | | | | 75 | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | ○ | ○ | ○ | ○ | ○ | ○ | ○ | ○ | ○ | ● | ● | | | | 97 | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | ○ | ○ | ○ | ○ | ○ | ○ | ○ | ○ | ○ | ○ | ● | ● | | | 122 | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ○ | ○ | ● | ● | | 150 | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ○ | ○ | ● | ● | 182 | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | ● | 217 | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 29

60 < VF ≦ 65

| Ds | HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS — FIRST DRIVE PERIOD SF 1 | 2 | 3 | 4 | 5 | 6 | 7 | 8 | 9 | 10 | 11 | 12 | 13 | 14 | SECOND DRIVE PERIOD SF 2 | 3 | 4 | 5 | 6 | 7 | 8 | 9 | 10 | 11 | 12 | 13 | 14 | LIGHT-EMISSION BRIGHTNESS FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 1 | 1 | 1 | 0 | 0 | 0 | 0 | 0 | 0 | 0 | 0 | 0 | 0 | 0 | ● | ● | ● | | | | | | | | | | | | ● | ● | | | | | | | | | | | | 0 | 0 |
| 0001 | 0 | 1 | 1 | 0 | 0 | 0 | 0 | 0 | 0 | 0 | 0 | 0 | 0 | 0 | ○ | ● | ● | | | | | | | | | | | | ● | ● | | | | | | | | | | | | 1 | 0 |
| 0010 | 0 | 0 | 1 | 1 | 0 | 0 | 0 | 0 | 0 | 0 | 0 | 0 | 0 | 0 | ○ | ○ | ● | ● | | | | | | | | | | | ○ | ● | ● | | | | | | | | | | | 4 | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | ○ | ○ | ● | ● | | | | | | | | | | 9 | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | ○ | ○ | ○ | ● | ● | | | | | | | | | 17 | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | ○ | ○ | ○ | ○ | ● | ● | | | | | | | | 27 | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | ○ | ○ | ○ | ○ | ○ | ● | ● | | | | | | | 40 | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | ○ | ○ | ○ | ○ | ○ | ○ | ● | ● | | | | | | 56 | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | ○ | ○ | ○ | ○ | ○ | ○ | ○ | ● | ● | | | | | 75 | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | ○ | ○ | ○ | ○ | ○ | ○ | ○ | ○ | ● | ● | | | | 97 | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | ○ | ○ | ○ | ○ | ○ | ○ | ○ | ○ | ○ | ● | ● | | | 122 | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ● | ● | | | ○ | ○ | ○ | ○ | ○ | ○ | ○ | ○ | ○ | ○ | ● | ● | | 150 | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ○ | ○ | ● | ● | 182 | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ● | | ○ | ○ | ○ | ○ | ○ | ○ | ○ | ○ | ○ | ○ | ○ | ○ | ● | 217 | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 30

65 < VF ≦ 75

| Ds | HD 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 0000 | 1 | 1 | 1 | 1 | 0 | 0 | 0 | 0 | 0 | 0 | 0 | 0 | 0 | 0 |
| 0001 | 0 | 1 | 1 | 1 | 0 | 0 | 0 | 0 | 0 | 0 | 0 | 0 | 0 | 0 |
| 0010 | 0 | 0 | 1 | 1 | 0 | 0 | 0 | 0 | 0 | 0 | 0 | 0 | 0 | 0 |
| 0011 | 0 | 0 | 0 | 1 | 1 | 0 | 0 | 0 | 0 | 0 | 0 | 0 | 0 | 0 |
| 0100 | 0 | 0 | 0 | 0 | 1 | 1 | 0 | 0 | 0 | 0 | 0 | 0 | 0 | 0 |
| 0101 | 0 | 0 | 0 | 0 | 0 | 1 | 1 | 0 | 0 | 0 | 0 | 0 | 0 | 0 |
| 0110 | 0 | 0 | 0 | 0 | 0 | 0 | 1 | 1 | 0 | 0 | 0 | 0 | 0 | 0 |
| 0111 | 0 | 0 | 0 | 0 | 0 | 0 | 0 | 1 | 1 | 0 | 0 | 0 | 0 | 0 |
| 1000 | 0 | 0 | 0 | 0 | 0 | 0 | 0 | 0 | 1 | 1 | 0 | 0 | 0 | 0 |
| 1001 | 0 | 0 | 0 | 0 | 0 | 0 | 0 | 0 | 0 | 1 | 1 | 0 | 0 | 0 |
| 1010 | 0 | 0 | 0 | 0 | 0 | 0 | 0 | 0 | 0 | 0 | 1 | 1 | 0 | 0 |
| 1011 | 0 | 0 | 0 | 0 | 0 | 0 | 0 | 0 | 0 | 0 | 0 | 1 | 1 | 0 |
| 1100 | 0 | 0 | 0 | 0 | 0 | 0 | 0 | 0 | 0 | 0 | 0 | 0 | 1 | 1 |
| 1101 | 0 | 0 | 0 | 0 | 0 | 0 | 0 | 0 | 0 | 0 | 0 | 0 | 0 | 1 |
| 1110 | 0 | 0 | 0 | 0 | 0 | 0 | 0 | 0 | 0 | 0 | 0 | 0 | 0 | 0 |

(SELECTIVE ERASE)

| Ds | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 3 | 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|
| 0000 | ● | ● | ● | ● | | | | | | | | | | | ● | ● | | | | | | | | | | | 0 | 0 |
| 0001 | ○ | ● | ● | ● | | | | | | | | | | | ● | ● | | | | | | | | | | | 1 | 0 |
| 0010 | ○ | ○ | ● | ● | | | | | | | | | | | ● | ● | | | | | | | | | | | 4 | 0 |
| 0011 | ○ | ○ | ○ | ● | ● | | | | | | | | | | ○ | ● | ● | | | | | | | | | | 9 | 9 |
| 0100 | ○ | ○ | ○ | ○ | ● | ● | | | | | | | | | ○ | ○ | ● | ● | | | | | | | | | 17 | 17 |
| 0101 | ○ | ○ | ○ | ○ | ○ | ● | ● | | | | | | | | ○ | ○ | ○ | ● | ● | | | | | | | | 27 | 27 |
| 0110 | ○ | ○ | ○ | ○ | ○ | ○ | ● | ● | | | | | | | ○ | ○ | ○ | ○ | ● | ● | | | | | | | 40 | 40 |
| 0111 | ○ | ○ | ○ | ○ | ○ | ○ | ○ | ● | ● | | | | | | ○ | ○ | ○ | ○ | ○ | ● | ● | | | | | | 56 | 56 |
| 1000 | ○ | ○ | ○ | ○ | ○ | ○ | ○ | ○ | ● | ● | | | | | ○ | ○ | ○ | ○ | ○ | ○ | ● | ● | | | | | 75 | 75 |
| 1001 | ○ | ○ | ○ | ○ | ○ | ○ | ○ | ○ | ○ | ● | ● | | | | ○ | ○ | ○ | ○ | ○ | ○ | ○ | ● | ● | | | | 97 | 97 |
| 1010 | ○ | ○ | ○ | ○ | ○ | ○ | ○ | ○ | ○ | ○ | ● | ● | | | ○ | ○ | ○ | ○ | ○ | ○ | ○ | ○ | ● | ● | | | 122 | 122 |
| 1011 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ● | ● | | 150 | 150 |
| 1100 | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ● | ● | 182 | 182 |
| 1101 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ● | 217 | 217 |
| 1110 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

BLACK CIRCLE : SELECTIVE ERASE DISCHARGE
WHITE CIRCLE : LIGHT-EMISSION

FIG. 31

$75 < VF \leqq 85$

| Ds | HD 1 | | | | | | | | | | | | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 1 | 1 | 0 | 1 | 1 | 0 | 0 | 0 | 0 | 0 | 0 | 0 | 0 | ● | ● | | ● | ● | | | | | | | | | | ● | ● | | | | | | | | | | 0 | 0 |
| 0001 | 0 | 1 | 1 | 1 | 1 | 0 | 0 | 0 | 0 | 0 | 0 | 0 | 0 | ○ | ● | ● | ● | ● | | | | | | | | | | ● | ● | | | | | | | | | | 1 | 0 |
| 0010 | 0 | 0 | 1 | 1 | 1 | 0 | 0 | 0 | 0 | 0 | 0 | 0 | 0 | ○ | ○ | ● | ● | ● | | | | | | | | | | ● | ● | | | | | | | | | | 4 | 0 |
| 0011 | 0 | 0 | 0 | 1 | 1 | 0 | 0 | 0 | 0 | 0 | 0 | 0 | 0 | ○ | ○ | ○ | ● | ● | | | | | | | | | | ● | ● | | | | | | | | | | 9 | 0 |
| 0100 | 0 | 0 | 0 | 0 | 1 | 1 | 0 | 0 | 0 | 0 | 0 | 0 | 0 | ○ | ○ | ○ | ○ | ● | ● | | | | | | | | | ○ | ● | ● | | | | | | | | | 17 | 17 |
| 0101 | 0 | 0 | 0 | 0 | 0 | 1 | 1 | 0 | 0 | 0 | 0 | 0 | 0 | ○ | ○ | ○ | ○ | ○ | ● | ● | | | | | | | | ○ | ○ | ● | ● | | | | | | | | 27 | 27 |
| 0110 | 0 | 0 | 0 | 0 | 0 | 0 | 1 | 1 | 0 | 0 | 0 | 0 | 0 | ○ | ○ | ○ | ○ | ○ | ○ | ● | ● | | | | | | | ○ | ○ | ○ | ● | ● | | | | | | | 40 | 40 |
| 0111 | 0 | 0 | 0 | 0 | 0 | 0 | 0 | 1 | 1 | 0 | 0 | 0 | 0 | ○ | ○ | ○ | ○ | ○ | ○ | ○ | ● | ● | | | | | | ○ | ○ | ○ | ○ | ● | ● | | | | | | 56 | 56 |
| 1000 | 0 | 0 | 0 | 0 | 0 | 0 | 0 | 0 | 1 | 1 | 0 | 0 | 0 | ○ | ○ | ○ | ○ | ○ | ○ | ○ | ○ | ● | ● | | | | | ○ | ○ | ○ | ○ | ○ | ● | ● | | | | | 75 | 75 |
| 1001 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ● | ● | | | | ○ | ○ | ○ | ○ | ○ | ○ | ● | ● | | | | 97 | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ● | ● | | | ○ | ○ | ○ | ○ | ○ | ○ | ○ | ● | ● | | | 122 | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ● | ● | | ○ | ○ | ○ | ○ | ○ | ○ | ○ | ○ | ● | ● | | 150 | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ● | ● | ○ | ○ | ○ | ○ | ○ | ○ | ○ | ○ | ○ | ● | ● | 182 | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ● | 217 | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

VF ≦ 60

| Ds | HD 14 | 13 | 12 | 11 | 10 | 9 | 8 | 7 | 6 | 5 | 4 | 3 | 2 | 1 |
|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 |
| 0001 | 0 | 0 | 0 | 0 | 0 | 0 | 0 | 0 | 0 | 0 | 0 | 0 | 0 | 1 |
| 0010 | 0 | 0 | 0 | 0 | 0 | 0 | 0 | 0 | 0 | 0 | 0 | 0 | 1 | 1 |
| 0011 | 0 | 0 | 0 | 0 | 0 | 0 | 0 | 0 | 0 | 0 | 0 | 1 | 1 | * |
| 0100 | 0 | 0 | 0 | 0 | 0 | 0 | 0 | 0 | 0 | 0 | 1 | 1 | * | * |
| 0101 | 0 | 0 | 0 | 0 | 0 | 0 | 0 | 0 | 0 | 1 | 1 | * | * | * |
| 0110 | 0 | 0 | 0 | 0 | 0 | 0 | 0 | 0 | 1 | 1 | * | * | * | * |
| 0111 | 0 | 0 | 0 | 0 | 0 | 0 | 0 | 1 | 1 | * | * | * | * | * |
| 1000 | 0 | 0 | 0 | 0 | 0 | 0 | 1 | 1 | * | * | * | * | * | * |
| 1001 | 0 | 0 | 0 | 0 | 0 | 1 | 1 | * | * | * | * | * | * | * |
| 1010 | 0 | 0 | 0 | 0 | 1 | 1 | * | * | * | * | * | * | * | * |
| 1011 | 0 | 0 | 0 | 1 | 1 | * | * | * | * | * | * | * | * | * |
| 1100 | 0 | 0 | 1 | 1 | * | * | * | * | * | * | * | * | * | * |
| 1101 | 0 | 1 | 1 | * | * | * | * | * | * | * | * | * | * | * |
| 1110 | 1 | 1 | * | * | * | * | * | * | * | * | * | * | * | * |

(SELECTIVE WRITE)

* : "1" OR "0"

LIGHT-EMISSION DRIVE PATTERN IN THE DISPLAY PERIOD OF TWO FIELDS

| LIGHT-EMISSION BRIGHTNESS | |
|---|---|
| FIRST DRIVE | SECOND DRIVE |
| 0 | 0 |
| 1 | 1 |
| 4 | 4 |
| 9 | 9 |
| 17 | 17 |
| 27 | 27 |
| 40 | 40 |
| 56 | 56 |
| 75 | 75 |
| 97 | 97 |
| 122 | 122 |
| 150 | 150 |
| 182 | 182 |
| 217 | 217 |
| 256 | 256 |

BLACK CIRCLE : SELECTIVE WRITE DISCHARGE AND LIGHT-EMISSION
WHITE CIRCLE : LIGHT-EMISSION

FIG. 33

60 < VF ≦ 65

| Ds | HD 14 | 13 | 12 | 11 | 10 | 9 | 8 | 7 | 6 | 5 | 4 | 3 | 2 | 1 |
|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 |
| 0001 | 0 | 0 | 0 | 0 | 0 | 0 | 0 | 0 | 0 | 0 | 0 | 0 | 0 | 1 |
| 0010 | 0 | 0 | 0 | 0 | 0 | 0 | 0 | 0 | 0 | 0 | 0 | 0 | 1 | 1 |
| 0011 | 0 | 0 | 0 | 0 | 0 | 0 | 0 | 0 | 0 | 0 | 0 | 1 | 1 | * |
| 0100 | 0 | 0 | 0 | 0 | 0 | 0 | 0 | 0 | 0 | 0 | 1 | 1 | * | * |
| 0101 | 0 | 0 | 0 | 0 | 0 | 0 | 0 | 0 | 0 | 1 | 1 | * | * | * |
| 0110 | 0 | 0 | 0 | 0 | 0 | 0 | 0 | 0 | 1 | 1 | * | * | * | * |
| 0111 | 0 | 0 | 0 | 0 | 0 | 0 | 0 | 1 | 1 | * | * | * | * | * |
| 1000 | 0 | 0 | 0 | 0 | 0 | 0 | 1 | 1 | * | * | * | * | * | * |
| 1001 | 0 | 0 | 0 | 0 | 0 | 1 | 1 | * | * | * | * | * | * | * |
| 1010 | 0 | 0 | 0 | 0 | 1 | 1 | * | * | * | * | * | * | * | * |
| 1011 | 0 | 0 | 0 | 1 | 1 | * | * | * | * | * | * | * | * | * |
| 1100 | 0 | 0 | 1 | 1 | * | * | * | * | * | * | * | * | * | * |
| 1101 | 0 | 1 | 1 | * | * | * | * | * | * | * | * | * | * | * |
| 1110 | 1 | 1 | * | * | * | * | * | * | * | * | * | * | * | * |

LIGHT-EMISSION DRIVE PATTERN IN THE DISPLAY PERIOD OF TWO FIELDS

| Ds | FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | 2 |
|---|---|---|---|---|---|---|---|---|---|---|---|---|---|---|---|---|---|---|---|---|---|---|---|---|---|---|---|
| 0000 | | | | | | | | | | | | | | | | | | | | | | | | | | | |
| 0001 | | | | | | | | | | | | | | ● | | | | | | | | | | | | | |
| 0010 | | | | | | | | | | | | | ● | ● | | | | | | | | | | | | | ● |
| 0011 | | | | | | | | | | | | ● | ● | ○ | | | | | | | | | | | | ● | ● |
| 0100 | | | | | | | | | | | ● | ● | ○ | ○ | | | | | | | | | | | ● | ● | ○ |
| 0101 | | | | | | | | | | ● | ● | ○ | ○ | ○ | | | | | | | | | | ● | ● | ○ | ○ |
| 0110 | | | | | | | | | ● | ● | ○ | ○ | ○ | ○ | | | | | | | | | ● | ● | ○ | ○ | ○ |
| 0111 | | | | | | | | ● | ● | ○ | ○ | ○ | ○ | ○ | | | | | | | | ● | ● | ○ | ○ | ○ | ○ |
| 1000 | | | | | | | ● | ● | ○ | ○ | ○ | ○ | ○ | ○ | | | | | | | ● | ● | ○ | ○ | ○ | ○ | ○ |
| 1001 | | | | | | ● | ● | ○ | ○ | ○ | ○ | ○ | ○ | ○ | | | | | | ● | ● | ○ | ○ | ○ | ○ | ○ | ○ |
| 1010 | | | | | ● | ● | ○ | ○ | ○ | ○ | ○ | ○ | ○ | ○ | | | | | ● | ● | ○ | ○ | ○ | ○ | ○ | ○ | ○ |
| 1011 | | | | ● | ● | ○ | ○ | ○ | ○ | ○ | ○ | ○ | ○ | ○ | | | | ● | ● | ○ | ○ | ○ | ○ | ○ | ○ | ○ | ○ |
| 1100 | | | ● | ● | ○ | ○ | ○ | ○ | ○ | ○ | ○ | ○ | ○ | ○ | | | ● | ● | ○ | ○ | ○ | ○ | ○ | ○ | ○ | ○ | ○ |
| 1101 | | ● | ● | ○ | ○ | ○ | ○ | ○ | ○ | ○ | ○ | ○ | ○ | ○ | | ● | ● | ○ | ○ | ○ | ○ | ○ | ○ | ○ | ○ | ○ | ○ |
| 1110 | ● | ● | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ○ |

| Ds | LIGHT-EMISSION BRIGHTNESS FIRST DRIVE | SECOND DRIVE |
|---|---|---|
| 0000 | 0 | 0 |
| 0001 | 1 | 0 |
| 0010 | 4 | 4 |
| 0011 | 9 | 9 |
| 0100 | 17 | 17 |
| 0101 | 27 | 27 |
| 0110 | 40 | 40 |
| 0111 | 56 | 56 |
| 1000 | 75 | 75 |
| 1001 | 97 | 97 |
| 1010 | 122 | 122 |
| 1011 | 150 | 150 |
| 1100 | 182 | 182 |
| 1101 | 217 | 217 |
| 1110 | 256 | 256 |

(SELECTIVE WRITE)

*: "1" OR "0"

BLACK CIRCLE: SELECTIVE WRITE DISCHARGE AND LIGHT-EMISSION
WHITE CIRCLE: LIGHT-EMISSION

FIG. 34

65 < VF ≦ 75

| Ds | HD 14 | 13 | 12 | 11 | 10 | 9 | 8 | 7 | 6 | 5 | 4 | 3 | 2 | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 | | | | | | | | | | | | | | | | | | | | | | | | | | | 0 | 0 |
| 0001 | 0 | 0 | 0 | 0 | 0 | 0 | 0 | 0 | 0 | 0 | 0 | 0 | 0 | 1 | | | | | | | | | | | | | ● | | | | | | | | | | | | | | 1 | 0 |
| 0010 | 0 | 0 | 0 | 0 | 0 | 0 | 0 | 0 | 0 | 0 | 0 | 0 | 1 | 1 | | | | | | | | | | | ● | ● | | | | | | | | | | | | | | | 4 | 0 |
| 0011 | 0 | 0 | 0 | 0 | 0 | 0 | 0 | 0 | 0 | 0 | 0 | 1 | 1 | * | | | | | | | | | | ● | ● | ○ | | | | | | | | | | | | | | ● | 9 | 9 |
| 0100 | 0 | 0 | 0 | 0 | 0 | 0 | 0 | 0 | 0 | 0 | 1 | 1 | * | * | | | | | | | | | ● | ● | ○ | ○ | | | | | | | | | | | | | ● | ● | 17 | 17 |
| 0101 | 0 | 0 | 0 | 0 | 0 | 0 | 0 | 0 | 0 | 1 | 1 | * | * | * | | | | | | | | ● | ● | ○ | ○ | ○ | | | | | | | | | | | | ● | ● | ○ | 27 | 27 |
| 0110 | 0 | 0 | 0 | 0 | 0 | 0 | 0 | 0 | 1 | 1 | * | * | * | * | | | | | | | ● | ● | ○ | ○ | ○ | ○ | | | | | | | | | | | ● | ● | ○ | ○ | 40 | 40 |
| 0111 | 0 | 0 | 0 | 0 | 0 | 0 | 0 | 1 | 1 | * | * | * | * | * | | | | | | ● | ● | ○ | ○ | ○ | ○ | ○ | | | | | | | | | | ● | ● | ○ | ○ | ○ | 56 | 56 |
| 1000 | 0 | 0 | 0 | 0 | 0 | 0 | 1 | 1 | * | * | * | * | * | * | | | | | ● | ● | ○ | ○ | ○ | ○ | ○ | ○ | | | | | | | | | ● | ● | ○ | ○ | ○ | ○ | 75 | 75 |
| 1001 | 0 | 0 | 0 | 0 | 0 | 1 | 1 | * | * | * | * | * | * | * | | | | ● | ● | ○ | ○ | ○ | ○ | ○ | ○ | ○ | | | | | | | | ● | ● | ○ | ○ | ○ | ○ | ○ | 97 | 97 |
| 1010 | 0 | 0 | 0 | 0 | 1 | 1 | * | * | * | * | * | * | * | * | | | ● | ● | ○ | ○ | ○ | ○ | ○ | ○ | ○ | ○ | | | | | | | ● | ● | ○ | ○ | ○ | ○ | ○ | ○ | 122 | 122 |
| 1011 | 0 | 0 | 0 | 1 | 1 | * | * | * | * | * | * | * | * | * | | ● | ● | ○ | ○ | ○ | ○ | ○ | ○ | ○ | ○ | ○ | | | | | | ● | ● | ○ | ○ | ○ | ○ | ○ | ○ | ○ | 150 | 150 |
| 1100 | 0 | 0 | 1 | 1 | * | * | * | * | * | * | * | * | * | * | ● | ● | ○ | ○ | ○ | ○ | ○ | ○ | ○ | ○ | ○ | ○ | | | | | ● | ● | ○ | ○ | ○ | ○ | ○ | ○ | ○ | ○ | 182 | 182 |
| 1101 | 0 | 1 | 1 | * | * | * | * | * | * | * | * | * | * | * | ● | ● | ○ | ○ | ○ | ○ | ○ | ○ | ○ | ○ | ○ | ○ | | | | ● | ● | ○ | ○ | ○ | ○ | ○ | ○ | ○ | ○ | ○ | 217 | 217 |
| 1110 | 1 | 1 | * | * | * | * | * | * | * | * | * | * | * | * | ● | ● | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | 256 | 256 |

(SELECTIVE WRITE) * : "1" OR "0"

BLACK CIRCLE : SELECTIVE WRITE DISCHARGE AND LIGHT-EMISSION
WHITE CIRCLE : LIGHT-EMISSION

FIG. 35

75 < VF ≦ 85

| Ds | HD 14 | 13 | 12 | 11 | 10 | 9 | 8 | 7 | 6 | 5 | 4 | 3 | 2 | 1 |
|---|---|---|---|---|---|---|---|---|---|---|---|---|---|---|
| 0000 | 0 | 0 | 0 | 0 | 0 | 0 | 0 | 0 | 0 | 0 | 0 | 0 | 0 | 0 |
| 0001 | 0 | 0 | 0 | 0 | 0 | 0 | 0 | 0 | 0 | 0 | 0 | 0 | 0 | 1 |
| 0010 | 0 | 0 | 0 | 0 | 0 | 0 | 0 | 0 | 0 | 0 | 0 | 0 | 1 | 1 |
| 0011 | 0 | 0 | 0 | 0 | 0 | 0 | 0 | 0 | 0 | 0 | 0 | 1 | 1 | * |
| 0100 | 0 | 0 | 0 | 0 | 0 | 0 | 0 | 0 | 0 | 0 | 1 | 1 | * | * |
| 0101 | 0 | 0 | 0 | 0 | 0 | 0 | 0 | 0 | 0 | 1 | 1 | * | * | * |
| 0110 | 0 | 0 | 0 | 0 | 0 | 0 | 0 | 0 | 1 | 1 | * | * | * | * |
| 0111 | 0 | 0 | 0 | 0 | 0 | 0 | 0 | 1 | 1 | * | * | * | * | * |
| 1000 | 0 | 0 | 0 | 0 | 0 | 0 | 1 | 1 | * | * | * | * | * | * |
| 1001 | 0 | 0 | 0 | 0 | 0 | 1 | 1 | * | * | * | * | * | * | * |
| 1010 | 0 | 0 | 0 | 0 | 1 | 1 | * | * | * | * | * | * | * | * |
| 1011 | 0 | 0 | 0 | 1 | 1 | * | * | * | * | * | * | * | * | * |
| 1100 | 0 | 0 | 1 | 1 | * | * | * | * | * | * | * | * | * | * |
| 1101 | 0 | 1 | 1 | * | * | * | * | * | * | * | * | * | * | * |
| 1110 | 1 | 1 | * | * | * | * | * | * | * | * | * | * | * | * |

LIGHT-EMISSION DRIVE PATTERN IN THE DISPLAY PERIOD OF TWO FIELDS

| Ds | FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 |
|---|---|---|---|---|---|---|---|---|---|---|---|---|---|---|---|---|---|---|---|---|---|---|---|---|---|
| 0000 | | | | | | | | | | | | | | | | | | | | | | | | | |
| 0001 | | | | | | | | | | | | | | ● | | | | | | | | | | | |
| 0010 | | | | | | | | | | | | | ● | ● | | | | | | | | | | | |
| 0011 | | | | | | | | | | | | ● | ● | ○ | | | | | | | | | | | |
| 0100 | | | | | | | | | | | ● | ● | ○ | ○ | | | | | | | | | | | ● |
| 0101 | | | | | | | | | | ● | ● | ○ | ○ | ○ | | | | | | | | | | ● | ● |
| 0110 | | | | | | | | | ● | ● | ○ | ○ | ○ | ○ | | | | | | | | | ● | ● | ○ |
| 0111 | | | | | | | | ● | ● | ○ | ○ | ○ | ○ | ○ | | | | | | | | ● | ● | ○ | ○ |
| 1000 | | | | | | | ● | ● | ○ | ○ | ○ | ○ | ○ | ○ | | | | | | | ● | ● | ○ | ○ | ○ |
| 1001 | | | | | | ● | ● | ○ | ○ | ○ | ○ | ○ | ○ | ○ | | | | | | ● | ● | ○ | ○ | ○ | ○ |
| 1010 | | | | | ● | ● | ○ | ○ | ○ | ○ | ○ | ○ | ○ | ○ | | | | | ● | ● | ○ | ○ | ○ | ○ | ○ |
| 1011 | | | | ● | ● | ○ | ○ | ○ | ○ | ○ | ○ | ○ | ○ | ○ | | | | ● | ● | ○ | ○ | ○ | ○ | ○ | ○ |
| 1100 | | | ● | ● | ○ | ○ | ○ | ○ | ○ | ○ | ○ | ○ | ○ | ○ | | | ● | ● | ○ | ○ | ○ | ○ | ○ | ○ | ○ |
| 1101 | | ● | ● | ○ | ○ | ○ | ○ | ○ | ○ | ○ | ○ | ○ | ○ | ○ | | ● | ● | ○ | ○ | ○ | ○ | ○ | ○ | ○ | ○ |
| 1110 | ● | ● | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ |

| Ds | LIGHT-EMISSION BRIGHTNESS FIRST DRIVE | SECOND DRIVE |
|---|---|---|
| 0000 | 0 | 0 |
| 0001 | 1 | 0 |
| 0010 | 4 | 0 |
| 0011 | 9 | 0 |
| 0100 | 17 | 17 |
| 0101 | 27 | 27 |
| 0110 | 40 | 40 |
| 0111 | 56 | 56 |
| 1000 | 75 | 75 |
| 1001 | 97 | 97 |
| 1010 | 122 | 122 |
| 1011 | 150 | 150 |
| 1100 | 182 | 182 |
| 1101 | 217 | 217 |
| 1110 | 256 | 256 |

(SELECTIVE WRITE) * : "1" OR "0"

BLACK CIRCLE : SELECTIVE WRITE DISCHARGE AND LIGHT-EMISSION
WHITE CIRCLE : LIGHT-EMISSION

FIG. 39

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 8 | BRIGHT-NESS | 0 ~ 7 | BRIGHT-NESS | 0 ~ 8 |
| 0 | 00000000 | 0 | 000000000 | 64 | 01000000 | 88 | 001011000 |
| 1 | 00000001 | 1 | 000000001 | 65 | 01000001 | 89 | 001011001 |
| 2 | 00000010 | 2 | 000000010 | 66 | 01000010 | 91 | 001011011 |
| 3 | 00000011 | 3 | 000000011 | 67 | 01000011 | 92 | 001011100 |
| 4 | 00000100 | 4 | 000000100 | 68 | 01000100 | 93 | 001011101 |
| 5 | 00000101 | 5 | 000000101 | 69 | 01000101 | 95 | 001011111 |
| 6 | 00000110 | 6 | 000000110 | 70 | 01000110 | 96 | 001100000 |
| 7 | 00000111 | 8 | 000001000 | 71 | 01000111 | 98 | 001100010 |
| 8 | 00001000 | 9 | 000001001 | 72 | 01001000 | 99 | 001100011 |
| 9 | 00001001 | 11 | 000001011 | 73 | 01001001 | 100 | 001100100 |
| 10 | 00001010 | 12 | 000001100 | 74 | 01001010 | 102 | 001100110 |
| 11 | 00001011 | 13 | 000001101 | 75 | 01001011 | 103 | 001100111 |
| 12 | 00001100 | 15 | 000001111 | 76 | 01001100 | 104 | 001101000 |
| 13 | 00001101 | 16 | 000010000 | 77 | 01001101 | 106 | 001101010 |
| 14 | 00001110 | 17 | 000010001 | 78 | 01001110 | 107 | 001101011 |
| 15 | 00001111 | 19 | 000010011 | 79 | 01001111 | 109 | 001101101 |
| 16 | 00010000 | 20 | 000010100 | 80 | 01010000 | 110 | 001101110 |
| 17 | 00010001 | 22 | 000010110 | 81 | 01010001 | 111 | 001101111 |
| 18 | 00010010 | 23 | 000010111 | 82 | 01010010 | 113 | 001110001 |
| 19 | 00010011 | 24 | 000011000 | 83 | 01010011 | 114 | 001110010 |
| 20 | 00010100 | 26 | 000011010 | 84 | 01010100 | 115 | 001110011 |
| 21 | 00010101 | 27 | 000011011 | 85 | 01010101 | 117 | 001110101 |
| 22 | 00010110 | 28 | 000011100 | 86 | 01010110 | 118 | 001110110 |
| 23 | 00010111 | 30 | 000011110 | 87 | 01010111 | 120 | 001111000 |
| 24 | 00011000 | 31 | 000011111 | 88 | 01011000 | 121 | 001111001 |
| 25 | 00011001 | 33 | 000100001 | 89 | 01011001 | 122 | 001111010 |
| 26 | 00011010 | 34 | 000100010 | 90 | 01011010 | 124 | 001111100 |
| 27 | 00011011 | 35 | 000100011 | 91 | 01011011 | 125 | 001111101 |
| 28 | 00011100 | 36 | 000100100 | 92 | 01011100 | 126 | 001111110 |
| 29 | 00011101 | 36 | 000100100 | 93 | 01011101 | 128 | 010000000 |
| 30 | 00011110 | 37 | 000100101 | 94 | 01011110 | 129 | 010000001 |
| 31 | 00011111 | 38 | 000100110 | 95 | 01011111 | 131 | 010000011 |
| 32 | 00100000 | 40 | 000101000 | 96 | 01100000 | 132 | 010000100 |
| 33 | 00100001 | 41 | 000101001 | 97 | 01100001 | 133 | 010000101 |
| 34 | 00100010 | 42 | 000101010 | 98 | 01100010 | 135 | 010000111 |
| 35 | 00100011 | 44 | 000101100 | 99 | 01100011 | 136 | 010001000 |
| 36 | 00100100 | 45 | 000101101 | 100 | 01100100 | 138 | 010001010 |
| 37 | 00100101 | 46 | 000101110 | 101 | 01100101 | 139 | 010001011 |
| 38 | 00100110 | 48 | 000110000 | 102 | 01100110 | 140 | 010001100 |
| 39 | 00100111 | 49 | 000110001 | 103 | 01100111 | 142 | 010001110 |
| 40 | 00101000 | 50 | 000110010 | 104 | 01101000 | 143 | 010001111 |
| 41 | 00101001 | 51 | 000110011 | 105 | 01101001 | 144 | 010010000 |
| 42 | 00101010 | 52 | 000110100 | 106 | 01101010 | 146 | 010010010 |
| 43 | 00101011 | 53 | 000110101 | 107 | 01101011 | 147 | 010010011 |
| 44 | 00101100 | 55 | 000110111 | 108 | 01101100 | 149 | 010010101 |
| 45 | 00101101 | 56 | 000111000 | 109 | 01101101 | 150 | 010010110 |
| 46 | 00101110 | 57 | 000111001 | 110 | 01101110 | 151 | 010010111 |
| 47 | 00101111 | 59 | 000111011 | 111 | 01101111 | 153 | 010011001 |
| 48 | 00110000 | 60 | 000111100 | 112 | 01110000 | 154 | 010011010 |
| 49 | 00110001 | 62 | 000111110 | 113 | 01110001 | 155 | 010011011 |
| 50 | 00110010 | 63 | 000111111 | 114 | 01110010 | 157 | 010011101 |
| 51 | 00110011 | 64 | 001000000 | 115 | 01110011 | 158 | 010001110 |
| 52 | 00110100 | 66 | 001000010 | 116 | 01110100 | 160 | 010100000 |
| 53 | 00110101 | 67 | 001000011 | 117 | 01110101 | 161 | 010100001 |
| 54 | 00110110 | 69 | 001000101 | 118 | 01110110 | 162 | 010100010 |
| 55 | 00110111 | 70 | 001000110 | 119 | 01110111 | 164 | 010100100 |
| 56 | 00111000 | 71 | 001000111 | 120 | 01111000 | 165 | 010100101 |
| 57 | 00111001 | 73 | 001001001 | 121 | 01111001 | 167 | 010100111 |
| 58 | 00111010 | 74 | 001001010 | 122 | 01111010 | 168 | 010101000 |
| 59 | 00111011 | 75 | 001001011 | 123 | 01111011 | 169 | 010101001 |
| 60 | 00111100 | 77 | 001001101 | 124 | 01111100 | 171 | 010101011 |
| 61 | 00111101 | 78 | 001001110 | 125 | 01111101 | 172 | 010101100 |
| 62 | 00111110 | 80 | 001010000 | 126 | 01111110 | 173 | 010101101 |
| 63 | 00111111 | 81 | 001010001 | 127 | 01111111 | 175 | 010101111 |

FIG. 40

| $D_{BL}$ | | $HD_P$ | | $D_{BL}$ | | $HD_P$ | |
|---|---|---|---|---|---|---|---|
| BRIGHT-NESS | 0 ~ 7 | BRIGHT-NESS | 0 ~ 8 | BRIGHT-NESS | 0 ~ 7 | BRIGHT-NESS | 0 ~ 8 |
| 128 | 10000000 | 176 | 010110000 | 192 | 11000000 | 265 | 100001001 |
| 129 | 10000001 | 178 | 010110010 | 193 | 11000001 | 266 | 100001010 |
| 130 | 10000010 | 179 | 010110011 | 194 | 11000010 | 267 | 100001011 |
| 131 | 10000011 | 180 | 010110100 | 195 | 11000011 | 269 | 100001101 |
| 132 | 10000100 | 182 | 010110110 | 196 | 11000100 | 270 | 100001110 |
| 133 | 10000101 | 183 | 010110111 | 197 | 11000101 | 271 | 100001111 |
| 134 | 10000110 | 184 | 010111000 | 198 | 11000110 | 273 | 100010001 |
| 135 | 10000111 | 186 | 010111010 | 199 | 11000111 | 274 | 100010010 |
| 136 | 10001000 | 187 | 010111011 | 200 | 11001000 | 276 | 100010100 |
| 137 | 10001001 | 189 | 010111101 | 201 | 11001001 | 277 | 100010101 |
| 138 | 10001010 | 190 | 010111110 | 202 | 11001010 | 278 | 100010110 |
| 139 | 10001011 | 191 | 010111111 | 203 | 11001011 | 280 | 100011000 |
| 140 | 10001100 | 193 | 011000001 | 204 | 11001100 | 281 | 100011001 |
| 141 | 10001101 | 194 | 011000010 | 205 | 11001101 | 282 | 100011010 |
| 142 | 10001110 | 196 | 011000100 | 206 | 11001110 | 284 | 100011100 |
| 143 | 10001111 | 197 | 011000101 | 207 | 11001111 | 285 | 100011101 |
| 144 | 10010000 | 198 | 011000110 | 208 | 11010000 | 287 | 100011111 |
| 145 | 10010001 | 200 | 011001000 | 209 | 11010001 | 288 | 100100000 |
| 146 | 10010010 | 201 | 011001001 | 210 | 11010010 | 289 | 100100001 |
| 147 | 10010011 | 202 | 011001010 | 211 | 11010011 | 291 | 100100011 |
| 148 | 10010100 | 204 | 011001100 | 212 | 11010100 | 292 | 100100100 |
| 149 | 10010101 | 205 | 011001101 | 213 | 11010101 | 294 | 100100110 |
| 150 | 10010110 | 207 | 011001111 | 214 | 11010110 | 295 | 100100111 |
| 151 | 10010111 | 208 | 011010000 | 215 | 11010111 | 296 | 100101000 |
| 152 | 10011000 | 209 | 011010001 | 216 | 11011000 | 298 | 100101010 |
| 153 | 10011001 | 211 | 011010011 | 217 | 11011001 | 299 | 100101011 |
| 154 | 10011010 | 212 | 011010100 | 218 | 11011010 | 300 | 100101100 |
| 155 | 10011011 | 213 | 011010101 | 219 | 11011011 | 302 | 100101110 |
| 156 | 10011100 | 215 | 011010111 | 220 | 11011100 | 303 | 100101111 |
| 157 | 10011101 | 216 | 011011001 | 221 | 11011101 | 305 | 100110001 |
| 158 | 10011110 | 218 | 011011010 | 222 | 11011110 | 306 | 100110010 |
| 159 | 10011111 | 219 | 011011011 | 223 | 11011111 | 307 | 100110011 |
| 160 | 10100000 | 220 | 011011100 | 224 | 11100000 | 309 | 100110101 |
| 161 | 10100001 | 222 | 011011110 | 225 | 11100001 | 310 | 100110110 |
| 162 | 10100010 | 223 | 011011111 | 226 | 11100010 | 311 | 100110111 |
| 163 | 10100011 | 225 | 011100001 | 227 | 11100011 | 313 | 100111001 |
| 164 | 10100100 | 226 | 011100010 | 228 | 11100100 | 314 | 100111010 |
| 165 | 10100101 | 227 | 011100011 | 229 | 11100101 | 316 | 100111100 |
| 166 | 10100110 | 229 | 011100101 | 230 | 11100110 | 317 | 100111101 |
| 167 | 10100111 | 230 | 011100110 | 231 | 11100111 | 318 | 100111110 |
| 168 | 10101000 | 231 | 011100111 | 232 | 11101000 | 320 | 101000000 |
| 169 | 10101001 | 233 | 011101001 | 233 | 11101001 | 321 | 101000001 |
| 170 | 10101010 | 234 | 011101010 | 234 | 11101010 | 323 | 101000011 |
| 171 | 10101011 | 236 | 011101100 | 235 | 11101011 | 324 | 101000100 |
| 172 | 10101100 | 237 | 011101101 | 236 | 11101100 | 325 | 101000101 |
| 173 | 10101101 | 238 | 011101110 | 237 | 11101101 | 327 | 101000111 |
| 174 | 10101110 | 240 | 011110000 | 238 | 11101110 | 328 | 101001000 |
| 175 | 10101111 | 241 | 011110001 | 239 | 11101111 | 329 | 101001001 |
| 176 | 10110000 | 242 | 011110010 | 240 | 11110000 | 331 | 101001011 |
| 177 | 10110001 | 244 | 011110100 | 241 | 11110001 | 332 | 101001100 |
| 178 | 10110010 | 245 | 011110101 | 242 | 11110010 | 334 | 101001110 |
| 179 | 10110011 | 247 | 011110111 | 243 | 11110011 | 335 | 101001111 |
| 180 | 10110100 | 248 | 011111000 | 244 | 11110100 | 336 | 101010000 |
| 181 | 10110101 | 249 | 011111001 | 245 | 11110101 | 338 | 101010010 |
| 182 | 10110110 | 251 | 011111011 | 246 | 11110110 | 339 | 101010011 |
| 183 | 10110111 | 252 | 011111100 | 247 | 11110111 | 340 | 101010100 |
| 184 | 10111000 | 253 | 011111101 | 248 | 11111000 | 342 | 101010110 |
| 185 | 10111001 | 255 | 011111111 | 249 | 11111001 | 343 | 101010111 |
| 186 | 10111010 | 256 | 100000000 | 250 | 11111010 | 345 | 101011001 |
| 187 | 10111011 | 258 | 100000010 | 251 | 11111011 | 346 | 101011010 |
| 188 | 10111100 | 259 | 100000011 | 252 | 11111100 | 347 | 101011011 |
| 189 | 10111101 | 260 | 100000100 | 253 | 11111101 | 349 | 101011101 |
| 190 | 10111110 | 262 | 100000110 | 254 | 11111110 | 350 | 101011110 |
| 191 | 10111111 | 263 | 100000111 | 255 | 11111111 | 352 | 101100000 |

FIG. 41

VF ≦ 60

| Ds | HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 1 | 2 | 3 | 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 1 | 1 | 0 | 0 | 0 | 0 | 1 | 1 | 0 | 0 | 0 | 0 | 0 | 0 | ● | ● | | | | | ● | ● | | | | | | | ● | ● | | | | | ● | ● | | | | | | | 0 | 0 |
| 00001 | 0 | 1 | 1 | 0 | 0 | 0 | 1 | 1 | 0 | 0 | 0 | 0 | 0 | 0 | ○ | ● | ● | | | | ● | ● | | | | | | | ○ | ● | ● | | | | ● | ● | | | | | | | 1 | 1 |
| 00010 | 0 | 0 | 1 | 1 | 0 | 0 | 1 | 1 | 0 | 0 | 0 | 0 | 0 | 0 | ○ | ○ | ● | ● | | | ● | ● | | | | | | | ○ | ○ | ● | ● | | | ● | ● | | | | | | | 2 | 2 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | ○ | ○ | ○ | ● | ● | | ● | ● | | | | | | | 3 | 3 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | ○ | ○ | ○ | ○ | ● | ● | ● | ● | | | | | | | 6 | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | ○ | ○ | ○ | ○ | ○ | ● | ● | ● | | | | | | | 9 | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | ○ | ○ | ○ | ○ | ○ | ○ | ● | ● | | | | | | | 17 | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | ○ | ○ | ○ | ○ | ○ | ● | ○ | ● | ● | | | | | | 22 | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | ○ | ○ | ○ | ○ | ○ | ○ | ○ | ● | ● | | | | | | 30 | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | ○ | ○ | ○ | ○ | ○ | ● | ○ | ○ | ● | ● | | | | | 37 | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | ○ | ○ | ○ | ○ | ○ | ○ | ○ | ○ | ● | ● | | | | | 45 | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | ○ | ○ | ○ | ○ | ○ | ● | ○ | ○ | ○ | ● | ● | | | | 57 | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | ○ | ○ | ○ | ○ | ○ | ○ | ○ | ○ | ○ | ● | ● | | | | 65 | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | ○ | ○ | ○ | ○ | ○ | ● | ○ | ○ | ○ | ○ | ● | ● | | | 82 | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ● | ● | | | | ○ | ○ | ○ | ○ | ○ | ○ | ○ | ○ | ○ | ○ | ● | ● | | | 90 | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | ○ | ○ | ○ | ○ | ○ | ● | ○ | ○ | ○ | ○ | ○ | ● | ● | | 113 | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ○ | ○ | ○ | ● | ● | 121 | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | ○ | ○ | ○ | ○ | ○ | ● | ○ | ○ | ○ | ○ | ○ | ○ | ● | ● | 150 | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ○ | ○ | ● | ● | 158 | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | ○ | ○ | ○ | ○ | ● | ● | ○ | ○ | ○ | ○ | ○ | ○ | ○ | ● | 195 | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ○ | ● | 206 | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | ○ | ○ | ○ | ○ | ● | ● | ○ | ○ | ○ | ○ | ○ | ○ | ○ | ○ | 245 | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 42

60 < VF ≦ 65

| Ds | HD 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| 00000 | 1 | 1 | 1 | 0 | 0 | 0 | 1 | 1 | 0 | 0 | 0 | 0 | 0 | 0 |
| 00001 | 0 | 1 | 1 | 0 | 0 | 0 | 1 | 1 | 0 | 0 | 0 | 0 | 0 | 0 |
| 00010 | 0 | 0 | 1 | 1 | 0 | 0 | 1 | 1 | 0 | 0 | 0 | 0 | 0 | 0 |
| 00011 | 0 | 0 | 0 | 1 | 1 | 0 | 1 | 1 | 0 | 0 | 0 | 0 | 0 | 0 |
| 00100 | 0 | 0 | 0 | 0 | 1 | 1 | 1 | 1 | 0 | 0 | 0 | 0 | 0 | 0 |
| 00101 | 0 | 0 | 0 | 0 | 0 | 1 | 1 | 1 | 0 | 0 | 0 | 0 | 0 | 0 |
| 00110 | 0 | 0 | 0 | 0 | 0 | 0 | 1 | 1 | 0 | 0 | 0 | 0 | 0 | 0 |
| 00111 | 0 | 0 | 0 | 0 | 0 | 1 | 0 | 1 | 1 | 0 | 0 | 0 | 0 | 0 |
| 01000 | 0 | 0 | 0 | 0 | 0 | 0 | 0 | 1 | 1 | 0 | 0 | 0 | 0 | 0 |
| 01001 | 0 | 0 | 0 | 0 | 0 | 1 | 0 | 0 | 1 | 1 | 0 | 0 | 0 | 0 |
| 01010 | 0 | 0 | 0 | 0 | 0 | 0 | 0 | 0 | 1 | 1 | 0 | 0 | 0 | 0 |
| 01011 | 0 | 0 | 0 | 0 | 0 | 1 | 0 | 0 | 0 | 1 | 1 | 0 | 0 | 0 |
| 01100 | 0 | 0 | 0 | 0 | 0 | 0 | 0 | 0 | 0 | 1 | 1 | 0 | 0 | 0 |
| 01101 | 0 | 0 | 0 | 0 | 0 | 1 | 0 | 0 | 0 | 0 | 1 | 1 | 0 | 0 |
| 01110 | 0 | 0 | 0 | 0 | 0 | 0 | 0 | 0 | 0 | 0 | 1 | 1 | 0 | 0 |
| 01111 | 0 | 0 | 0 | 0 | 0 | 1 | 0 | 0 | 0 | 0 | 0 | 1 | 1 | 0 |
| 10000 | 0 | 0 | 0 | 0 | 0 | 0 | 0 | 0 | 0 | 0 | 0 | 1 | 1 | 0 |
| 10001 | 0 | 0 | 0 | 0 | 0 | 1 | 0 | 0 | 0 | 0 | 0 | 0 | 1 | 1 |
| 10010 | 0 | 0 | 0 | 0 | 0 | 0 | 0 | 0 | 0 | 0 | 0 | 0 | 1 | 1 |
| 10011 | 0 | 0 | 0 | 0 | 1 | 1 | 0 | 0 | 0 | 0 | 0 | 0 | 0 | 1 |
| 10100 | 0 | 0 | 0 | 0 | 0 | 0 | 0 | 0 | 0 | 0 | 0 | 0 | 0 | 1 |
| 10101 | 0 | 0 | 0 | 0 | 1 | 1 | 0 | 0 | 0 | 0 | 0 | 0 | 0 | 0 |
| 10110 | 0 | 0 | 0 | 0 | 0 | 0 | 0 | 0 | 0 | 0 | 0 | 0 | 0 | 0 |

LIGHT-EMISSION DRIVE PATTERN IN THE DISPLAY PERIOD OF TWO FIELDS

| Ds | FIRST DRIVE PERIOD SF 1 | 2 | 3 | 4 | 5 | 6 | 7 | 8 | 9 | 10 | 11 | 12 | 13 | 14 | SECOND DRIVE PERIOD SF 2 | 3 | 4 | 5 | 6 | 7 | 8 | 9 | 10 | 11 | 12 | 13 | 14 |
|---|---|---|---|---|---|---|---|---|---|---|---|---|---|---|---|---|---|---|---|---|---|---|---|---|---|---|---|
| 00000 | ● | ● | ● | | | | ● | ● | | | | | | | ● | ● | | | | ● | ● | | | | | | |
| 00001 | ○ | ● | ● | | | | ● | ● | | | | | | | ● | ● | | | | ● | ● | | | | | | |
| 00010 | ○ | ○ | ● | ● | | | ● | ● | | | | | | | ○ | ● | ● | | | ● | ● | | | | | | |
| 00011 | ○ | ○ | ○ | ● | ● | | ● | ● | | | | | | | ○ | ○ | ● | ● | | ● | ● | | | | | | |
| 00100 | ○ | ○ | ○ | ○ | ● | ● | ● | ● | | | | | | | ○ | ○ | ○ | ● | ● | ● | ● | | | | | | |
| 00101 | ○ | ○ | ○ | ○ | ○ | ● | ● | ● | | | | | | | ○ | ○ | ○ | ○ | ● | ● | ● | | | | | | |
| 00110 | ○ | ○ | ○ | ○ | ○ | ○ | ● | ● | | | | | | | ○ | ○ | ○ | ○ | ○ | ● | ● | | | | | | |
| 00111 | ○ | ○ | ○ | ○ | ○ | ● | ○ | ● | ● | | | | | | ○ | ○ | ○ | ○ | ● | ○ | ● | ● | | | | | |
| 01000 | ○ | ○ | ○ | ○ | ○ | ○ | ○ | ● | ● | | | | | | ○ | ○ | ○ | ○ | ○ | ○ | ● | ● | | | | | |
| 01001 | ○ | ○ | ○ | ○ | ○ | ● | ○ | ○ | ● | ● | | | | | ○ | ○ | ○ | ○ | ● | ○ | ○ | ● | ● | | | | |
| 01010 | ○ | ○ | ○ | ○ | ○ | ○ | ○ | ○ | ● | ● | | | | | ○ | ○ | ○ | ○ | ○ | ○ | ○ | ● | ● | | | | |
| 01011 | ○ | ○ | ○ | ○ | ○ | ● | ○ | ○ | ○ | ● | ● | | | | ○ | ○ | ○ | ○ | ● | ○ | ○ | ○ | ● | ● | | | |
| 01100 | ○ | ○ | ○ | ○ | ○ | ○ | ○ | ○ | ○ | ● | ● | | | | ○ | ○ | ○ | ○ | ○ | ○ | ○ | ○ | ● | ● | | | |
| 01101 | ○ | ○ | ○ | ○ | ○ | ● | ○ | ○ | ○ | ○ | ● | ● | | | ○ | ○ | ○ | ○ | ● | ○ | ○ | ○ | ○ | ● | ● | | |
| 01110 | ○ | ○ | ○ | ○ | ○ | ○ | ○ | ○ | ○ | ○ | ● | ● | | | ○ | ○ | ○ | ○ | ○ | ○ | ○ | ○ | ○ | ● | ● | | |
| 01111 | ○ | ○ | ○ | ○ | ○ | ● | ○ | ○ | ○ | ○ | ○ | ● | ● | | ○ | ○ | ○ | ○ | ● | ○ | ○ | ○ | ○ | ○ | ● | ● | |
| 10000 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ○ | ● | ● | |
| 10001 | ○ | ○ | ○ | ○ | ○ | ● | ○ | ○ | ○ | ○ | ○ | ○ | ● | ● | ○ | ○ | ○ | ○ | ● | ○ | ○ | ○ | ○ | ○ | ○ | ● | ● |
| 10010 | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ○ | ● | ● |
| 10011 | ○ | ○ | ○ | ○ | ● | ● | ○ | ○ | ○ | ○ | ○ | ○ | ○ | ● | ○ | ○ | ○ | ● | ● | ○ | ○ | ○ | ○ | ○ | ○ | ○ | ● |
| 10100 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ○ | ● |
| 10101 | ○ | ○ | ○ | ○ | ● | ● | ○ | ○ | ○ | ○ | ○ | ○ | ○ | ○ | ○ | ○ | ○ | ● | ● | ○ | ○ | ○ | ○ | ○ | ○ | ○ | ○ |
| 10110 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

| Ds | LIGHT-EMISSION BRIGHTNESS FIRST DRIVE | SECOND DRIVE |
|---|---|---|
| 00000 | 0 | 0 |
| 00001 | 1 | 0 |
| 00010 | 2 | 2 |
| 00011 | 3 | 3 |
| 00100 | 6 | 6 |
| 00101 | 9 | 9 |
| 00110 | 17 | 17 |
| 00111 | 22 | 22 |
| 01000 | 30 | 30 |
| 01001 | 37 | 37 |
| 01010 | 45 | 45 |
| 01011 | 57 | 57 |
| 01100 | 65 | 65 |
| 01101 | 82 | 82 |
| 01110 | 90 | 90 |
| 01111 | 113 | 113 |
| 10000 | 121 | 121 |
| 10001 | 150 | 150 |
| 10010 | 158 | 158 |
| 10011 | 195 | 195 |
| 10100 | 206 | 206 |
| 10101 | 245 | 245 |
| 10110 | 256 | 256 |

(SELECTIVE ERASE)

BLACK CIRCLE : SELECTIVE ERASE DISCHARGE
WHITE CIRCLE : LIGHT-EMISSION

FIG. 43

65 < VF ≦ 75

| Ds | HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS — FIRST DRIVE PERIOD SF 1 | 2 | 3 | 4 | 5 | 6 | 7 | 8 | 9 | 10 | 11 | 12 | 13 | 14 | SECOND DRIVE PERIOD SF 3 | 4 | 5 | 6 | 7 | 8 | 9 | 10 | 11 | 12 | 13 | 14 | LIGHT-EMISSION BRIGHTNESS FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 1 | 1 | 1 | 1 | 0 | 0 | 1 | 1 | 0 | 0 | 0 | 0 | 0 | 0 | ● | ● | ● | ● | | | ● | ● | | | | | | | ● | ● | | | ● | ● | | | | | | | 0 | 0 |
| 00001 | 0 | 1 | 1 | 1 | 0 | 0 | 1 | 1 | 0 | 0 | 0 | 0 | 0 | 0 | ○ | ● | ● | ● | | | ● | ● | | | | | | | ● | ● | | | ● | ● | | | | | | | 1 | 0 |
| 00010 | 0 | 0 | 1 | 1 | 0 | 0 | 1 | 1 | 0 | 0 | 0 | 0 | 0 | 0 | ○ | ○ | ● | ● | | | ● | ● | | | | | | | ● | ● | | | ● | ● | | | | | | | 2 | 0 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | ○ | ● | ● | | ● | ● | | | | | | | 3 | 3 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | ○ | ○ | ● | ● | ● | ● | | | | | | | 6 | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | ○ | ○ | ○ | ● | ● | ● | | | | | | | 9 | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | ○ | ○ | ○ | ○ | ● | ● | | | | | | | 17 | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | ○ | ○ | ○ | ● | ○ | ● | ● | | | | | | 22 | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | ○ | ○ | ○ | ○ | ○ | ● | ● | | | | | | 30 | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | ○ | ○ | ○ | ● | ○ | ○ | ● | ● | | | | | 37 | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | ○ | ○ | ○ | ○ | ○ | ○ | ● | ● | | | | | 45 | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | ○ | ○ | ○ | ● | ○ | ○ | ○ | ● | ● | | | | 57 | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | ○ | ○ | ○ | ○ | ○ | ○ | ○ | ● | ● | | | | 65 | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | ○ | ○ | ○ | ● | ○ | ○ | ○ | ○ | ● | ● | | | 82 | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ● | ● | | | | ○ | ○ | ○ | ○ | ○ | ○ | ○ | ○ | ● | ● | | | 90 | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | ○ | ○ | ○ | ● | ○ | ○ | ○ | ○ | ○ | ● | ● | | 113 | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ● | ● | | | ○ | ○ | ○ | ○ | ○ | ○ | ○ | ○ | ○ | ● | ● | | 121 | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | ○ | ○ | ○ | ● | ○ | ○ | ○ | ○ | ○ | ○ | ● | ● | 150 | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | ○ | ○ | ○ | ○ | ○ | ○ | ○ | ○ | ○ | ○ | ● | ● | 158 | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | ○ | ○ | ● | ● | ○ | ○ | ○ | ○ | ○ | ○ | ○ | ● | 195 | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ○ | ● | 206 | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | ○ | ○ | ● | ● | ○ | ○ | ○ | ○ | ○ | ○ | ○ | ○ | 245 | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 44

75 < VF ≦ 85

| Ds | HD 1 | 2 | 3 | 4 | 5 | 6 | 7 | 8 | 9 | 10 | 11 | 12 | 13 | 14 | LIGHT-EMISSION DRIVE PATTERN IN THE DISPLAY PERIOD OF TWO FIELDS: FIRST DRIVE PERIOD SF 1 | 2 | 3 | 4 | 5 | 6 | 7 | 8 | 9 | 10 | 11 | 12 | 13 | 14 | SECOND DRIVE PERIOD SF 4 | 5 | 6 | 7 | 8 | 9 | 10 | 11 | 12 | 13 | 14 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 1 | 1 | 0 | 1 | 1 | 0 | 1 | 1 | 0 | 0 | 0 | 0 | 0 | 0 | ● | ● | | ● | ● | | ● | ● | | | | | | | ● | ● | | ● | ● | | | | | | | 0 | 0 |
| 00001 | 0 | 1 | 1 | 1 | 1 | 0 | 1 | 1 | 0 | 0 | 0 | 0 | 0 | 0 | ○ | ● | ● | ● | ● | | ● | ● | | | | | | | ● | ● | | ● | ● | | | | | | | 1 | 0 |
| 00010 | 0 | 0 | 1 | 1 | 1 | 0 | 1 | 1 | 0 | 0 | 0 | 0 | 0 | 0 | ○ | ○ | ● | ● | ● | | ● | ● | | | | | | | ● | ● | | ● | ● | | | | | | | 2 | 0 |
| 00011 | 0 | 0 | 0 | 1 | 1 | 0 | 1 | 1 | 0 | 0 | 0 | 0 | 0 | 0 | ○ | ○ | ○ | ● | ● | | ● | ● | | | | | | | ● | ● | | ● | ● | | | | | | | 3 | 0 |
| 00100 | 0 | 0 | 0 | 0 | 1 | 1 | 1 | 1 | 0 | 0 | 0 | 0 | 0 | 0 | ○ | ○ | ○ | ○ | ● | ● | ● | ● | | | | | | | ○ | ● | ● | ● | ● | | | | | | | 6 | 6 |
| 00101 | 0 | 0 | 0 | 0 | 0 | 1 | 1 | 1 | 0 | 0 | 0 | 0 | 0 | 0 | ○ | ○ | ○ | ○ | ○ | ● | ● | ● | | | | | | | ○ | ○ | ● | ● | ● | | | | | | | 9 | 9 |
| 00110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | ○ | ○ | ○ | ● | ● | | | | | | | 17 | 17 |
| 00111 | 0 | 0 | 0 | 0 | 0 | 1 | 0 | 1 | 1 | 0 | 0 | 0 | 0 | 0 | ○ | ○ | ○ | ○ | ○ | ● | ○ | ● | ● | | | | | | ○ | ○ | ● | ○ | ● | ● | | | | | | 22 | 22 |
| 01000 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | ○ | ○ | ○ | ○ | ● | ● | | | | | | 30 | 30 |
| 01001 | 0 | 0 | 0 | 0 | 0 | 1 | 0 | 0 | 1 | 1 | 0 | 0 | 0 | 0 | ○ | ○ | ○ | ○ | ○ | ● | ○ | ○ | ● | ● | | | | | ○ | ○ | ● | ○ | ○ | ● | ● | | | | | 37 | 37 |
| 01010 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | ○ | ○ | ○ | ○ | ○ | ● | ● | | | | | 45 | 45 |
| 01011 | 0 | 0 | 0 | 0 | 0 | 1 | 0 | 0 | 0 | 1 | 1 | 0 | 0 | 0 | ○ | ○ | ○ | ○ | ○ | ● | ○ | ○ | ○ | ● | ● | | | | ○ | ○ | ● | ○ | ○ | ○ | ● | ● | | | | 57 | 57 |
| 01100 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | ○ | ○ | ○ | ○ | ○ | ○ | ● | ● | | | | 65 | 65 |
| 01101 | 0 | 0 | 0 | 0 | 0 | 1 | 0 | 0 | 0 | 0 | 1 | 1 | 0 | 0 | ○ | ○ | ○ | ○ | ○ | ● | ○ | ○ | ○ | ○ | ● | ● | | | ○ | ○ | ● | ○ | ○ | ○ | ○ | ● | ● | | | 82 | 82 |
| 01110 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | ○ | ○ | ○ | ○ | ○ | ○ | ○ | ● | ● | | | 90 | 90 |
| 01111 | 0 | 0 | 0 | 0 | 0 | 1 | 0 | 0 | 0 | 0 | 0 | 1 | 1 | 0 | ○ | ○ | ○ | ○ | ○ | ● | ○ | ○ | ○ | ○ | ○ | ● | ● | | ○ | ○ | ● | ○ | ○ | ○ | ○ | ○ | ● | ● | | 113 | 113 |
| 10000 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | ○ | ○ | ○ | ○ | ○ | ○ | ○ | ○ | ● | ● | | 121 | 121 |
| 10001 | 0 | 0 | 0 | 0 | 0 | 1 | 0 | 0 | 0 | 0 | 0 | 0 | 1 | 1 | ○ | ○ | ○ | ○ | ○ | ● | ○ | ○ | ○ | ○ | ○ | ○ | ● | ● | ○ | ○ | ● | ○ | ○ | ○ | ○ | ○ | ○ | ● | ● | 150 | 150 |
| 10010 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ● | ● | | ○ | ○ | ○ | ○ | ○ | ○ | ○ | ○ | ○ | ● | ● | 158 | 158 |
| 10011 | 0 | 0 | 0 | 0 | 1 | 1 | 0 | 0 | 0 | 0 | 0 | 0 | 0 | 1 | ○ | ○ | ○ | ○ | ● | ● | ○ | ○ | ○ | ○ | ○ | ○ | ○ | ● | ○ | ● | ● | ○ | ○ | ○ | ○ | ○ | ○ | ○ | ● | 195 | 195 |
| 10100 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | ○ | ○ | ○ | ○ | ○ | ○ | ○ | ○ | ○ | ○ | ● | 206 | 206 |
| 10101 | 0 | 0 | 0 | 0 | 1 | 1 | 0 | 0 | 0 | 0 | 0 | 0 | 0 | 0 | ○ | ○ | ○ | ○ | ● | ● | ○ | ○ | ○ | ○ | ○ | ○ | ○ | ○ | ○ | ● | ● | ○ | ○ | ○ | ○ | ○ | ○ | ○ | ○ | 245 | 245 |
| 10110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 256 | 256 |

(SELECTIVE ERASE)

BLACK CIRCLE : SELECTIVE ERASE DISCHARGE
WHITE CIRCLE : LIGHT-EMISSION

FIG. 45

VF ≦ 60

| Ds | HD 14 | 13 | 12 | 11 | 10 | 9 | 8 | 7 | 6 | 5 | 4 | 3 | 2 | 1 | LIGHT-EMISSION DRIVE PATTERN IN THE DISPLAY PERIOD OF TWO FIELDS — FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | 2 | 1 | LIGHT-EMISSION BRIGHTNESS FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | | | | | | | | | | | | | | | | | 0 | 0 |
| 00001 | 0 | 0 | 0 | 0 | 0 | 0 | 0 | 0 | 0 | 0 | 0 | 0 | 0 | 1 | | | | | | | | | | | | ● | | | | | | | | | | | | | | | | | | ● | 1 | 1 |
| 00010 | 0 | 0 | 0 | 0 | 0 | 0 | 0 | 0 | 0 | 0 | 0 | 0 | 1 | 0 | | | | | | | | | | | ● | ○ | | | | | | | | | | | | | | | ● | ○ | 2 | 2 |
| 00011 | 0 | 0 | 0 | 0 | 0 | 0 | 0 | 0 | 0 | 0 | 0 | 1 | 0 | 0 | | | | | | | | | | ● | ○ | ○ | | | | | | | | | | | | | ● | ○ | ○ | 3 | 3 |
| 00100 | 0 | 0 | 0 | 0 | 0 | 0 | 0 | 0 | 0 | 0 | 10 | 0 | 0 | 0 | | | | | | | | | ● | ○ | ○ | ○ | | | | | | | | | | | | ● | ○ | ○ | ○ | 6 | 6 |
| 00101 | 0 | 0 | 0 | 0 | 0 | 0 | 0 | 0 | 0 | 1 | 0 | 0 | 0 | 0 | | | | | | | | | ● | ○ | ○ | ○ | ○ | | | | | | | | | | | ● | ○ | ○ | ○ | ○ | 9 | 9 |
| 00110 | 0 | 0 | 0 | 0 | 0 | 0 | 0 | 0 | 1 | 0 | 0 | 0 | 0 | 0 | | | | | | | | ● | ○ | ○ | ○ | ○ | ○ | | | | | | | | | ● | ○ | ○ | ○ | ○ | ○ | ○ | 17 | 17 |
| 00111 | 0 | 0 | 0 | 0 | 0 | 0 | 0 | 1 | 0 | 1 | 0 | 0 | 0 | 0 | | | | | | | ● | | ● | ○ | ○ | ○ | ○ | | | | | | | ● | | ● | ○ | ○ | ○ | ○ | ○ | 22 | 22 |
| 01000 | 0 | 0 | 0 | 0 | 0 | 0 | 0 | 1 | 1 | 0 | 0 | 0 | 0 | 0 | | | | | | | ● | ● | ○ | ○ | ○ | ○ | ○ | | | | | | | ● | ● | ○ | ○ | ○ | ○ | ○ | ○ | 30 | 30 |
| 01001 | 0 | 0 | 0 | 0 | 0 | 0 | 1 | 0 | 0 | 1 | 0 | 0 | 0 | 0 | | | | | | | ● | ○ | | ● | ○ | ○ | ○ | | | | | | ● | ○ | | ● | ○ | ○ | ○ | ○ | ○ | 37 | 37 |
| 01010 | 0 | 0 | 0 | 0 | 0 | 0 | 1 | 0 | 1 | 0 | 0 | 0 | 0 | 0 | | | | | | | ● | ○ | ● | ○ | ○ | ○ | ○ | | | | | | ● | ○ | ● | ○ | ○ | ○ | ○ | ○ | ○ | 45 | 45 |
| 01011 | 0 | 0 | 0 | 0 | 0 | 1 | 0 | 0 | 0 | 1 | 0 | 0 | 0 | 0 | | | | | | ● | ○ | ○ | | ● | ○ | ○ | ○ | | | | | ● | ○ | ○ | | ● | ○ | ○ | ○ | ○ | ○ | 57 | 57 |
| 01100 | 0 | 0 | 0 | 0 | 0 | 1 | 0 | 0 | 1 | 0 | 0 | 0 | 0 | 0 | | | | | | ● | ○ | ○ | ● | ○ | ○ | ○ | ○ | | | | | ● | ○ | ○ | ● | ○ | ○ | ○ | ○ | ○ | ○ | 65 | 65 |
| 01101 | 0 | 0 | 0 | 0 | 1 | 0 | 0 | 0 | 0 | 1 | 0 | 0 | 0 | 0 | | | | | ● | ○ | ○ | ○ | | ● | ○ | ○ | ○ | | | | ● | ○ | ○ | ○ | | ● | ○ | ○ | ○ | ○ | ○ | 82 | 82 |
| 01110 | 0 | 0 | 0 | 0 | 1 | 0 | 0 | 0 | 1 | 0 | 0 | 0 | 0 | 0 | | | | | ● | ○ | ○ | ○ | ● | ○ | ○ | ○ | ○ | | | | ● | ○ | ○ | ○ | ● | ○ | ○ | ○ | ○ | ○ | ○ | 90 | 90 |
| 01111 | 0 | 0 | 0 | 1 | 0 | 0 | 0 | 0 | 0 | 1 | 0 | 0 | 0 | 0 | | | | ● | ○ | ○ | ○ | ○ | | ● | ○ | ○ | ○ | | | ● | ○ | ○ | ○ | ○ | | ● | ○ | ○ | ○ | ○ | ○ | 113 | 113 |
| 10000 | 0 | 0 | 0 | 1 | 0 | 0 | 0 | 0 | 1 | 0 | 0 | 0 | 0 | 0 | | | | ● | ○ | ○ | ○ | ○ | ● | ○ | ○ | ○ | ○ | ○ | | ● | ○ | ○ | ○ | ○ | ● | ○ | ○ | ○ | ○ | ○ | ○ | 121 | 121 |
| 10001 | 0 | 0 | 1 | 0 | 0 | 0 | 0 | 0 | 0 | 1 | 0 | 0 | 0 | 0 | | | ● | ○ | ○ | ○ | ○ | ○ | | ● | ○ | ○ | ○ | ○ | | ● | ○ | ○ | ○ | ○ | | ● | ○ | ○ | ○ | ○ | ○ | 150 | 150 |
| 10010 | 0 | 0 | 1 | 0 | 0 | 0 | 0 | 0 | 1 | 0 | 1 | 0 | 0 | 0 | | | ● | ○ | ○ | ○ | ○ | ○ | ● | ○ | ○ | ○ | ○ | ○ | | ● | ○ | ○ | ○ | ○ | ● | ○ | ○ | ○ | ○ | ○ | ○ | 158 | 158 |
| 10011 | 0 | 1 | 0 | 0 | 0 | 0 | 0 | 0 | 0 | 0 | 0 | 0 | 0 | 0 | | ● | ○ | ○ | ○ | ○ | ○ | ○ | | | ● | ○ | ○ | ○ | ● | ○ | ○ | ○ | ○ | ○ | ○ | | | ● | ○ | ○ | ○ | 195 | 195 |
| 10100 | 0 | 1 | 0 | 0 | 0 | 0 | 0 | 0 | 1 | 0 | 1 | 0 | 0 | 0 | | ● | ○ | ○ | ○ | ○ | ○ | ○ | ● | ○ | ○ | ○ | ○ | ○ | ● | ○ | ○ | ○ | ○ | ○ | ○ | ● | ○ | ○ | ○ | ○ | ○ | 206 | 206 |
| 10101 | 1 | 0 | 0 | 0 | 0 | 0 | 0 | 0 | 0 | 0 | 0 | 0 | 0 | 0 | ● | ○ | ○ | ○ | ○ | ○ | ○ | ○ | | | ● | ○ | ○ | ○ | ● | ○ | ○ | ○ | ○ | ○ | ○ | | | ● | ○ | ○ | ○ | 245 | 245 |
| 10110 | 1 | 0 | 0 | 0 | 0 | 0 | 0 | 0 | 1 | 0 | | | 0 | 0 | ● | ○ | ○ | ○ | ○ | ○ | ○ | ○ | ● | ○ | ○ | ○ | ○ | ○ | ● | ○ | ○ | ○ | ○ | ○ | ○ | ● | ○ | ○ | ○ | ○ | ○ | 256 | 256 |

(SELECTIVE WRITE)

BLACK CIRCLE : SELECTIVE WRITE DISCHARGE AND LIGHT EMISSION
WHITE CIRCLE : LIGHT-EMISSION

FIG. 46

60 < VF ≦ 65

| Ds | HD 14 | | | | | | | | | | | | | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | 2 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | | | | | | | | | | | | | | | 0 | 0 |
| 00001 | 0 | 0 | 0 | 0 | 0 | 0 | 0 | 0 | 0 | 0 | 0 | 0 | 0 | 1 | | | | | | | | | | | | | ● | | | | | | | | | | | | | | | | 1 | 0 |
| 00010 | 0 | 0 | 0 | 0 | 0 | 0 | 0 | 0 | 0 | 0 | 0 | 0 | 1 | 0 | | | | | | | | | | | | ● | ○ | | | | | | | | | | | | | | | ● | 2 | 2 |
| 00011 | 0 | 0 | 0 | 0 | 0 | 0 | 0 | 0 | 0 | 0 | 0 | 1 | 0 | 0 | | | | | | | | | | | ● | ○ | ○ | | | | | | | | | | | | ● | ○ | | 3 | 3 |
| 00100 | 0 | 0 | 0 | 0 | 0 | 0 | 0 | 0 | 0 | 0 | 10 | 0 | 0 | 0 | | | | | | | | | | ● | ○ | ○ | ○ | | | | | | | | | | | ● | ○ | ○ | | 6 | 6 |
| 00101 | 0 | 0 | 0 | 0 | 0 | 0 | 0 | 0 | 0 | 1 | 0 | 0 | 0 | 0 | | | | | | | | | ● | ○ | ○ | ○ | ○ | | | | | | | | | | ● | ○ | ○ | ○ | | 9 | 9 |
| 00110 | 0 | 0 | 0 | 0 | 0 | 0 | 0 | 0 | 1 | 0 | 0 | 0 | 0 | 0 | | | | | | | | ● | ○ | ○ | ○ | ○ | ○ | | | | | | | | | ● | ○ | ○ | ○ | ○ | ○ | | 17 | 17 |
| 00111 | 0 | 0 | 0 | 0 | 0 | 0 | 0 | 1 | 0 | 1 | 0 | 0 | 0 | 0 | | | | | | | ● | | ● | ○ | ○ | ○ | ○ | | | | | | | ● | | ● | ○ | ○ | ○ | ○ | | 22 | 22 |
| 01000 | 0 | 0 | 0 | 0 | 0 | 0 | 0 | 1 | 1 | 0 | 0 | 0 | 0 | 0 | | | | | | | ● | ● | ○ | ○ | ○ | ○ | ○ | | | | | | | ● | ● | ○ | ○ | ○ | ○ | ○ | | 30 | 30 |
| 01001 | 0 | 0 | 0 | 0 | 0 | 0 | 1 | 0 | 0 | 1 | 0 | 0 | 0 | 0 | | | | | | ● | ○ | | ● | ○ | ○ | ○ | ○ | | | | | | ● | ○ | | ● | ○ | ○ | ○ | ○ | | 37 | 37 |
| 01010 | 0 | 0 | 0 | 0 | 0 | 0 | 1 | 0 | 1 | 0 | 0 | 0 | 0 | 0 | | | | | | ● | ○ | ● | ○ | ○ | ○ | ○ | ○ | | | | | | ● | ○ | ● | ○ | ○ | ○ | ○ | ○ | | 45 | 45 |
| 01011 | 0 | 0 | 0 | 0 | 0 | 1 | 0 | 0 | 0 | 1 | 0 | 0 | 0 | 0 | | | | | ● | ○ | ○ | | ● | ○ | ○ | ○ | ○ | | | | | ● | ○ | ○ | | ● | ○ | ○ | ○ | ○ | | 57 | 57 |
| 01100 | 0 | 0 | 0 | 0 | 0 | 1 | 0 | 0 | 1 | 0 | 0 | 0 | 0 | 0 | | | | | ● | ○ | ○ | ● | ○ | ○ | ○ | ○ | ○ | | | | | ● | ○ | ○ | ● | ○ | ○ | ○ | ○ | ○ | | 65 | 65 |
| 01101 | 0 | 0 | 0 | 0 | 1 | 0 | 0 | 0 | 0 | 1 | 0 | 0 | 0 | 0 | | | | ● | ○ | ○ | ○ | | ● | ○ | ○ | ○ | ○ | | | | ● | ○ | ○ | ○ | | ● | ○ | ○ | ○ | ○ | | 82 | 82 |
| 01110 | 0 | 0 | 0 | 0 | 1 | 0 | 0 | 0 | 1 | 0 | 0 | 0 | 0 | 0 | | | | ● | ○ | ○ | ○ | ● | ○ | ○ | ○ | ○ | ○ | | | | ● | ○ | ○ | ○ | ● | ○ | ○ | ○ | ○ | ○ | | 90 | 90 |
| 01111 | 0 | 0 | 0 | 1 | 0 | 0 | 0 | 0 | 0 | 1 | 0 | 0 | 0 | 0 | | | ● | ○ | ○ | ○ | ○ | | ● | ○ | ○ | ○ | ○ | | | ● | ○ | ○ | ○ | ○ | | ● | ○ | ○ | ○ | ○ | | 113 | 113 |
| 10000 | 0 | 0 | 0 | 1 | 0 | 0 | 0 | 0 | 1 | 0 | 0 | 0 | 0 | 0 | | | ● | ○ | ○ | ○ | ○ | ● | ○ | ○ | ○ | ○ | ○ | | | ● | ○ | ○ | ○ | ○ | ● | ○ | ○ | ○ | ○ | ○ | | 121 | 121 |
| 10001 | 0 | 0 | 1 | 0 | 0 | 0 | 0 | 0 | 0 | 1 | 0 | 0 | 0 | 0 | | ● | ○ | ○ | ○ | ○ | ○ | | ● | ○ | ○ | ○ | ○ | | ● | ○ | ○ | ○ | ○ | ○ | | ● | ○ | ○ | ○ | ○ | | 150 | 150 |
| 10010 | 0 | 0 | 1 | 0 | 0 | 0 | 0 | 0 | 1 | 0 | 1 | 0 | 0 | 0 | | ● | ○ | ○ | ○ | ○ | ○ | ● | ○ | ○ | ○ | ○ | ○ | | ● | ○ | ○ | ○ | ○ | ○ | ● | ○ | ○ | ○ | ○ | ○ | | 158 | 158 |
| 10011 | 0 | 1 | 0 | 0 | 0 | 0 | 0 | 0 | 0 | 0 | 0 | 0 | 0 | 0 | ● | ○ | ○ | ○ | ○ | ○ | ○ | | | ● | ○ | ○ | ○ | ● | ○ | ○ | ○ | ○ | ○ | ○ | | | ● | ○ | ○ | | 195 | 195 |
| 10100 | 0 | 1 | 0 | 0 | 0 | 0 | 0 | 0 | 1 | 0 | 1 | 0 | 0 | 0 | ● | ○ | ○ | ○ | ○ | ○ | ○ | ● | ○ | ○ | ○ | ○ | ○ | ● | ○ | ○ | ○ | ○ | ○ | ○ | ● | ○ | ○ | ○ | ○ | ○ | | 206 | 206 |
| 10101 | 1 | 0 | 0 | 0 | 0 | 0 | 0 | 0 | 0 | 0 | 0 | 0 | 0 | 0 | ● | ○ | ○ | ○ | ○ | ○ | ○ | ○ | | ● | ○ | ○ | ○ | ● | ○ | ○ | ○ | ○ | ○ | ○ | ○ | | | ● | ○ | ○ | | 245 | 245 |
| 10110 | 1 | 0 | 0 | 0 | 0 | 0 | 0 | 0 | 1 | 0 | | 0 | 0 | 0 | ● | ○ | ○ | ○ | ○ | ○ | ○ | ○ | ● | ○ | ○ | ○ | ○ | ● | ○ | ○ | ○ | ○ | ○ | ○ | ○ | ● | ○ | ○ | ○ | ○ | | 256 | 256 |

(SELECTIVE WRITE)

BLACK CIRCLE : SELECTIVE WRITE DISCHARGE AND LIGHT EMISSION
WHITE CIRCLE : LIGHT-EMISSION

FIG. 47

65 < VF ≦ 75

| Ds | HD 14 | | | | | | | | | | | | | 1 | LIGHT-EMISSION DRIVE PATTERN IN THE DISPLAY PERIOD OF TWO FIELDS: FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | 3 | LIGHT-EMISSION BRIGHTNESS: FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | | | | | | | | | | | | | 0 | 0 |
| 00001 | 0 | 0 | 0 | 0 | 0 | 0 | 0 | 0 | 0 | 0 | 0 | 0 | 0 | 1 | | | | | | | | | | | | | ● | | | | | | | | | | | | | | 1 | 0 |
| 00010 | 0 | 0 | 0 | 0 | 0 | 0 | 0 | 0 | 0 | 0 | 0 | 0 | 1 | 0 | | | | | | | | | | | | ● | ○ | | | | | | | | | | | | | | 2 | 0 |
| 00011 | 0 | 0 | 0 | 0 | 0 | 0 | 0 | 0 | 0 | 0 | 0 | 1 | 0 | 0 | | | | | | | | | | | ● | ○ | ○ | | | | | | | | | | | | | ● | 3 | 3 |
| 00100 | 0 | 0 | 0 | 0 | 0 | 0 | 0 | 0 | 0 | 0 | 10 | 0 | 0 | 0 | | | | | | | | | | ● | ○ | ○ | ○ | | | | | | | | | | | | ● | ○ | 6 | 6 |
| 00101 | 0 | 0 | 0 | 0 | 0 | 0 | 0 | 0 | 0 | 1 | 0 | 0 | 0 | 0 | | | | | | | | | ● | ○ | ○ | ○ | ○ | | | | | | | | | | | ● | ○ | ○ | 9 | 9 |
| 00110 | 0 | 0 | 0 | 0 | 0 | 0 | 0 | 0 | 1 | 0 | 0 | 0 | 0 | 0 | | | | | | | | ● | ○ | ○ | ○ | ○ | ○ | | | | | | | | | | ● | ○ | ○ | ○ | 17 | 17 |
| 00111 | 0 | 0 | 0 | 0 | 0 | 0 | 0 | 1 | 0 | 1 | 0 | 0 | 0 | 0 | | | | | | | ● | | ● | ○ | ○ | ○ | ○ | | | | | | | | ● | | ● | ○ | ○ | ○ | 22 | 22 |
| 01000 | 0 | 0 | 0 | 0 | 0 | 0 | 0 | 1 | 1 | 0 | 0 | 0 | 0 | 0 | | | | | | | ● | ● | ○ | ○ | ○ | ○ | ○ | | | | | | | | ● | ● | ○ | ○ | ○ | ○ | 30 | 30 |
| 01001 | 0 | 0 | 0 | 0 | 0 | 0 | 1 | 0 | 0 | 1 | 0 | 0 | 0 | 0 | | | | | | ● | ○ | | ● | ○ | ○ | ○ | ○ | | | | | | | ● | ○ | | ● | ○ | ○ | ○ | 37 | 37 |
| 01010 | 0 | 0 | 0 | 0 | 0 | 0 | 1 | 0 | 1 | 0 | 0 | 0 | 0 | 0 | | | | | | ● | ○ | ● | ○ | ○ | ○ | ○ | ○ | | | | | | | ● | ○ | ● | ○ | ○ | ○ | ○ | 45 | 45 |
| 01011 | 0 | 0 | 0 | 0 | 0 | 1 | 0 | 0 | 0 | 1 | 0 | 0 | 0 | 0 | | | | | ● | ○ | ○ | | ● | ○ | ○ | ○ | ○ | | | | | | ● | ○ | ○ | | ● | ○ | ○ | ○ | 57 | 57 |
| 01100 | 0 | 0 | 0 | 0 | 0 | 1 | 0 | 0 | 1 | 0 | 0 | 0 | 0 | 0 | | | | | ● | ○ | ○ | ● | ○ | ○ | ○ | ○ | ○ | | | | | | ● | ○ | ○ | ● | ○ | ○ | ○ | ○ | 65 | 65 |
| 01101 | 0 | 0 | 0 | 0 | 1 | 0 | 0 | 0 | 0 | 1 | 0 | 0 | 0 | 0 | | | | ● | ○ | ○ | ○ | | ● | ○ | ○ | ○ | ○ | | | | | ● | ○ | ○ | ○ | | ● | ○ | ○ | ○ | 82 | 82 |
| 01110 | 0 | 0 | 0 | 0 | 1 | 0 | 0 | 0 | 1 | 0 | 0 | 0 | 0 | 0 | | | | ● | ○ | ○ | ○ | ● | ○ | ○ | ○ | ○ | ○ | | | | | ● | ○ | ○ | ○ | ● | ○ | ○ | ○ | ○ | 90 | 90 |
| 01111 | 0 | 0 | 0 | 1 | 0 | 0 | 0 | 0 | 0 | 1 | 0 | 0 | 0 | 0 | | | ● | ○ | ○ | ○ | ○ | | ● | ○ | ○ | ○ | ○ | | | ● | ○ | ○ | ○ | ○ | | ● | ○ | ○ | ○ | 113 | 113 |
| 10000 | 0 | 0 | 0 | 1 | 0 | 0 | 0 | 0 | 1 | 0 | 0 | 0 | 0 | 0 | | | ● | ○ | ○ | ○ | ○ | ● | ○ | ○ | ○ | ○ | ○ | | | ● | ○ | ○ | ○ | ○ | ● | ○ | ○ | ○ | ○ | 121 | 121 |
| 10001 | 0 | 0 | 1 | 0 | 0 | 0 | 0 | 0 | 0 | 1 | 0 | 0 | 0 | 0 | | ● | ○ | ○ | ○ | ○ | ○ | | ● | ○ | ○ | ○ | ○ | | ● | ○ | ○ | ○ | ○ | ○ | | ● | ○ | ○ | ○ | 150 | 150 |
| 10010 | 0 | 0 | 1 | 0 | 0 | 0 | 0 | 0 | 1 | 0 | 1 | 0 | 0 | 0 | | ● | ○ | ○ | ○ | ○ | ○ | ● | ○ | ○ | ○ | ○ | ○ | | ● | ○ | ○ | ○ | ○ | ○ | ● | ○ | ○ | ○ | ○ | 158 | 158 |
| 10011 | 0 | 1 | 0 | 0 | 0 | 0 | 0 | 0 | 0 | 0 | 0 | 0 | 0 | 0 | ● | ○ | ○ | ○ | ○ | ○ | ○ | | | ● | ○ | ○ | ○ | ● | ○ | ○ | ○ | ○ | ○ | ○ | ○ | | | ● | ○ | 195 | 195 |
| 10100 | 0 | 1 | 0 | 0 | 0 | 0 | 0 | 0 | 1 | 0 | 1 | 0 | 0 | 0 | ● | ○ | ○ | ○ | ○ | ○ | ○ | ● | ○ | ○ | ○ | ○ | ○ | ● | ○ | ○ | ○ | ○ | ○ | ○ | ○ | ● | ○ | ○ | ○ | 206 | 206 |
| 10101 | 1 | 0 | 0 | 0 | 0 | 0 | 0 | 0 | 0 | 0 | 0 | 0 | 0 | 0 | ● | ○ | ○ | ○ | ○ | ○ | ○ | ○ | | | ● | ○ | ○ | ● | ○ | ○ | ○ | ○ | ○ | ○ | ○ | ○ | | | ● | ○ | 245 | 245 |
| 10110 | 1 | 0 | 0 | 0 | 0 | 0 | 0 | 0 | 1 | 0 | | | 0 | 0 | 0 | ● | ○ | ○ | ○ | ○ | ○ | ○ | ○ | ● | ○ | ○ | ○ | ○ | ○ | ○ | ○ | ○ | ○ | ○ | ○ | ● | ○ | ○ | ○ | 256 | 256 |

(SELECTIVE WRITE)

BLACK CIRCLE: SELECTIVE WRITE DISCHARGE AND LIGHT EMISSION
WHITE CIRCLE: LIGHT-EMISSION

FIG. 48

$75 < VF \leqq 85$

| Ds | HD 14 | 13 | 12 | 11 | 10 | 9 | 8 | 7 | 6 | 5 | 4 | 3 | 2 | 1 | LIGHT-EMISSION DRIVE PATTERN IN THE DISPLAY PERIOD OF TWO FIELDS — FIRST DRIVE PERIOD SF 14 | 13 | 12 | 11 | 10 | 9 | 8 | 7 | 6 | 5 | 4 | 3 | 2 | 1 | SECOND DRIVE PERIOD SF 14 | 13 | 12 | 11 | 10 | 9 | 8 | 7 | 6 | 5 | 4 | LIGHT-EMISSION BRIGHTNESS FIRST DRIVE | SECOND DRIVE |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 00000 | 0 | 0 | 0 | 0 | 0 | 0 | 0 | 0 | 0 | 0 | 0 | 0 | 0 | 0 | | | | | | | | | | | | | | | | | | | | | | | | | | 0 | 0 |
| 00001 | 0 | 0 | 0 | 0 | 0 | 0 | 0 | 0 | 0 | 0 | 0 | 0 | 0 | 1 | | | | | | | | | | | | ● | | | | | | | | | | | | | | 1 | 0 |
| 00010 | 0 | 0 | 0 | 0 | 0 | 0 | 0 | 0 | 0 | 0 | 0 | 0 | 1 | 0 | | | | | | | | | | | ● | ○ | | | | | | | | | | | | | | 2 | 0 |
| 00011 | 0 | 0 | 0 | 0 | 0 | 0 | 0 | 0 | 0 | 0 | 0 | 1 | 0 | 0 | | | | | | | | | | ● | ○ | ○ | | | | | | | | | | | | | | 3 | 0 |
| 00100 | 0 | 0 | 0 | 0 | 0 | 0 | 0 | 0 | 0 | 0 | 10 | 0 | 0 | 0 | | | | | | | | | ● | ○ | ○ | ○ | | | | | | | | | | | | ● | | 6 | 6 |
| 00101 | 0 | 0 | 0 | 0 | 0 | 0 | 0 | 0 | 0 | 1 | 0 | 0 | 0 | 0 | | | | | | | | ● | ○ | ○ | ○ | ○ | | | | | | | | | | | ● | ○ | | 9 | 9 |
| 00110 | 0 | 0 | 0 | 0 | 0 | 0 | 0 | 0 | 1 | 0 | 0 | 0 | 0 | 0 | | | | | | | ● | ○ | ○ | ○ | ○ | ○ | | | | | | | | | | ● | ○ | ○ | | 17 | 17 |
| 00111 | 0 | 0 | 0 | 0 | 0 | 0 | 0 | 1 | 0 | 1 | 0 | 0 | 0 | 0 | | | | | | | ● | | ● | ○ | ○ | ○ | ○ | | | | | | | | ● | | ● | ○ | | 22 | 22 |
| 01000 | 0 | 0 | 0 | 0 | 0 | 0 | 0 | 1 | 1 | 0 | 0 | 0 | 0 | 0 | | | | | | | ● | ● | ○ | ○ | ○ | ○ | ○ | | | | | | | | ● | ● | ○ | ○ | | 30 | 30 |
| 01001 | 0 | 0 | 0 | 0 | 0 | 0 | 1 | 0 | 0 | 1 | 0 | 0 | 0 | 0 | | | | | | ● | ○ | | ● | ○ | ○ | ○ | ○ | | | | | | | ● | ○ | | ● | ○ | | 37 | 37 |
| 01010 | 0 | 0 | 0 | 0 | 0 | 0 | 1 | 0 | 1 | 0 | 0 | 0 | 0 | 0 | | | | | | ● | ○ | ● | ○ | ○ | ○ | ○ | ○ | | | | | | | ● | ○ | ● | ○ | ○ | | 45 | 45 |
| 01011 | 0 | 0 | 0 | 0 | 0 | 1 | 0 | 0 | 0 | 1 | 0 | 0 | 0 | 0 | | | | | ● | ○ | ○ | | ● | ○ | ○ | ○ | ○ | | | | | | ● | ○ | ○ | | ● | ○ | | 57 | 57 |
| 01100 | 0 | 0 | 0 | 0 | 0 | 1 | 0 | 0 | 1 | 0 | 0 | 0 | 0 | 0 | | | | | ● | ○ | ○ | ● | ○ | ○ | ○ | ○ | ○ | | | | | | ● | ○ | ○ | ● | ○ | ○ | | 65 | 65 |
| 01101 | 0 | 0 | 0 | 0 | 1 | 0 | 0 | 0 | 0 | 1 | 0 | 0 | 0 | 0 | | | | ● | ○ | ○ | ○ | | ● | ○ | ○ | ○ | ○ | | | | | ● | ○ | ○ | ○ | | ● | ○ | | 82 | 82 |
| 01110 | 0 | 0 | 0 | 0 | 1 | 0 | 0 | 0 | 1 | 0 | 0 | 0 | 0 | 0 | | | | ● | ○ | ○ | ○ | ● | ○ | ○ | ○ | ○ | ○ | | | | | ● | ○ | ○ | ○ | ● | ○ | ○ | | 90 | 90 |
| 01111 | 0 | 0 | 0 | 1 | 0 | 0 | 0 | 0 | 0 | 1 | 0 | 0 | 0 | 0 | | | ● | ○ | ○ | ○ | ○ | | ● | ○ | ○ | ○ | ○ | | | | ● | ○ | ○ | ○ | ○ | | ● | ○ | | 113 | 113 |
| 10000 | 0 | 0 | 0 | 1 | 0 | 0 | 0 | 0 | 1 | 0 | 0 | 0 | 0 | 0 | | | ● | ○ | ○ | ○ | ○ | ● | ○ | ○ | ○ | ○ | ○ | | | | ● | ○ | ○ | ○ | ○ | ● | ○ | ○ | | 121 | 121 |
| 10001 | 0 | 0 | 1 | 0 | 0 | 0 | 0 | 0 | 0 | 1 | 0 | 0 | 0 | 0 | | ● | ○ | ○ | ○ | ○ | ○ | | ● | ○ | ○ | ○ | ○ | | | ● | ○ | ○ | ○ | ○ | ○ | | ● | ○ | | 150 | 150 |
| 10010 | 0 | 0 | 1 | 0 | 0 | 0 | 0 | 0 | 1 | 0 | 1 | 0 | 0 | 0 | | ● | ○ | ○ | ○ | ○ | ○ | ● | ○ | ○ | ○ | ○ | ○ | | | ● | ○ | ○ | ○ | ○ | ○ | ● | ○ | ○ | | 158 | 158 |
| 10011 | 0 | 1 | 0 | 0 | 0 | 0 | 0 | 0 | 0 | 0 | 0 | 0 | 0 | 0 | ● | ○ | ○ | ○ | ○ | ○ | ○ | | | ● | ○ | ○ | ○ | ● | ○ | ○ | ○ | ○ | ○ | ○ | ○ | | | | ● | 195 | 195 |
| 10100 | 0 | 1 | 0 | 0 | 0 | 0 | 0 | 0 | 1 | 0 | 1 | 0 | 0 | 0 | ● | ○ | ○ | ○ | ○ | ○ | ○ | ● | ○ | ○ | ○ | ○ | ○ | ● | ○ | ○ | ○ | ○ | ○ | ○ | ○ | ● | ○ | ○ | | 206 | 206 |
| 10101 | 1 | 0 | 0 | 0 | 0 | 0 | 0 | 0 | 0 | 0 | 0 | 0 | 0 | 0 | ● | ○ | ○ | ○ | ○ | ○ | ○ | ○ | | | ● | ○ | ○ | ○ | ● | ○ | ○ | ○ | ○ | ○ | ○ | ○ | | | | ● | 245 | 245 |
| 10110 | 1 | 0 | 0 | 0 | 0 | 0 | 0 | 0 | 1 | 0 | | 0 | 0 | 0 | ● | ○ | ○ | ○ | ○ | ○ | ○ | ○ | ● | ○ | ○ | ○ | ○ | ○ | ● | ○ | ○ | ○ | ○ | ○ | ○ | ○ | ● | ○ | ○ | 256 | 256 |

(SELECTIVE WRITE)

BLACK CIRCLE: SELECTIVE WRITE DISCHARGE AND LIGHT EMISSION
WHITE CIRCLE: LIGHT-EMISSION

METHOD FOR DRIVING A PLASMA DISPLAY PANEL

BACKGROUND OF THE INVENTION

1. Field of the Invention

The present invention relates to a method for driving a display panel which employs a matrix display scheme.

2. Description of Related Art

As a display panel employing the matrix display scheme, for example, a plasma display panel (hereinafter called "PDP") and an electroluminescent display (hereinafter called "ELD") are known.

In display panels such as these PDP or ELD comprising light-emitting elements having only two states, "light-emitting" and "non-light-emitting", a gray-scale drive is carried out using a sub-field method in order to obtain halftone brightness.

FIG. 1 shows a drive format for carrying out halftone drive of 256 levels using such a sub-field method.

As shown in FIG. 1, for realizing halftone drive of 256 levels, the display period of one field comprises eight sub-fields, sub-fields SF1 through SF8. The following light-emission periods (the frequency of light emission) having lengths of period corresponding to each weighted bit digit of 8-bit pixel data are assigned to the sub-fields, respectively, for light-emitting drive. That is, SF1: 128 (first bit)

SF2: 64 (second bit)

SF3: 32 (third bit)

SF4: 16 (fourth bit)

SF5: 8 (fifth bit)

SF6: 4 (sixth bit)

SF1: 7 (seventh bit)

SF2: 8 (eighth bit)

That is, these are set to each sub-field according to pixel data whether light-emission is carried out at the sub-field and thus a brightness expression of a 256-level gray scale can be realized by the combination thereof.

For example, when 8-bit pixel data ("00101000") corresponding to a brightness level of "40" is supplied, light-emission is carried out only by sub-fields corresponding to the bit digit of logic level "1", that is, only by SF3 and SF5. According to this light-emission drive, since "32+8=40" frequencies of light emissions are carried out within the display period of one field, the display corresponding to a brightness level of "40" is visualized.

In order to produce a brightness expression of a gray scale using a display panel comprising light-emitting elements having only two states, "light-emitting" and "non-light-emitting", the so-called sub-field method is used for a halftone drive which, divides the display period of one field into a plurality of sub-fields wherein a frequency of light emission (the number of light emissions) different from one another is defined.

In recent display devices used in computers or the like, the refresh rate can be changed in order to reduce flicker at the time of displaying images. That is, the refresh rate is increased to shorten the display period of one field, thereby preventing "flicker" on the screen.

However, in order to shorten the display period of one field in a display panel which employs the aforementioned sub-field method for carrying out gray-scale drive, the number of of light emissions (light-emission period) to be carried out in each sub-field must be reduced. Thus, this presented a problem that desired display brightness was unable to be obtained.

OBJECCT AND SUMMARY OF THE INVENTION

The present invention has been developed in order to solve the aforementioned problem. An object of the invention is to provide a drive method of display panels which is capable of changing the refresh rate of a display panel employing the matrix display scheme for gray-scale drive using the sub-field method without degrading display quality.

A method for driving a display panel, according to the present invention, allows for carrying out gray-scale drive of a display panel employing the matrix display scheme, the display panel having a plurality of pixel celss each formed at an intersection of a plurality of electrode rows arranged for each scanning line and a plurality of electrode columns arranged to intersect the electrode rows, the unit display period of an input video signal consisting of a plurality of divided display periods, the method comprising a steps of: carrying out a divided light-emission drive process for allowing selected ones of the pixel cells to emit light for a number of light emissions assigned to each of the divided display periods, in each of the divided display periods, wherein a number of execusions of the divided light-emission drive process within the unit display period is changed in response to a vertical synchronization frequency of the input video signal.

BRIEF DESCRIPTION OF THE DRAWINGS

FIG. 5 is a view showing an example of conversion tables of the first data conversion circuit 32.

FIG. 6 is a view showing an example of conversion tables of the first data conversion circuit 32.

FIG. 12 shows conversion table A.

FIG. 13 shows conversion table B.

FIG. 14 shows conversion table C.

FIG. 15 shows conversion table D.

FIG. 18 is a view showing a light-emission drive pattern in the display period of two fields with the vertical synchronization frequency of a video signal being equal to 60 Hz or less.

FIG. 19 is a view showing a light-emission drive pattern in the display period of two fields with the vertical synchronization frequency of a video signal being equal to 60 Hz to 65 Hz.

FIG. 20 is a view showing a light-emission drive pattern in the display period of two fields with the vertical synchronization frequency of a video signal being equal to 65 Hz to 75 Hz.

FIG. 21 is a view showing a light-emission drive pattern in the display period of two fields with the vertical synchronization frequency of a video signal being equal to 75 Hz to 85 Hz.

FIG. 24 is a view showing the conversion table of the second data conversion circuit 34 and all light-emission drive patterns used during the display period of two fields, which are carried out at the time of the vertical synchronization frequency of a video signal being equal to 60 Hz or less, when the selective write address method is employed.

FIG. 25 is a view showing the conversion table of the second data conversion circuit 34 and all light-emission drive patterns used during the display period of two fields, which are carried out at the time of the vertical synchronization frequency of a video signal being equal to 60 Hz to 65 Hz, when the selective write address method is employed.

FIG. 26 is a view showing the conversion table of the second data conversion circuit 34 and all light-emission drive patterns used during the display period of two fields, which are carried out at the time of the vertical synchronization frequency of a video signal being equal to 65 Hz to 75 Hz, when the selective write address method is employed.

FIG. 28 is a view showing another example of the conversion table of the second data conversion circuit 34 and all light-emission drive patterns used during the display period of two fields, which are carried out at the time of the vertical synchronization frequency of a video signal being equal to 60 Hz or less, when the selective erase address method is employed.

FIG. 29 is a view showing another example of the conversion table of the second data conversion circuit 34 and all light-emission drive patterns used during the display period of two fields, which are carried out at the time of the vertical synchronization frequency of a video signal being equal to 60 Hz to 65 Hz, when the selective erase address method is employed.

FIG. 30 is a view showing another example of the conversion table of the second data conversion circuit 34 and all light-emission drive patterns used during the display period of two fields, which are carried out at the time of the vertical synchronization frequency of a video signal being equal to 65 Hz to 75 Hz, when the selective erase address method is employed.

FIG. 31 is a view showing another example of the conversion table of the second data conversion circuit 34 and all light-emission drive patterns used during the display period of two fields, which are carried out at the time of the vertical synchronization frequency of a video signal being equal to 75 Hz to 85 Hz, when the selective erase address method is employed.

FIG. 33 is a view showing another example of the conversion table of the second data conversion circuit 34 and all light-emission drive patterns used during the display period of two fields, which are carried out at the time of the vertical synchronization frequency of a video signal being equal to 60 Hz to 65 Hz, when the selective write address method is employed.

FIG. 34 is a view showing another example of the conversion table of the second data conversion circuit 34 and all light-emission drive patterns used during the display period of two fields, which are carried out at the time of the vertical synchronization frequency of a video signal being equal to 65 Hz to 75 Hz, when the selective write address method is employed.

FIG. 35 is a view showing another example of the conversion table of the second data conversion circuit 34 and all light-emission drive patterns used during the display period of two fields, which are carried out at the time of the vertical synchronization frequency of a video signal being equal to 75 Hz to 85 Hz, when the selective write address method is employed.

FIG. 39 is view showing a conversion table in accordance with the conversion characteristics shown in FIG. 38.

FIG. 40 is view showing a conversion table in accordance with the conversion characteristics shown in FIG. 38.

FIG. 41 is a view showing a conversion table of the second data conversion circuit 34 used in a case where the light-emission drive formats shown in FIG. 36A through FIG. 36D and all light-emission drive patterns used during the display period of two fields, which are carried out at the time of the vertical synchronization frequency of a video signal being equal to 60 Hz or less.

FIG. 42 is a view showing a conversion table of the second data conversion circuit 34 used in a case where the light-emission drive formats shown in FIG. 36A through FIG. 36D and all light-emission drive patterns used during the display period of two fields, which are carried out at the time of the vertical synchronization frequency of a video signal being equal to 60 Hz to 65 Hz.

FIG. 43 is a view showing a conversion table of the second data conversion circuit 34 used in a case where the light-emission drive formats shown in FIG. 36A through FIG. 36D and all light-emission drive patterns used during the display period of two fields, which are carried out at the time of the vertical synchronization frequency of a video signal being equal to 65 Hz to 75 Hz.

FIG. 44 is a view showing a conversion table of the second data conversion circuit 34 used in a case where the light-emission drive formats shown in FIG. 36A through FIG. 36D and all light-emission drive patterns used during the display period of two fields, which are carried out at the time of the vertical synchronization frequency of a video signal being equal to 75 Hz to 85 Hz.

FIG. 45 is a view showing a conversion table of the second data conversion circuit 34 used in a case where the light-emission drive formats shown in FIG. 37A through FIG. 37D and all light-emission drive patterns used during the display period of two fields, which are carried out at the time of the vertical synchronization frequency of a video signal being equal to 60 Hz or less.

FIG. 46 is a view showing a conversion table of the second data conversion circuit 34 used in a case where the light-emission drive formats shown in FIG. 37A through FIG. 37D and all light-emission drive patterns used during the display period of two fields, which are carried out at the time of the vertical synchronization frequency of a video signal being equal to 60 Hz to 65 Hz.

FIG. 47 is a view showing a conversion table of the second data conversion circuit 34 used in a case where the light-emission drive formats shown in FIG. 37A through FIG. 37D and all light-emission drive patterns used during the display period of two fields, which are carried out at the time of the vertical synchronization frequency of a video signal being equal to 65 Hz to 75 Hz.

FIG. 48 is a view showing a conversion table of the second data conversion circuit 34 used in a case where the light-emission drive formats shown in FIG. 37A through FIG. 37D and all light-emission drive patterns used during the display period of two fields, which are carried out at the time of the vertical synchronization frequency of a video signal being equal to 75 Hz to 85 Hz.

DETAILED DESCRIPTION OF THE PREFERRED EMBODIMENTS

The embodiments of the present invention will be explained below with reference to the drawings.

Figure 1:
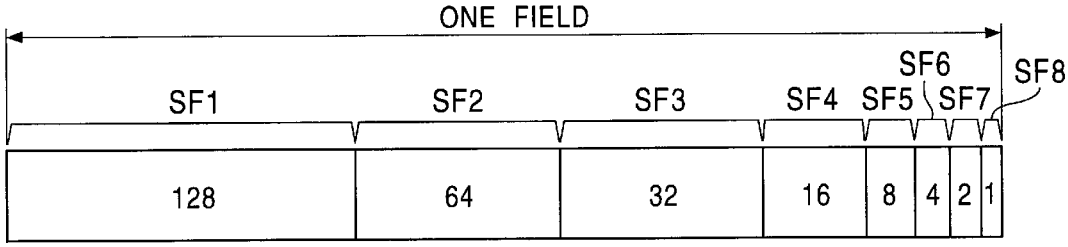
FIG. 1 is a view showing a conventional light-emission drive format for producing a display with 256 levels of halftone.
Figure 2:
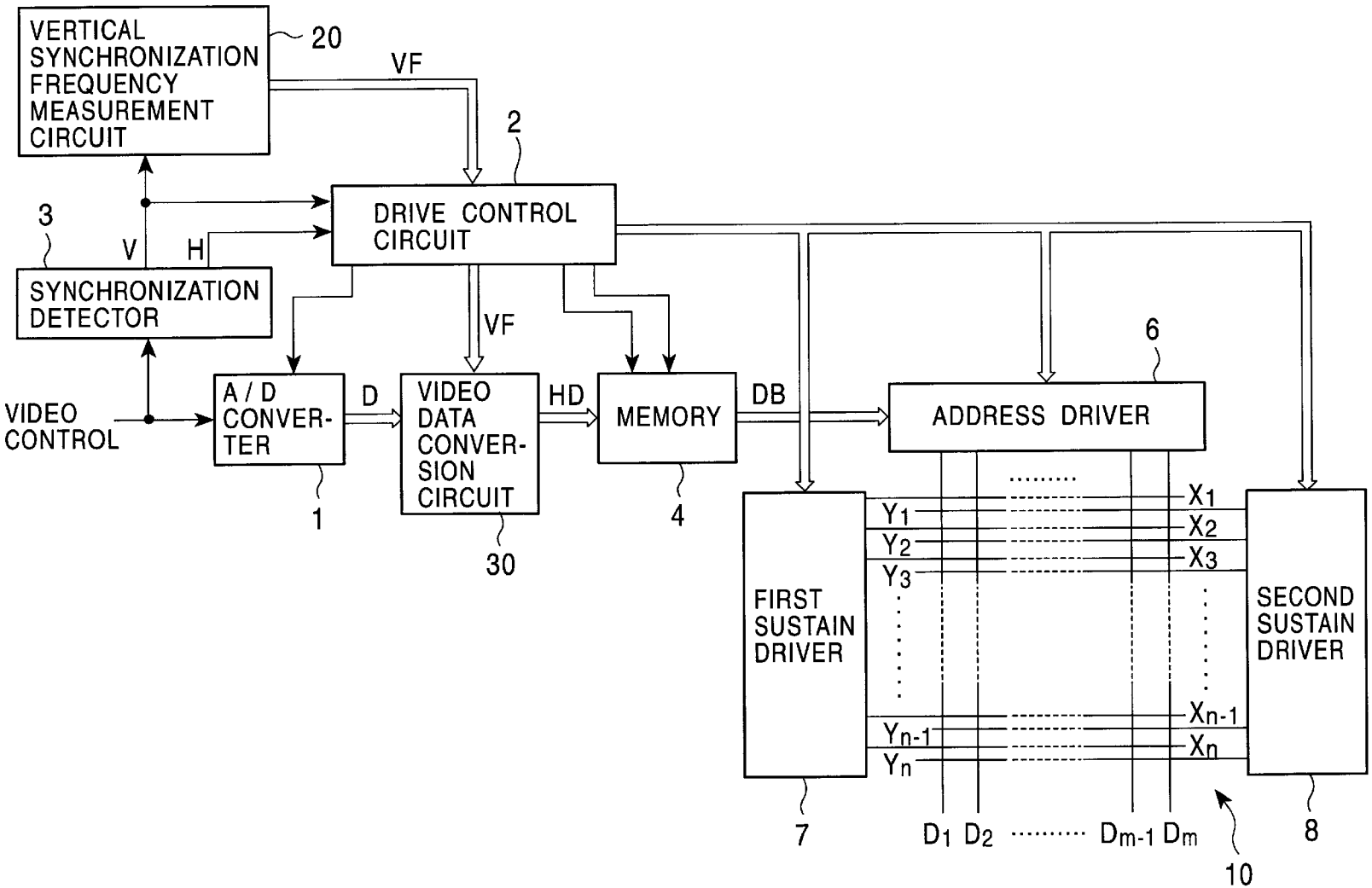
FIG. 2 is a schematic view showing the configuration of a plasma display device for driving a plasma display panel in accordance with the drive method of the present invention.

FIG. 2 is a schematic view showing the configuration of a plasma display device provided with a drive unit for driving a plasma display panel, which is a display panel employing the matrix display scheme, in accordance with the drive method according to the present invention.

As shown in FIG. 2, such a plasma display panel comprises a PDP 10, an A/D converter 1, a drive control circuit 2, a synchronization detector circuit 3, a drive data conversion circuit 30, a memory 4, an address driver 6, and a drive portion comprising a first and second sustain drivers 7 and 8.

The PDP 10 comprises m electrode columns $D_1$ through $D_m$ serving as address electrodes, and n electrode rows $X_1$ through $X_n$ and n electrode rows $Y_1$ through $Y_n$, which are arranged to intersect these electrode columns, respectively. In the PDP 10, a pair of electrode rows X and electrode Y rows forms a electrode row corresponding to one line. The electrode column D and electrode rows X and Y are coated with a dielectric layer exposed to a discharge space, and a discharge cell corresponding to one pixel is configured so as to be formed at an intersection of each pair of electrode rows and a electrode column.

The synchronization detector circuit 3 supplies vertical synchronization detection signal V to the drive control circuit 2 and a vertical synchronization frequency measurement circuit 20, respectively, when detecting a vertical synchronization signal in an input video signal, whereas the synchronization detector circuit 3 supplies a horizontal synchronization signal H to the drive control circuit 2 when detecting a horizontal synchronization signal.

The vertical synchronization frequency measurement circuit 20 measures the frequency of the aforementioned vertical synchronization detection signal V to supply a vertical frequency signal VF representing the frequency to the drive control circuit 2 and the drive data conversion circuit 30, respectively.

The A/D converter 1 samples input analog video signals, in response to the clock signal supplied from the drive control circuit 2, and then converts the signals into 8-bit pixel data D corresponding to each pixel, which is then supplied to the drive data conversion circuit 30.

Figure 3:
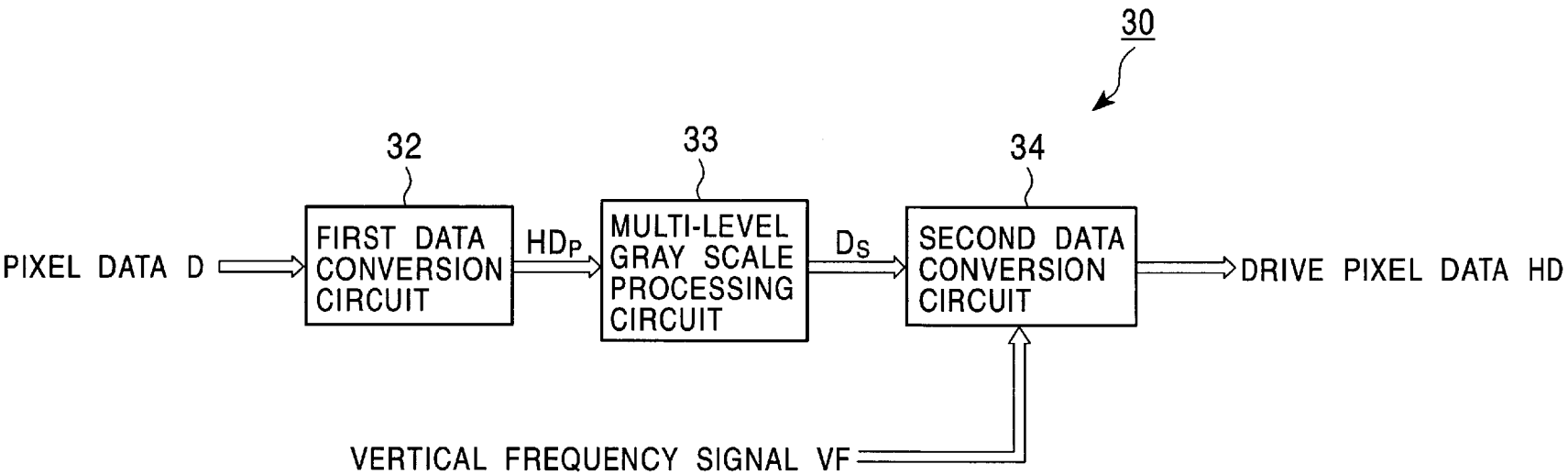
FIG. 3 is a view showing the internal configuration of drive data conversion circuitry 30.

FIG. 3 shows the internal configuration of such drive data conversion circuit 30.

Figure 4:
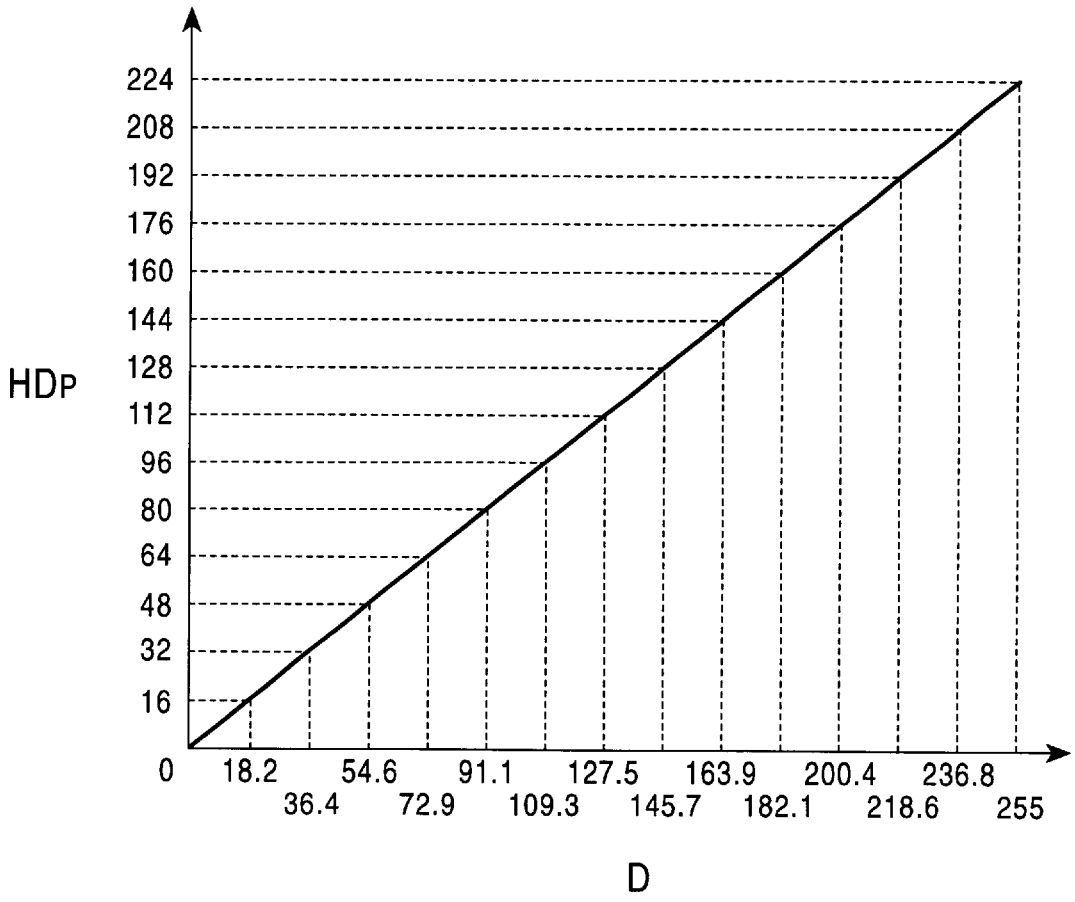
FIG. 4 is a view showing the conversion characteristics of a first data conversion circuit 32.

In FIG. 3, a first data conversion circuit 32 converts the pixel data D of each pixel supplied in sequence from the A/D converter 1 into 8-bit (0 through 224) conversion pixel data $HD_p$ derived from 14×16/255 (224/225) in accordance with the conversion characteristics shown in FIG. 4, and then supplies the data to a multi-level gray scale processing circuit 33. Specifically, the 8-bit (0 to 255) pixel data D is converted in accordance with the conversion tables shown in FIG. 5 and FIG. 6 derived from this conversion characteristic. That is, this conversion characteristic is set in response to the number of bits of pixel data D, the number of compression bits provided by a multi-level gray scale processing to be described later, and the number of display gray-scale. As such, the first data conversion circuit 32 is provided at the preceding stage of the multi-level gray scale processing to effectuate a conversion to the number of display gray-scale and the number of compression bits provided by multi-level gray scale processing.

The pixel data D is thereby divided at the bit boundary into an upper bit group (corresponding to pixel data of multi-level gray scale) and a lower bit group (data to be discarded, error data). In accordance with this signal, the multi-level gray scale processing is carried out. The aforementioned data conversion by means of the first data conversion circuit 32 prevents the occurrence of brightness saturation caused by the multi-level gray scale processing at the following stage and the occurrence of flat portions in display characteristics (that is, the occurrence of gray scale distortion) produced in the cases where a display level of gray scale is not present at the bit boundary.

Figure 7:
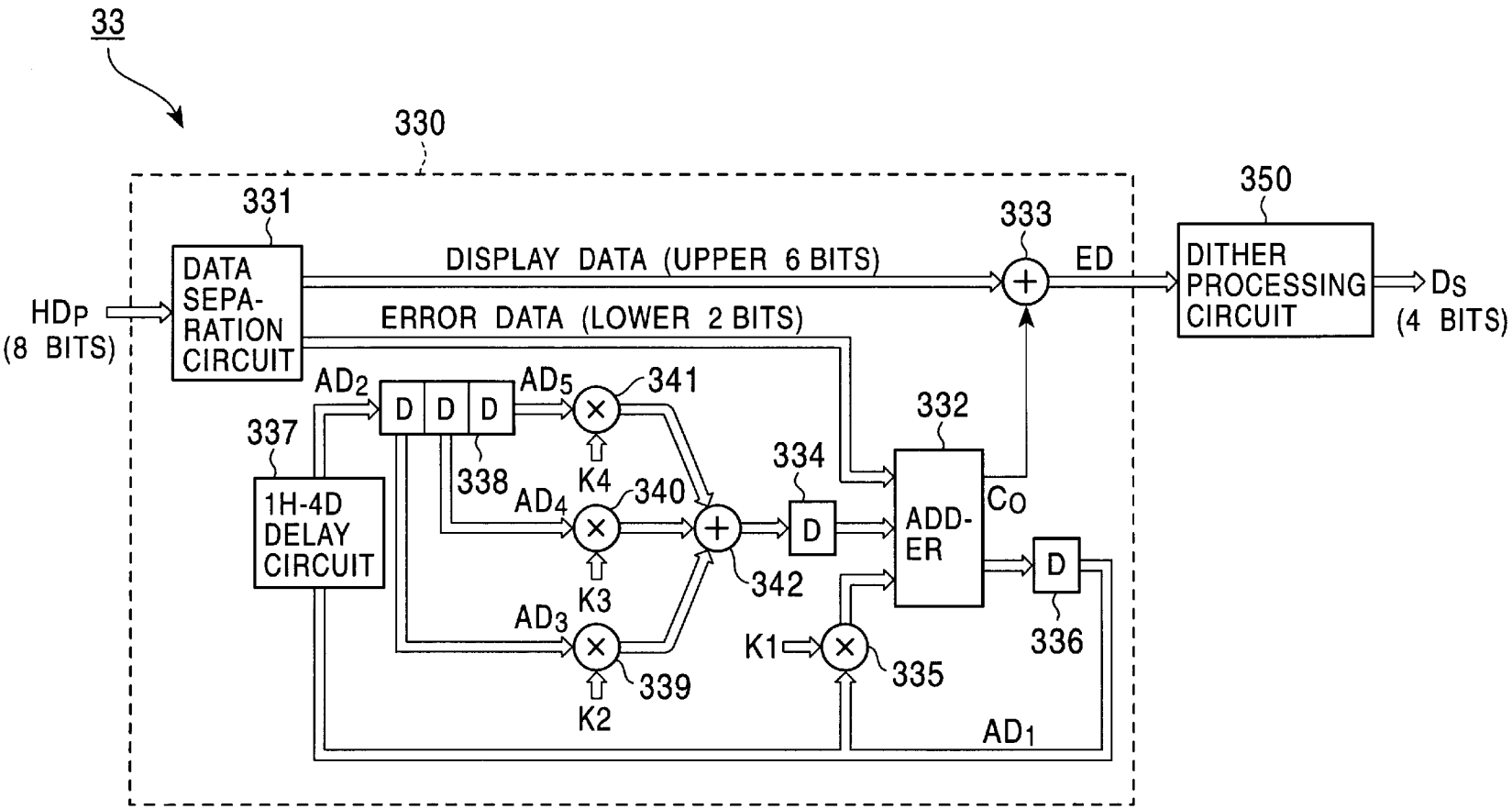
FIG. 7 is a view showing the internal configuration of a multi-level gray scale processing circuit 33.

FIG. 7 shows the internal configuration of the multi-level gray scale processing circuit 33.

As shown in FIG. 7, the multi-level gray scale processing circuit 33 comprises an error diffusion processing circuit 330 and a dither processing circuit 350.

A data separation circuit 331 of the error diffusion processing circuit 330 separates the lower two bits in the 8-bit conversion pixel data $HD_p$ supplied from the first data conversion circuit 32 as error data and the upper 6 bits as display data. An adder 332 supplies, to a delay circuit 336, an additional value obtained by adding the lower two bits of the conversion pixel data $HD_p$ taken as error data, delay output from a delay circuit 334, and multiplication output of a coefficient multiplier 335. The delay circuit 336 supplies a signal, as delay additional signal $AD_1$, obtained by delaying the additional value supplied from the adder 332 by delay time D having the same time as the period of the clock period of the pixel data to the aforementioned coefficient multiplier 335 and a delay circuit 337, respectively. The coefficient multiplier 335 supplies, to the aforementioned adder 332, a multiplication result obtained by multiplying a predetermined coefficient value $K_1$ (for example, "7/16") to the aforementioned delay additional signal $AD_1$. The delay circuit 337 supplies, to a delay circuit 338 as a delay additional signal $AD_2$, a signal obtained by further delaying the aforementioned delay additional signal $AD_1$ by time (one horizontal scan period—the aforementioned delay time D×4). The delay circuit 338 supplies, to a coefficient multiplier 339 as a delay additional signal $AD_3$, a signal obtained by further delaying the aforementioned delay additional signal $AD_2$ by the aforementioned delay time D. Moreover, the delay circuit 338 supplies, to a coefficient multiplier 340 as a delay additional signal $AD_4$, a signal obtained by further delaying the delay additional signal $AD_2$ by the aforementioned delay time D×2. Still moreover, the delay circuit 338 supplies, to a coefficient multiplier 341 as a delay additional signal $AD_5$, a signal obtained by further delaying the delay additional signal $AD_2$ by the aforementioned delay time D×3. The coefficient multiplier 339 supplies, to the aforementioned adder 342, a multiplication result obtained by multiplying a predetermined coefficient value $K_2$ (for example, "3/16") to the aforementioned delay additional signal $AD_3$. The coefficient multiplier 340 supplies, to the aforementioned adder 342, a multiplication result obtained by multiplying a predetermined coefficient value $K_3$ (for example, "5/16") to the aforementioned delay additional signal $AD_4$. The coefficient multiplier 341 supplies, to the aforementioned adder 342, a multiplication result obtained by multiplying a predetermined coefficient value $K_4$ (for example, "1/16") to the aforementioned delay additional signal $AD_5$. The adder 342 supplies, to the aforementioned delay circuit 334, an additional value obtained by adding the multiplication results supplied by the respective aforementioned coefficient multipliers 339, 340, and 341. The delay circuit 334 supplies, to the aforementioned adder 332, the additional signal delayed by the aforementioned delay time D. In cases where no carry is produced in a case where the lower two bits of the aforementioned conversion pixel data $HD_p$, the delay output from the delay circuit 334, and the multiplication output of the coefficient multiplier 335 are added, the adder 332 generates a carryout signal $C_0$ of logic level "0" to supply the signal to an adder 333. In cases where a carry is produced, the adder 332 generates a carryout signal $C_0$ of logic level "1" to supply the signal to an adder 333. The adder 333 outputs, as the aforementioned 6-bit error diffusion processing pixel data ED, a signal obtained by adding the aforementioned carryout signal $C_0$ to the display data comprising the upper 6 bits of the aforementioned conversion pixel data $HD_p$. That is, the number of bits of the error diffusion processing pixel data ED is less than that of the aforementioned conversion pixel data $HD_p$.

Figure 8:
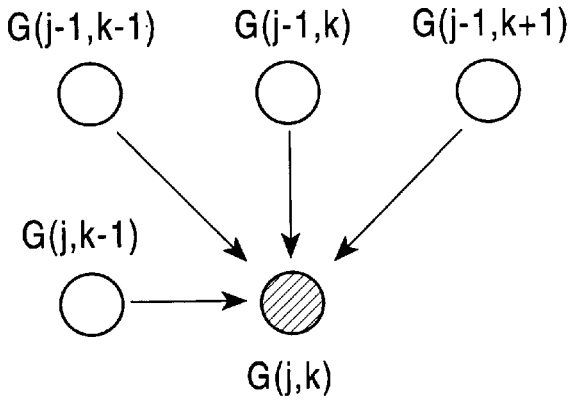
FIG. 8 is an explanatory view showing the operation of an error diffusion processing circuit 330.

The operation of the aforementioned error diffusion processing circuit 330 is to be explained below. For example, in order to determine the error diffusion processing pixel data ED corresponding to a pixel G (j, k) of the PDP 10 shown in FIG. 8, the respective error data corresponding to a pixel G (j, k−1) on the left of such pixel G (j, k), to a pixel G (j−1, k−1) on the upper left of the pixel G (j, k), to a pixel G (j−1, k) immediately above the pixel G (j, k), and to a pixel G (j-1, k+1) on the upper right of the pixel G (j, k), that is, error data corresponding to the pixel G (j, k−1), the delay additional signal $AD_1$, error data corresponding to the pixel G (j−1, k+1), the delay additional signal $AD_3$, error data corresponding to the pixel G (j−1, k), the delay additional signal $AD_4$, and error data corresponding to the pixel G (j−1, k−1), the delay additional signal $AD_5$ are respectively weighted by the predetermined coefficients $K_1$ through $K_4$, which are described above, and then added. Subsequently, the result of the addition is added by error data corresponding to the lower two bits of the conversion pixel data $HD_p$, that is, the error data corresponding to the pixel G (j, k). Then, the carryout signal $C_0$ of one bit thus obtained is added to the display data corresponding to the upper six bits of the conversion pixel data $HD_p$, that is, to the pixel G (j, k), and the resultant value is allowed to serve as the error diffusion processing pixel data ED.

The error diffusion processing circuit 330 with such a configuration interprets the upper 6 bits of the conversion pixel data $HD_p$ as display data and the remaining lower 2 bits as error data. The circuit also adds the error data of the surrounding pixels {G (j, k−1), G (j−1, k+1), G (j−1, k), G (j−1, k−1)} by assigning weights thereto and allows the resultant to be reflected upon the aforementioned display data. This operation allows the brightness of the lower 2 bits at the original pixel {G (j, k)} to be expressed by the aforementioned surrounding pixels in a quasi manner. Therefore, this allows the display data of the number of bits less than 8 bits, that is, equal to 6 bits to express the levels of gray scale of brightness equivalent to those expressed by the aforementioned 8-bit pixel data.

Moreover, an even addition of these coefficient values of error diffusion to respective pixels may cause the noise resulting from error diffusion patterns to be visually recognized and thus produce an adverse effect on display quality. Accordingly, like the case of the dither coefficients, which is to be described later, the coefficients $K_1$ through $K_4$ of error diffusion that should be assigned to the respective four pixels may be changed for each field.

The dither processing circuit 350 applies the dither processing to the 6-bit error diffusion processing pixel data ED supplied from the error diffusion processing circuit 330, thereby generating the multi-level gray scale processing pixel data $D_s$ whose number of bits is reduced to 4 bits, while maintaining the level of gray scale of the same brightness as that of the error diffusion processing pixel data ED. Incidentally, the dither processing allows a plurality of adjacent pixels to express one intermediate display level. Take as an example the case of the gray-scale display corresponding to 8 bits by using the display data of the upper 6 bits out of 8-bit pixel data. Four pixels adjacent to one another on the right and left, and above and below are taken as one set. Then, four dither coefficients a through d having values different from one another are assigned to respective pixel data corresponding to each of the set of pixels and then added. The dither processing is to produce four different combinations of intermediate display levels with four pixels. Therefore, even with the number of bits of the pixel data equal to 6 bits, the brightness levels of gray scale available for display are 4 times, that is, halftone display corresponding to 8 bits becomes available.

However, an even addition of the dither patterns with the coefficients a through d to respective pixels may cause the noise resulting from the dither patterns to be visually recognized and thus produce an adverse effect on display quality.

Accordingly, the dither processing circuit 350 allows the aforementioned dither coefficients a through d that should be assigned to the respective four pixels to be changed for each field.

Figure 9:
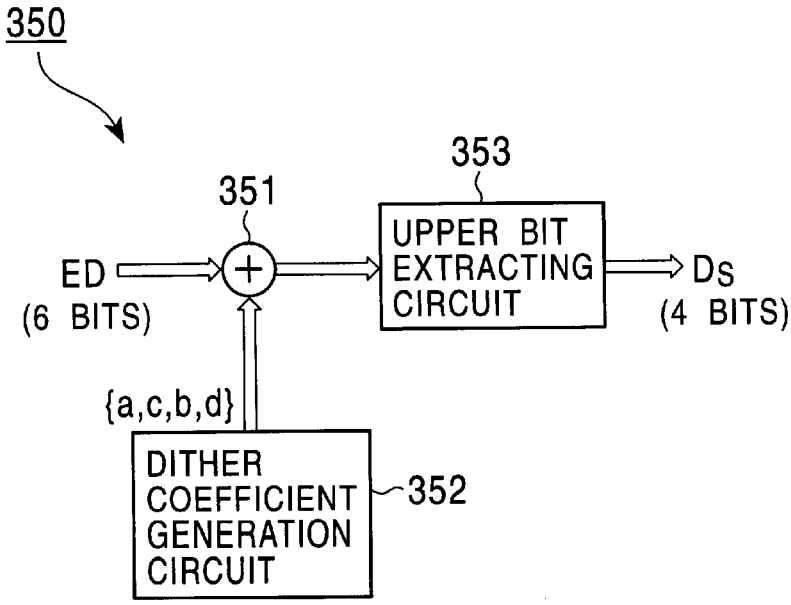
FIG. 9 is a view showing the internal configuration of a dither processing circuit 350.

FIG. 9 is a view showing the internal configuration of such a dither processing circuit 350.

Figure 10:
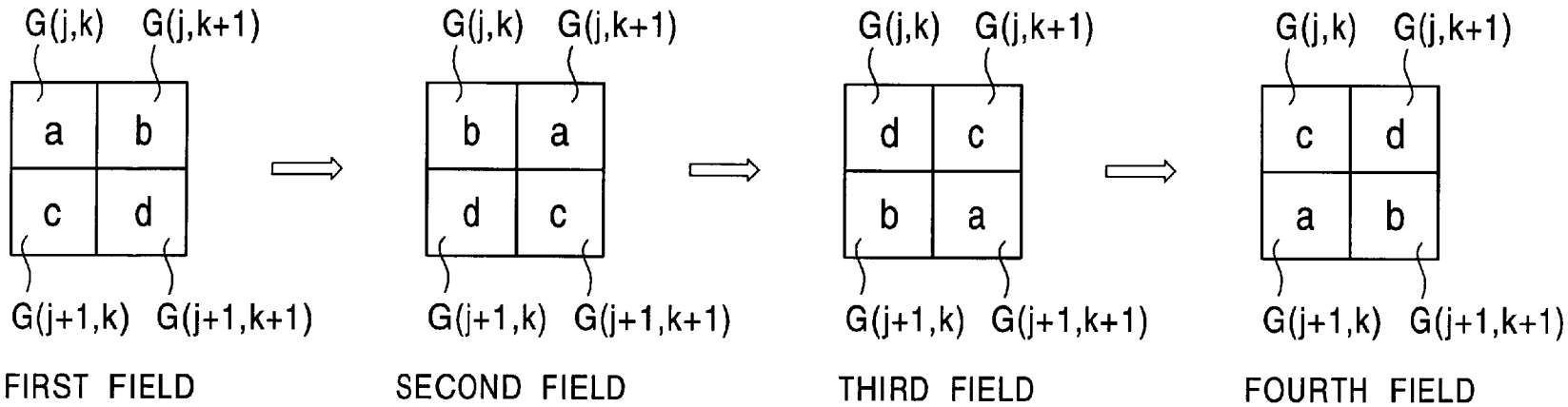
FIG. 10 is a view explaining the operation of the dither processing circuit 350.

In FIG. 9, a dither coefficient generation circuit 352 generates four dither coefficients a, b, c, and d for each of four pixels adjacent to one another and supplies these coefficients in sequence to the adder 351. For example, as shown in FIG. 10, the circuit generates four dither coefficients a, b, c, d, for the respective four pixels, namely, for pixel G (j, k) and pixel G (j, k+1) corresponding to the jth row, and for pixel G (j+1, k) and pixel G (j+1, k+1) corresponding to the (j+1)th row. At this time, the dither coefficient generation circuit 352 changes, at each field as shown in FIG. 10, the aforementioned dither coefficients a, b, c, and d that should be assigned to each of these four pixels.

That is, dither coefficients a through d are assigned to the pixels and generated repeatedly in a cyclic manner as follows and supplied to an adder 351.

At the starting first field, pixel G (j, k), dither coefficient a, pixel G (j, k+1), dither coefficient b, pixel G (j+1, k), dither coefficient c, and pixel G (j+1, k+1), dither coefficient d;

at the subsequent second field, pixel G (j, k), dither coefficient b, pixel G (j, k+1), dither coefficient a, pixel G (j+1, k), dither coefficient d, and pixel G (j+1, k+1), dither coefficient c;

at the subsequent third field, pixel G (j, k), dither coefficient d, pixel G (j, k+1), dither coefficient c, pixel G (j+1, k), dither coefficient b, and pixel G (j+1, k+1), dither coefficient a;

and, at the fourth field, pixel G (j, k), dither coefficient c, pixel G (j, k+1), dither coefficient d, pixel G (j+1, k), dither coefficient a, and pixel G (j+1, k+1), dither coefficient b.

The dither coefficient generation circuit 352 executes repeatedly the operation of the first to fourth fields mentioned above. That is, upon completion of generating the dither coefficients at the fourth field, the above-mentioned operation is repeated all over again from the aforementioned first field.

The adder 351 adds the dither coefficients a through d, which are assigned to respective fields as mentioned above, to respective error diffusion processing pixel data ED corresponding to the aforementioned pixel G (j, k), pixel G (j, k+1), pixel G (j+1, k), and pixel G (j+1, k+1), respectively, which are supplied from the aforementioned error diffusion processing circuit 330. The adder 351 then supplies the dither added pixel data thus obtained to an upper bit extracting circuit 353.

For example, at the first field shown in FIG. 10, each of the following data is supplied sequentially, as the dither added pixel data, to the upper bit extracting circuit 353. That is, error diffusion processing pixel data ED corresponding to pixel G (j, k)+dither coefficient a, error diffusion processing pixel data ED corresponding to pixel G (j, k+1)+dither coefficient b, error diffusion processing pixel data ED corresponding to pixel G (j+1, k)+dither coefficient c, and error diffusion processing pixel data ED corresponding to pixel G (j+1, k+1)+dither coefficient d.

The upper bit extracting circuit 353 extracts the bits up to the upper four bits of such dither added pixel data and then supplies the resultant data to the second data conversion circuit 34 shown in FIG. 3 as multi-level gray scale pixel data $D_s$.

The second data conversion circuit 34 converts the multi-level gray scale pixel data $D_s$ into the drive pixel data HD in accordance with the conversion table corresponding to the vertical synchronization frequency, shown by the vertical frequency signal VF.

Figure 11:
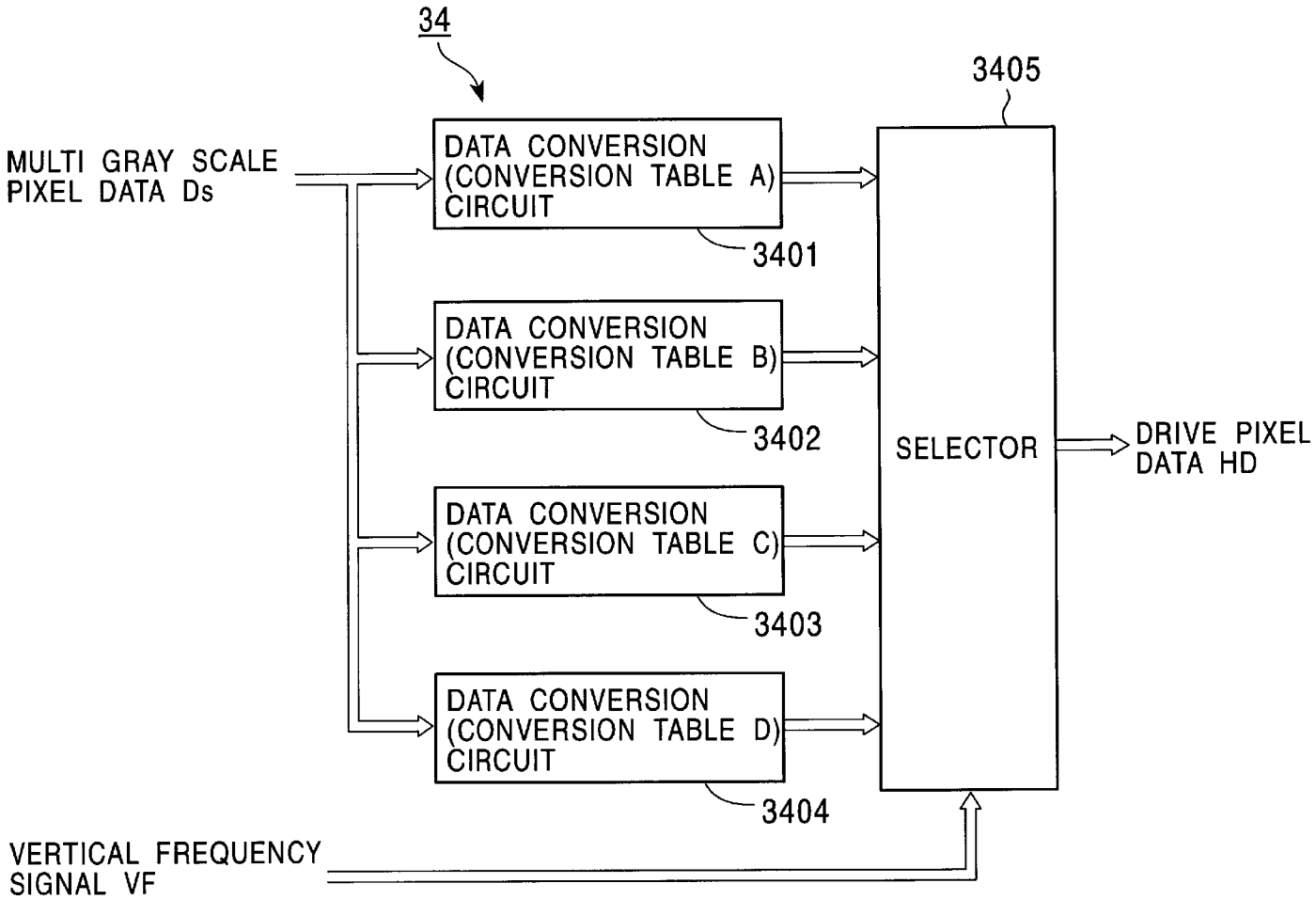
FIG. 11 is a view showing the internal configuration of a second data conversion circuit 34.

FIG. 11 is a view showing an example of the internal configuration of such second data conversion circuit 34.

Each of data conversion circuits 3401 through 3404 in FIG. 11 converts the aforementioned 4-bit multi-level gray scale pixel data $D_s$ to 14-bit data in accordance with conversion tables A to D, which are different from one another.

A selector 3405 alternatively selects data corresponding to the vertical synchronization frequency indicated by the aforementioned vertical frequency signal VF among data that has been converted and outputted by each of these data conversion circuits 3401 to 3404, and then outputs the data as the drive pixel data HD.

For example, in cases where the vertical frequency signal VF indicates $$VF \leqq 60 \text{ Hz},$$

the selector 3405 alternatively selects the conversion data that is converted and outputted by the data conversion circuit 3401 in accordance with the conversion table A shown in FIG. 12, and then outputs the data as the drive pixel data HD.

Moreover, in cases where the vertical frequency signal VF indicates $$60 \text{ Hz} < VF \leqq 65 \text{ Hz},$$

the selector 3405 alternatively selects the conversion data that is converted and outputted by the data conversion circuit 3402 in accordance with the conversion table B shown in FIG. 13, and then outputs the data as the drive pixel data HD.

Moreover, in cases where the vertical frequency signal VF indicates $$65 \text{ Hz} < VF \leqq 75 \text{ Hz},$$

the selector 3405 alternatively selects the conversion data that is converted and outputted by the data conversion circuit 3403 in accordance with the conversion table C shown in FIG. 14, and then outputs the data as the drive pixel data HD.

Still moreover, in cases where the vertical frequency signal VF indicates $$75 \text{ Hz} < VF \leqq 85 \text{ Hz},$$

the selector 3405 alternatively selects the conversion data that is converted and outputted by the data conversion circuit 3404 in accordance with the conversion table D shown in FIG. 15, and then outputs the data as the drive pixel data HD.

As mentioned above, the drive data conversion circuit 30 first applies the multi-level gray scale processing such as the error diffusion processing and the dither processing to 8-bit pixel data D, thereby determining the multi-level gray scale pixel data $D_s$ whose number of bits is reduced to four bits while maintaining the number of levels of the visual brightness gray scale. Subsequently, the drive data conversion circuit 30 converts this multi-level gray scale pixel data $D_s$ into 14-bit drive pixel data HD for actually driving the PDP 10, in accordance with the conversion tables shown in FIG. 12 through FIG. 15 corresponding to the vertical synchronization frequency of a video signal.

The memory 4 writes sequentially the aforementioned drive pixel data HD in accordance with the write signal supplied by the drive control circuit 2. For example, after having completed writing the drive pixel data $HD_{11\text{-}nm}$ for one screen (with n rows and m columns) corresponding to an odd field, the write action allows the memory 4 to divide the drive pixel data $HD_{11\text{-}nm}$ for one screen corresponding to the odd field into each bit digit, as follows, in accordance with the read signal supplied by the drive control circuit 2. That is, $DB1_{11\text{-}nm}$: the first bit of the drive pixel data $HD_{11\text{-}nm}$ $DB2_{11\text{-}nm}$: the second bit of the drive pixel data $HD_{11\text{-}nm}$ $DB3_{11\text{-}nm}$: the third bit of the drive pixel data $HD_{11\text{-}nm}$ $DB4_{11\text{-}nm}$: the fourth bit of the drive pixel data $HD_{11\text{-}nm}$ $DB5_{11\text{-}nm}$: the fifth bit of the drive pixel data $HD_{11\text{-}nm}$ $DB6_{11\text{-}nm}$: the sixth bit of the drive pixel data $HD_{11\text{-}nm}$ $DB7_{11\text{-}nm}$: the seventh bit of the drive pixel data $HD_{11\text{-}nm}$ $DB8_{11\text{-}nm}$: the eighth bit of the drive pixel data $HD_{11\text{-}nm}$ $DB9_{11\text{-}nm}$: the ninth bit of the drive pixel data $HD_{11\text{-}nm}$ $DB10_{11\text{-}nm}$: the tenth bit of the drive pixel data $HD_{11\text{-}nm}$ $DB11_{11\text{-}nm}$: the eleventh bit of the drive pixel data $HD_{11\text{-}nm}$ $DB12_{11\text{-}nm}$: the twelfth bit of the drive pixel data $HD_{11\text{-}nm}$ $DB13_{11\text{-}nm}$: the thirteenth bit of the drive pixel data $HD_{11\text{-}nm}$ $DB14_{11\text{-}nm}$: the fourteenth bit of the drive pixel data $HD_{11\text{-}nm}$ Then, the memory 4 reads the data $DB1_{11\text{-}nm}$, $DB2_{11\text{-}nm}$, $DB14_{11\text{-}nm}$ in sequence line by line and supplies the data to an address driver 6.

Subsequently, the memory 4 reads again the drive pixel data $HD_{11\text{-}nm}$ for one screen corresponding to the odd field in accordance with the read signal supplied by the drive control circuit 2 and then supplies the data to the address driver 6. At this time, the second read-out takes the form according to the vertical frequency signal VF.

That is, in cases where the vertical frequency signal VF shows that $$VF \leqq 60 \text{ Hz},$$

like the aforementioned first read-out, the memory 4 reads each of $DB1_{11\text{-}nm}$, through $DB14_{11\text{-}nm}$ line by line in sequence and then supplies the same to the address driver 6.

However, in cases where the vertical frequency signal VF shows that $$60 \text{ Hz} < VF \leqq 65 \text{ Hz},$$

the memory 4 reads each of $DB2_{11\text{-}nm}$ through $DB14_{11\text{-}nm}$ line by line in sequence except for $DB1_{11\text{-}nm}$ in the aforementioned $DB1_{11\text{-}nm}$ through $DB14_{11\text{-}nm}$ and then supplies the same to the address driver 6.

Moreover, in cases where the vertical frequency signal VF shows that $$65 \text{ Hz} < VF \leqq 75 \text{ Hz},$$

the memory 4 reads each of $DB3_{11\text{-}nm}$ through $DB14_{11\text{-}nm}$ line by line in sequence except for $DB1_{11\text{-}nm}$ and $DB2_{11\text{-}nm}$ in the aforementioned $DB1_{11\text{-}nm}$ through $DB14_{11\text{-}nm}$, and then supplies the same to the address driver 6.

Still moreover, in cases where the vertical frequency signal VF shows that $$75 \text{ Hz} < VF \leqq 85 \text{ Hz},$$

the memory 4 reads each of $DB4_{11\text{-}nm}$ through $DB14_{11\text{-}nm}$ line by line in sequence except for $DB1_{11\text{-}nm}$ through $DB3_{11\text{-}nm}$ in the aforementioned $DB1_{11\text{-}nm}$ through $DB14_{11\text{-}nm}$, and then supplies the same to the address driver 6.

That is, the memory 4 writes in sequence only data that corresponds to odd fields (or even fields) out of the drive pixel data HD supplied sequentially from the drive data conversion circuit 30 and then reads each twice in the form mentioned above. Such reading twice allows to carry out display drive for two fields as described later.

The drive control circuit 2 generates clock signals for the aforementioned A/D converter 1 in synchronization with the horizontal synchronization signal H and the vertical synchronization detection signal V supplied from the synchronization detector circuit 3. Moreover, the drive control circuit 2 generates write and read signals in response to the vertical frequency signal VF in synchronization with the aforementioned vertical synchronization detection signal V and then supplies the signals to the memory 4. Moreover, the drive control circuit 2 supplies various types of timing signals for controllably driving the PDP 10 in accordance with light-emission drive patterns in response to the vertical frequency signal VF to the address driver 6, a first sustain driver 7, and a second sustain driver 8, respectively.

FIG. 16A through FIG. 16D show examples of light-emission drive patterns according to the drive method of the present invention.

Figures 16A, 16B, 16C, 16D:
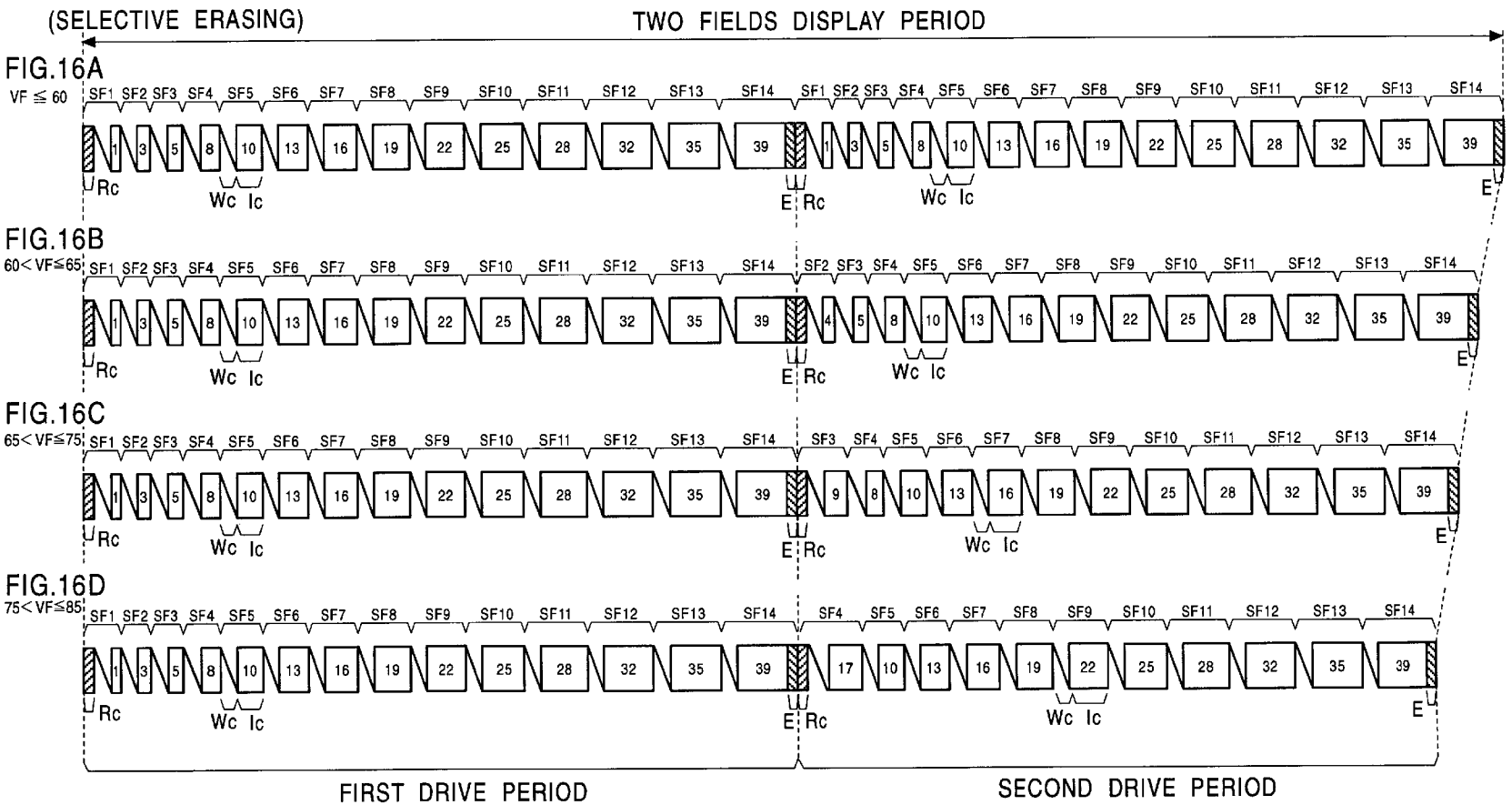
FIG. 16A through FIG. 16D show a light-emission drive format during a display period of two fields in accordance with the drive method of the present invention.

FIG. 16A is a view showing a light-emission drive pattern in a case where the vertical frequency signal VF indicates $$VF \leqq 60 \text{ Hz},$$

FIG. 16B in a case where the vertical frequency signal VF indicates $$60 \text{ Hz} < VF \leqq 65 \text{ Hz},$$

FIG. 16C in a case where the vertical frequency signal VF indicates $$65 \text{ Hz} < VF \leqq 75 \text{ Hz}, \text{ and}$$

FIG. 16D in a case where the vertical frequency signal VF indicates $$75 \text{ Hz} < VF \leqq 85 \text{ Hz}.$$

In this embodiment, as shown in FIG. 16A through FIG. 16D, a display period of two fields is regarded as a unit display period which is repeatedly executed. At this time, the unit display period consists of the former-half, first drive period, and the latter-half, second drive period. The operation in the first drive period is the same in all of FIG. 16A through FIG. 16D.

The first drive period consists of 14 sub-fields SF1 through SF14. In each of the sub-fields, a pixel data write process Wc is performed to write pixel data to each discharge cell of the PDP 10 for setting"light-emitting cells" and "non-light-emitting cells". The light-emission sustain process Ic is also performed which allows only the aforementioned "light-emitting cells" to emit light by discharge for the number of frequencies (the period) shown in the figure and sustains light-emission thereof. Moreover, in the first drive period, only in the head sub-field, a simultaneous reset process Rc for initializing the quantity of wall charge within all discharge cells of the PDP 10 is executed. In addition, only in the last sub-field, an erase process E is executed for erasing simultaneously the wall charge within all discharge cells. That is, light emission drive in the first drive period is carried out by division light-emission drive with sub-fields divided into 14 sub-fields as sub-fields SF1 through SF14.

In order to implement the aforementioned operations in each of these simultaneous reset process Rc, the pixel data write process Wc, the light-emission sustain process Ic, and the erase process E, each of the address driver 6, the first sustain driver 7, and the second sustain driver 8 applies various types of drive pulses to each of the electrode columns $D_1$ through $D_m$, and the electrode rows $X_1$ through $X_n$, and $Y_1$ through $Y_n$.

Figure 17:
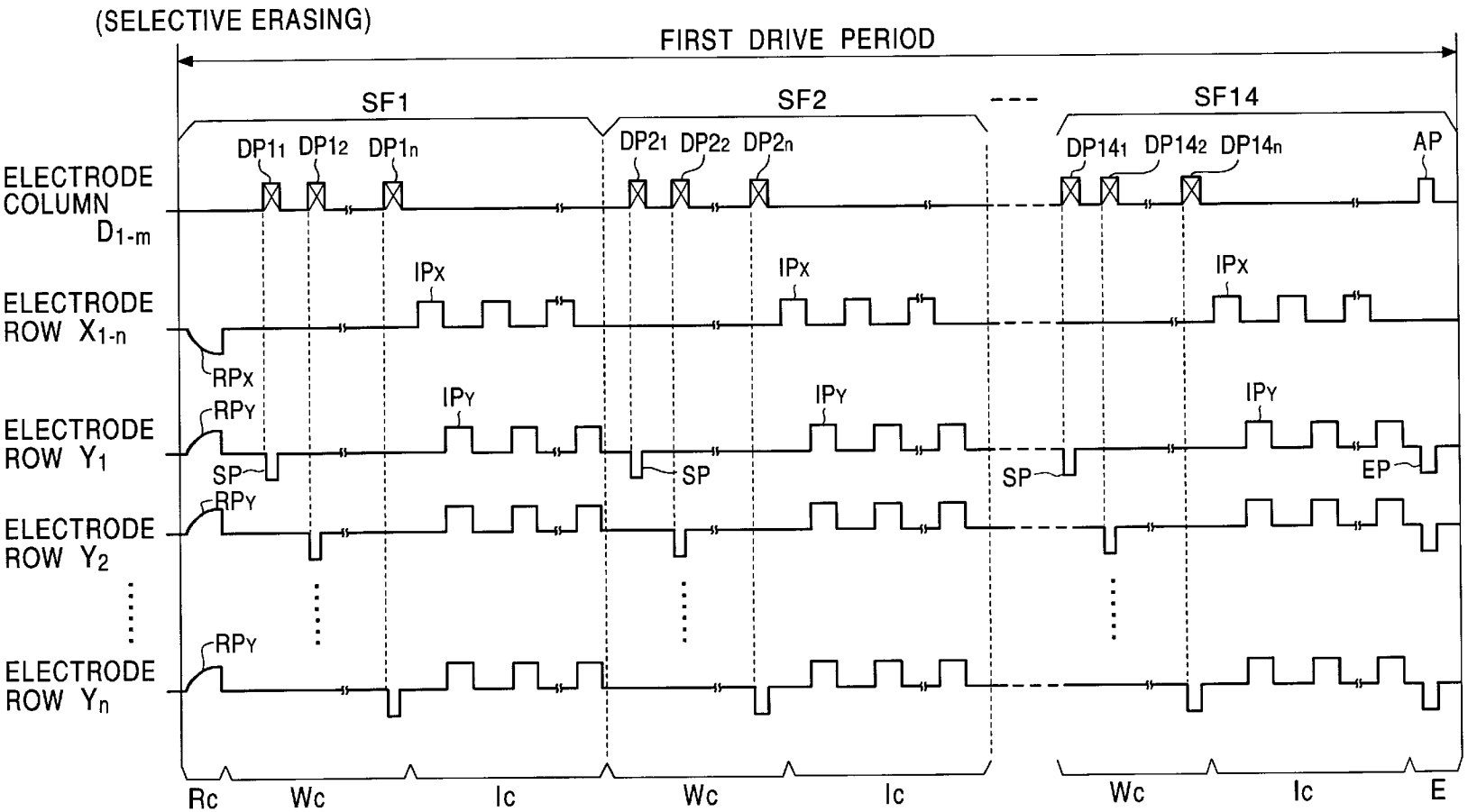
FIG. 17 is a view showing the application timing of various types of drive pulses within a first drive period.

FIG. 17 is a view showing the application timing of various types of drive pulses in the first drive period shown in FIG. 16A through FIG. 16D.

First, in the simultaneous reset process Rc of the sub-field SF1, the first sustain driver 7 and the second sustain driver 8 apply a reset pulse $RP_x$ of negative polarity and a reset pulse $RP_y$ of positive polarity to the electrode rows $X_1$ through $X_n$ and $Y_1$ through $Y_n$. The application of these reset pulses $RP_x$ and $RP_Y$ allows a reset discharge to be carried out in all discharge cells of the PDP 10, and thus a predetermined uniform wall charge is formed in respective discharge cells. This allows all discharge cells in the PDP 10 to be once initialized to the "light-emitting cells".

Next, in the pixel data write process Wc of the sub-field SF1, the address driver 6 generates a pixel data pulse having a voltage corresponding to the logic level of each of the $DB1_{11\text{-}nm}$ supplied from the memory 4 as mentioned above and applies the pulse sequentially to the electrode column $D_{1\text{-}m}$ line by line. That is, first, pixel data pulse group $DP1_1$ comprising m pixel data pulses corresponding to the first line of the aforementioned $DB1_{11\text{-}nm}$, that is, corresponding to the logic level of the respective $DB1_{11\text{-}nm}$, is generated and applied simultaneously to the electrode column $D_{1\text{-}m}$. Next, pixel data pulse group $DP1_2$ comprising m pixel data pulses corresponding to the second line of the $DB1_{11\text{-}nm}$, that is, corresponding to the logic level of the respective $DB1_{21\text{-}2n}$, is generated and applied simultaneously to the electrode column $D_{1\text{-}m}$. Subsequently, likewise, pixel data pulse groups $DP1_3$ through $DP1_n$ corresponding to respective lines continue to be applied to the electrode column $D_{1\text{-}m}$ in sequence.

Next, in the pixel data write process Wc of the sub-field SF2, the address driver 6 generates a pixel data pulse having a voltage corresponding to the logic level of each of the $DB2_{11\text{-}nm}$ supplied from the memory 4 as mentioned above and applies the pulse sequentially to the electrode column $D_{1\text{-}m}$ line by line. That is, first, pixel data pulse group $DP2_1$ comprising m pixel data pulses corresponding to the first line of the aforementioned $DB2_{11\text{-}nm}$, that is, corresponding to the logic level of the respective $DB2_{11\text{-}nm}$, is generated and applied simultaneously to the electrode column $D_{1\text{-}m}$. Next, pixel data pulse group $DP2_2$ comprising m pixel data pulses corresponding to the second line of the $DB2_{11\text{-}nm}$, that is, corresponding to the logic level of the respective $DB1_{21\text{-}2n}$, is generated and simultaneously applied to the electrode column $D_{1\text{-}m}$. Subsequently, likewise, pixel data pulse groups $DP2_3$ through $DP2_n$ corresponding to respective lines continue to be applied to the electrode column $D_{1\text{-}m}$ in sequence. In the pixel data write process Wc of each of the sub-fields SF3 through SF14, in the same manner as that mentioned above, the address driver 6 generates pixel data pulse groups $DP3_{1\text{-}n}$ through $DP14_{1\text{-}n}$ based on each of the $DB3_{11\text{-}nm}$ through $DB14_{11\text{-}nm}$ and continues to apply the pulses to the electrode column $D_{1\text{-}m}$ line by line in sequence. Moreover, it is to be understood that the address driver 6 generates a high voltage pixel data pulse for logic level "1" of DB and a low voltage pixel data pulse (zero volt) for level "0".

Here, the second sustain driver 8 generates scanning pulses SP of negative polarity shown in FIG. 17 at the same timing as the application timing of each of the aforementioned pixel data pulse groups DP. Then, the second sustain driver 8 applies the scanning pulses SP in sequence to the electrode rows $Y_1$ through $Y_n$. At this time, discharge (selective erase discharge) is caused only in the discharge cells located at the intersections of the "rows" to which the scanning pulse SP is applied and the "columns" to which a high-voltage pixel data pulse is applied, so that the wall charge remaining within the discharge cells are selectively erased. This selective erase discharge causes the discharge cells that have been reset to a state of "light-emitting cells" at the aforementioned simultaneous reset process Rc to change to the "non-light-emitting cells". Incidentally, the discharge cells that are formed in the "columns" to which the aforementioned high-voltage pixel data pulses have not been applied are provided with no discharge, but are sustained to a state of being initialized in the aforementioned simultaneous reset process Rc, that is, to the state of "light-emitting cells".

That is, by means of the pixel data write process Wc of each of the sub-fields, a "light-emitting cell" for which sustain discharge is generated in the light-emission sustain process Ic following immediately thereafter and a "non-light-emitting cell" which remains in the non-light-emitting state without having sustain discharge generated are set alternatively in response to pixel data. Thus, the so-called writing of pixel data to respective discharge cells is carried out.

In addition, in the light-emission sustain process Ic which is executed in each of the sub-fields SF1 through SF14, the first sustain driver 7 and the second sustain driver 8 apply sustain pulses $IP_X$ and $IP_Y$ of positive polarity alternately, as shown in FIG. 17, to the electrode rows $X_1$ through $X_n$ and $Y_1$ through $Y_n$. Here, the number of times of the sustain pulse IP to be applied in light-emission sustain process Ic of each of the sub-fields is as follows. That is, SF1: 1,
SF2: 3,
SF3: 5,
SF4: 8,
SF5: 10,
SF6: 13,
SF7: 16,
SF8: 19,
SF9: 22,
SF10: 25,
SF11: 28,
SF12: 32,
SF13: 35, and
SF14: 39.

The aforementioned application of the sustain pulse IP causes the discharge cells in which wall charges are preserved in the aforementioned pixel data write process Wc, that is, the "light-emitting cells" to perform sustain discharge every time the cells are applied with the sustain pulses $IP_X$ and $IP_Y$, and to sustain the discharge light-emission state thereof only for the aforementioned number of times (period). At this time, the ratio of the number of times of the sustain discharges to be executed in each of the sub-fields SF1 through SF14 is made non-linear (that is, the inverse Gamma ratio, $Y=X^{2.2}$) as mentioned above. This is to allow for compensating for the non-linear characteristic (the Gamma characteristic) of the input pixel data D.

Moreover, in the erase process E of the last sub-field of the first drive period shown in FIG. 17, the address driver 6 generates an erase pulse AP and applies the pulse to each of the electrode columns $D_{1-m}$. The second sustain driver 8 generates an erase pulse EP at the same time as the application timing of the erase pulse AP and then applies the pulse to each of the electrode rows $Y_1$ through $Y_n$. The simultaneous applications of these erase pulses AP and EP cause the erase discharge to be generated in all discharge cells of the PDP 10, so that walls charge remaining in all discharge cells disappears. That is, the erase discharge turns all discharge cells of the PDP 10 to "non-light-emitting cells". The aforementioned drive effectuates the selective erase discharge selectively in response to the login level of each of the bits (the first to fourteenth bit) of the aforementioned drive pixel data HD, in the pixel data write process Wc of the sub-field corresponding to the bit digit. At this time, the selective erase discharge causes the discharge cells that have been initialized to the "light-emitting cells" in the aforementioned simultaneous reset process Rc to change to the "non-light-emitting cells". On the other hand, the discharge cells for which the selective erase discharge has not been carried out sustain the state initialized at the aforementioned simultaneous reset process Rc, that is, the state of "light-emitting cells". In each light-emission sustain process Ic, only these "light-emitting cells" are repeatedly allowed to emit light for the number of times (period) corresponding to the sub-field thereof.

On the other hand, in the second drive period, although the same operation as that in the aforementioned first drive period is basically employed, the number of sub-fields to be executed is intended to decrease in response to the vertical frequency signal VF.

That is, as shown in the second drive period of FIG. 16B, in cases where the vertical frequency signal VF is $$60\ \text{Hz} < VF \leqq 65\ \text{Hz},$$

then, the sub-field SF1 is omitted, and the number of times of sustain discharge that should have been originally executed in the light-emission sustain process Ic of SF1 is added to the light-emission sustain process Ic of sub-field SF2. Therefore, the number of times of sustain discharge to be carried out in the light-emission sustain process Ic of sub-field SF2 in the second drive period of FIG. 16B becomes "4".

Moreover, as shown in the second drive period of FIG. 16C, in cases where the vertical frequency signal VF is $$65\ \text{Hz} < VF \leqq 75\ \text{Hz},$$

then, the sub-fields SF1 and SF2 are omitted, and the number of times of sustain discharge that should have been originally executed in the light-emission sustain process Ic of SF1 and SF2 is added to the light-emission sustain process Ic of sub-field SF3. Therefore, the number of times of sustain discharge to be carried out in the light-emission sustain process Ic of sub-field SF3 in the second drive period of FIG. 16C becomes "9".

Moreover, as shown in the second drive period of FIG. 16D, in cases where the vertical frequency signal VF is $$75\ \text{Hz} < VF \leqq 85\ \text{Hz},$$

then, the sub-fields SF1 through SF3 are omitted, and the number of times of sustain discharge that should have been originally executed in the light-emission sustain process Ic of SF1 through SF3 is added to the light-emission sustain process Ic of sub-field SF4. Therefore, the number of times of sustain discharge to be carried out in the light-emission sustain process Ic of sub-field SF4 in the second drive period of FIG. 16D becomes "17".

Moreover, as shown in FIG. 16A, in cases where the vertical frequency signal VF is $$VF \leqq 60\ \text{Hz},$$

then, like the aforementioned first drive period, all of the sub-fields SF1 through SF14 are executed in the second drive period.

As mentioned above, the number of sub-fields to be executed in the second drive period is reduced as the vertical frequency signal VF increases. As shown in FIG. 16B through FIG. 16D, this shortens the drive time for the display period of one field as the vertical synchronization frequency of an inputted video signal increases, thereby enabling image display with a fresh rate in response to the vertical frequency of an input video signal.

Here, the drive pixel data HD, which is used for a drive in accordance with the light-emission drive formats shown in FIG. 16A through FIG. 16D, has 15 patterns as shown in FIG. 12 to FIG. 15. Accordingly, the light-emission drive patterns to be actually carried out in accordance with those shown in FIG. 16A through FIG. 16D are as shown in FIG. 18 through FIG. 21. Herein, FIG. 18 shows the light-emission drive pattern during the display period of two fields in a case where the vertical frequency signal VF indicates $$VF \leqq 60\ \text{Hz};$$

FIG. 19 shows the light-emission drive pattern during the display period of two fields in a case where the vertical frequency signal VF indicates $$60\ \text{Hz} < VF \leqq 65\ \text{Hz};$$

FIG. 20 shows the light-emission drive pattern during the display period of two fields in a case where the vertical frequency signal VF indicates $$65\ \text{Hz} < VF \leqq 75\ \text{Hz}; \text{ and}$$

FIG. 21 shows the light-emission drive pattern during the display period of two fields in a case where the vertical frequency signal VF indicates $$75\ \text{Hz} < VF \leqq 85\ \text{Hz}.$$

The black circles shown in FIG. 18 through FIG. 21 indicate that the selective erase discharge is carried out in the pixel data write process Wc of the sub-field. That is, the simultaneous reset process Rc to be executed in the head of each of the first and second drive periods causes the wall charge formed in all discharge cells of the PDP 10 to remain until the aforementioned selective erase discharge is carried out, and in the light-emission sustain process Ic of each of the sub-fields SF present until that time, sustain discharge accompanying light-emission is generated (which is shown by the white circles). As such, each discharge cell remains as a "light-emitting cell" until the aforementioned selective erase discharge is carried out in each of the first and second drive period, and in the light-emission sustain process Ic of each of the sub-fields present until that time, light-emission is repeated for the number of times corresponding to each of the sub-fields.

According to the light emission drive patterns shown in FIG. 18 to FIG. 21, the gray-scale drive of 15 levels with the following light-emission brightness ratio is carried out. That is approximately,

{0, 1, 4, 9, 17, 27, 40, 56, 75, 97, 122, 150, 182, 217, 256}.

However, the input pixel data D supplied from the aforementioned A/D converter 1 expresses an 8-bit halftone, that is, the halftone of 256 levels. Accordingly, in order to implement halftone display of about 256 levels by means of the aforementioned halftone drive of 15 levels, the multi-level gray scale processing circuit 33 shown in FIG. 3 is allowed to perform multi-level gray scale processing such as the error diffusion and dither processing.

As detailed in the foregoing, in the present invention, the number of sub-fields to be executed in the second drive period decreases as the vertical synchronization frequency of inputted video signals increases to shorten the drive time per the display period of one field. This enables image display at a fresh rate in response to the vertical frequency of the inputted video signals.

Furthermore, in the aforementioned embodiment, there is a case where the so-called selective erase address method is employed as the write method of pixel data is described, in which a wall charge is built up in each of the discharge cells beforehand in the head of each drive period to set all discharge cells to "light-emitting cells" and the wall charge is selectively erased in response to pixel data, thereby writing pixel data.

However, the present invention is also applicable to cases where the so-called selective write address method is employed as a pixel data write method, in which a wall charge is designed to be selectively built up in response to pixel data.

FIG. 22A through FIG. 22D show light-emission drive formats in cases where this selective write address method is employed.

As shown in FIG. 22A through FIG. 22D, in cases where the selective write address method is employed, the display period of two fields is regarded as one cycle and repeatedly executed like the case where the aforementioned selective erase address method is employed. At this time, the cycle constitutes the former half first drive period and the latter half second drive period with the operation in the first drive period being the same in FIG. 22A through FIG. 22D.

The first drive period has fourteen sub-fields SF1 through SF14. In each of the sub-fields, carried out are the pixel data write process Wc for writing pixel data to respective discharge cells of the PDP 10 to set to either "light-emitting cells" or "non-light-emitting cells", and the light-emission sustain process Ic for sustaining the light-emission state by allowing only the aforementioned "light-emitting cells" to perform discharge light-emission for frequencies (period) shown in the figures. Moreover, during the first drive period, the simultaneous reset process Rc for initializing the quantity of wall charges within all discharge cells of the PDP 10 is executed only in the head sub-field, and the erase process E for simultaneously erasing the wall charges in all discharge cells is executed only in the last sub-field.

In order to implement the aforementioned operations in each of these simultaneous reset process Rc, the pixel data write process Wc, the light-emission sustain process Ic, and the erase process E, each of the address drivers 6, the first sustain driver 7, and the second sustain driver 8 applies various types of drive pulses to each of the electrode columns $D_1$ through $D_m$, and to the electrode rows $X_1$ through $X_n$, and $Y_1$ through $Y_n$.

Figures 22A, 22B, 22C, 22D:
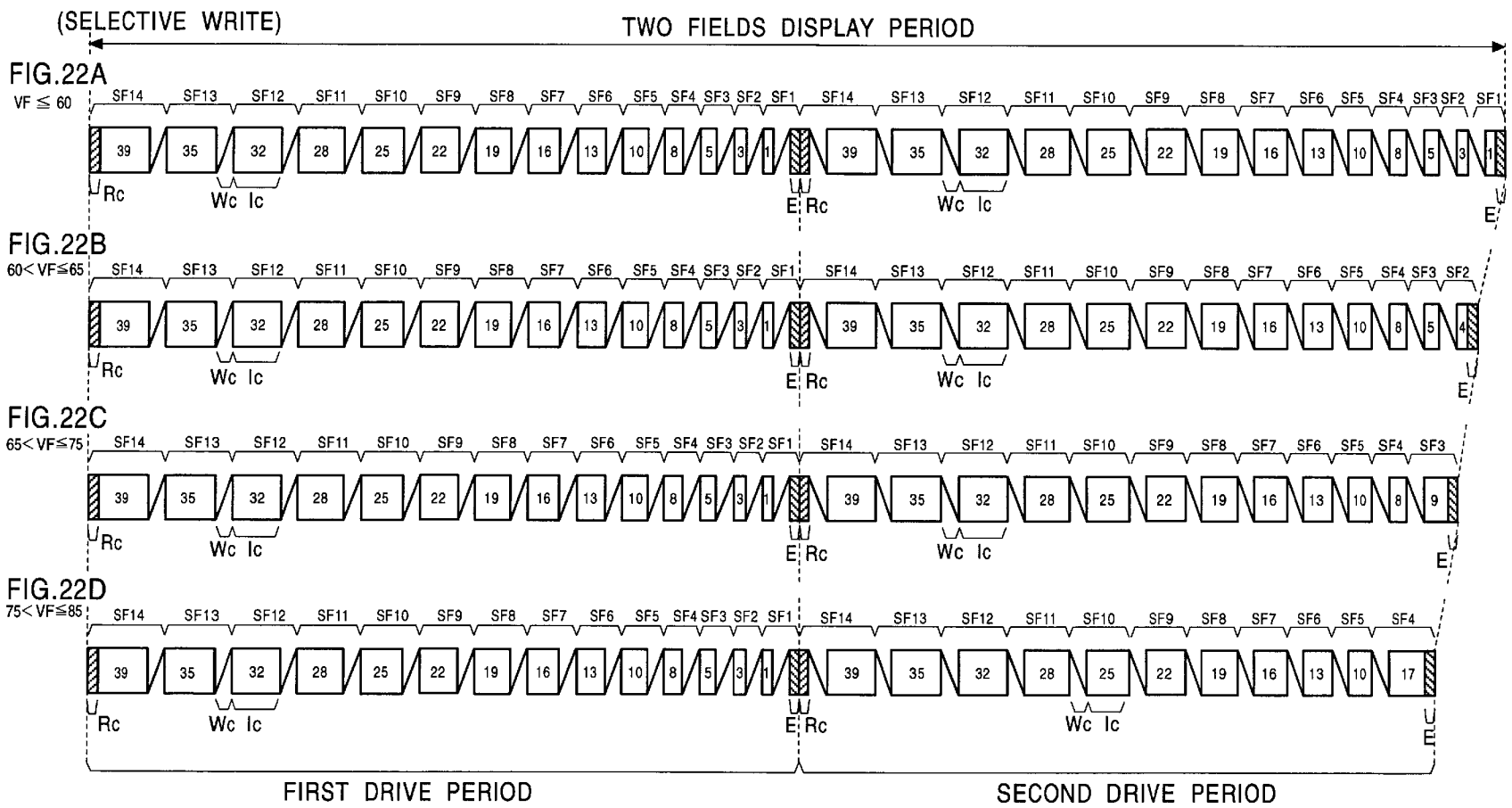
FIG. 22A through FIG. 22D is a view showing a light-emission drive format in the display period of two fields, which is used in a case where a selective write address method employed.
Figure 23:
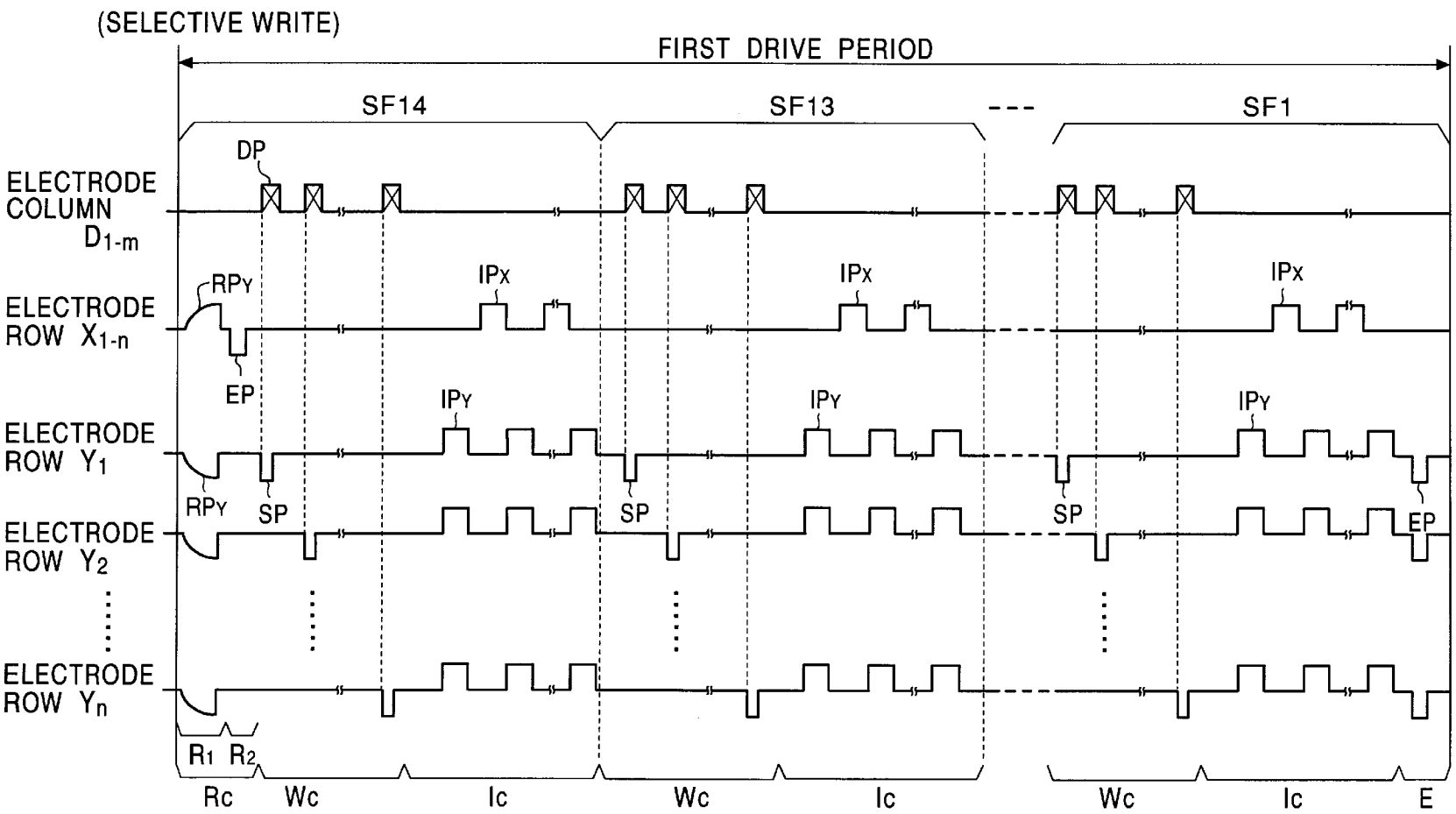
FIG. 23 is a view showing the application timing of various types of drive pulses to be applied during the first drive period when the selective write address method is employed.

FIG. 23 is a view showing the application timing of various types of drive pulses within the first drive period shown in FIG. 22A through FIG. 22D.

As shown in FIG. 23, in cases where the aforementioned selective write address method is employed, first, in the simultaneous reset process Rc of the head sub-field SF14, the first sustain driver 7 and the second sustain driver 8 apply reset pulses $RP_X$ and $RP_Y$ to the electrode rows X and Y of the PDP 10, respectively. This allows reset discharge to be carried out in all discharge cells of the PDP 10 to force wall charges to be built up in respective discharge cells ($R_1$). Immediately thereafter, the first sustain driver 7 applies the erase pulse EP to the electrode rows $X_1$ through $X_n$ of the PDP 10 simultaneously, thereby generating erase discharge for erasing the aforementioned wall charges built up in all discharge cells ($R_2$). That is, the execution of the simultaneous reset process Rc shown in FIG. 23 allows all discharge cells in the PDP 10 to be initialized to the state of a non-light-emitting cell.

In each pixel data write process Wc, discharge (selective write discharge) is carried out only in the discharge cells located at the intersections of the "rows" to which the scanning pulse SP is applied and the "columns" to which a high-voltage pixel data pulse is applied, so that a wall charge is built up selectively in the discharge cells. This selective write discharge causes the discharge cells that have been reset to the state of "non-light-emitting cells" at the aforementioned simultaneous reset process Rc to change to the "light-emitting cells". Moreover, the discharge cells that are formed in the "columns" to which the aforementioned high-voltage pixel data pulses are not applied are provided with no discharge, but are sustained in a state of being initialized in the aforementioned simultaneous reset process Rc, that is, in a state of "non-light-emitting cells".

That is, by the execution of the pixel data write process Wc, the "light-emitting cells" in which the light-emitting state is sustained in the light-emission sustain process to be described later and the "non-light-emitting cells" remaining in an "off" state are alternatively set in response to pixel data. Thus, the so-called writing of pixel data to respective discharge cells is carried out.

In addition, in each of the light-emission sustain processes Ic, the first sustain driver 7 and the second sustain driver 8 apply sustain pulses $IP_X$ and $IP_Y$ of positive polarity alternately as shown in FIG. 23 to the electrode rows $X_1$ through $X_n$ and $Y_1$ through $Y_n$. Here, the number of frequencies of the sustain pulse IP to be applied in light-emission sustain process Ic of each of the sub-fields is as follows. That is, SF14: 39,
SF13: 35,
SF12: 32,
SF11: 28
SF10: 25,
SF9: 22,
SF8: 19,
SF7: 16,
SF6: 13,
SF5: 10,

SF4: 8,

SF3: 5,

SF2: 3, and

SF1: 1.

The aforementioned application of the sustain pulse IP causes the discharge cells in which wall charges are preserved in the aforementioned pixel data write process. Wc, that is, the "light-emitting cells" to perform sustain discharge every time the cells are applied with the sustain pulses $IP_X$ and $IP_Y$, and to sustain the discharge light-emission state thereof only for the aforementioned frequencies (period). At this time, the ratio of the number of frequencies of the sustain discharges to be executed in each of the sub-fields SF1 through SF14 is made non-linear (that is, the inverse Gamma ratio, $Y=X^{2.2}$) as mentioned above. This is to allow for compensating of the non-linear characteristic (the Gamma characteristic) of the input pixel data D.

Moreover, in the write process E of the last sub-field SF1 of the first drive period shown in FIG. 22A through FIG. 22D, the second sustain driver 8 generates an erase pulse EP and applies the pulse to each of the electrode rows $Y_1$ through $Y_n$. The application of the erase pulse EP causes an erase discharge to be generated in all discharge cells of the PDP 10, so that wall charges remaining in all discharge cells disappear. That is, the erase discharge turns all discharge cells of the PDP 10 to "non-light-emitting cells".

On the other hand, in the second drive period shown in FIG. 22A through FIG. 22D, although the same operation as that in the aforementioned first drive period is basically employed, the number of sub-fields to be executed is intended to decrease in response to the vertical frequency signal VF.

That is, as shown in the second drive period of FIG. 22B, in cases where the vertical frequency signal VF is $$60\ \text{Hz} < VF \leqq 65\ \text{Hz},$$

then, the sub-field SF1 is omitted, and the frequencies of sustain discharge that should have been originally executed in the light-emission sustain process Ic of SF1 is added to the light-emission sustain process Ic of sub-field SF2. Therefore, the number of frequencies of sustain discharge to be carried out in the light-emission sustain process Ic of sub-field SF2 in the second drive period of FIG. 22B becomes "4".

Moreover, as shown in the second drive period of FIG. 22C, in cases where the vertical frequency signal VF is $$65\ \text{Hz} < VF \leqq 75\ \text{Hz},$$

then, the sub-fields SF1 and SF2 are omitted, and the number of frequencies of sustain discharge that should have been originally executed in the light-emission sustain process Ic of SF1 and SF2 is added to the light-emission sustain process Ic of sub-field SF3. Therefore, the frequencies of sustain discharge to be carried out in the light-emission sustain process Ic of sub-field SF3 in the second drive period of FIG. 22C becomes "9".

Moreover, as shown in the second drive period of FIG. 22D, in cases where the vertical frequency signal VF is that $$75\ \text{Hz} < VF \leqq 85\ \text{Hz},$$

then, the sub-fields SF1 through SF3 are omitted, and the frequencies of sustain discharge that should have been originally executed in the light-emission sustain process Ic of the SF1 through SF3 is added to the light-emission sustain process Ic of sub-field SF4. Therefore, the frequencies of sustain discharge to be carried out in the light-emission sustain process Ic of sub-field SF4 in the second drive period of FIG. 22D becomes "17".

Moreover, as shown in FIG. 22A, in cases where the vertical frequency signal VF is $$VF \leqq 60\ \text{Hz},$$

then, like the aforementioned first drive period, all of the sub-fields SF1 through SF14 are executed in the second drive period.

FIG. 24 through FIG. 27 show the conversion tables to be used in the second data conversion circuit 34 in cases where the selective write address method is employed, and show all light-emission drive patterns within the display period of two fields to be carried out in response to the drive pixel data HD that has been converted to be outputted in accordance with the conversion tables. Moreover, in cases where such a selective write address method is employed, only one conversion table is used in the second data conversion circuit 34 irrespective of the vertical frequency signal VF as shown in FIG. 26 through FIG. 29.

Here, FIG. 24 shows the light-emission drive pattern in a case where the vertical frequency signal VF shows that $$VF \leqq 60\ \text{Hz};$$

FIG. 25 shows the light-emission drive pattern in a case where the vertical frequency signal VF shows that $$60\ \text{Hz} < VF \leqq 65\ \text{Hz};$$

FIG. 26 shows the light-emission drive pattern in a case where the vertical frequency signal VF shows that $$65\ \text{Hz} < VF \leqq 75\ \text{Hz}; \text{ and}$$

Figure 27:
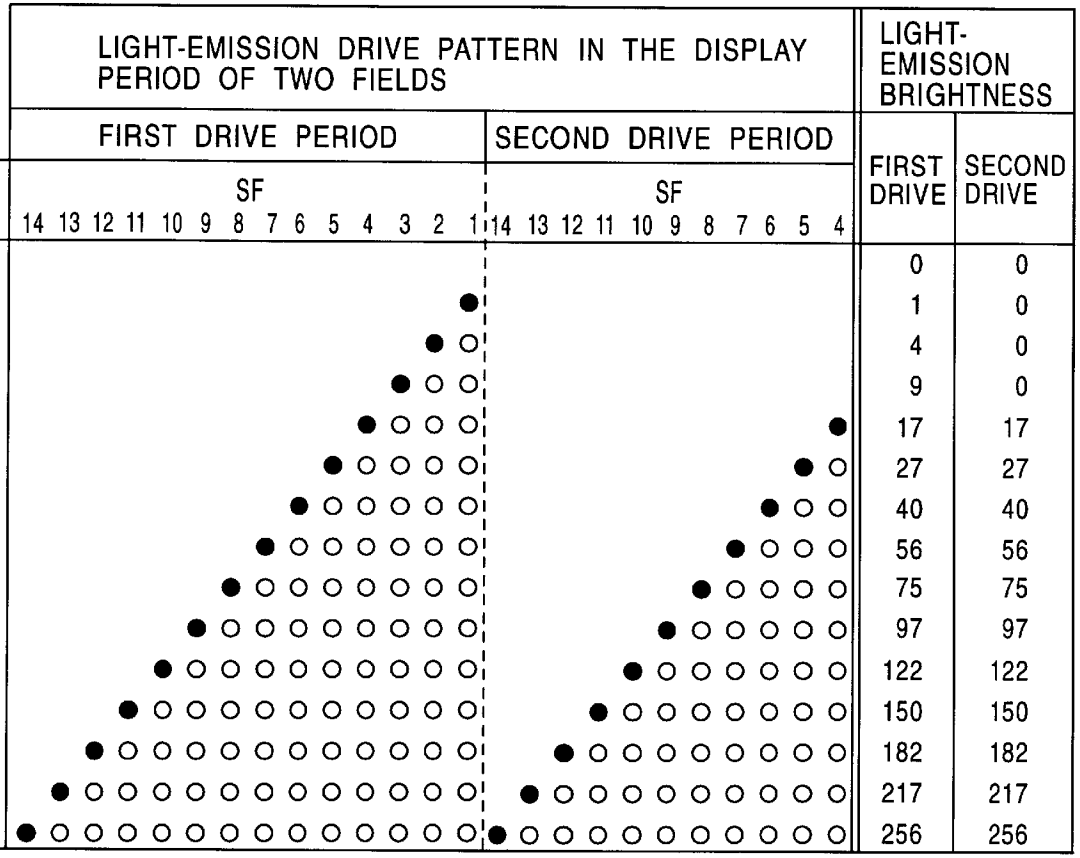
FIG. 27 is a view showing the conversion table of the second data conversion circuit 34 and all light-emission drive patterns used during the display period of two fields, which are carried out at the time of the vertical synchronization frequency of a video signal being equal to 75 Hz to 85 Hz, when the selective write address method is employed.

FIG. 27 shows the light-emission drive pattern in a case where the vertical frequency signal VF shows that $$75\ \text{Hz} < VF \leqq 85\ \text{Hz}.$$

The black circles shown in FIG. 24 through FIG. 27 indicate that the aforementioned selective write discharge is generated in the pixel data write process Wc of the sub-field. That is, the selective write discharge is generated only in the sub-field SF corresponding to the bit digit of logic level "1" in the drive pixel data HD. The sustain discharge accompanying light-emission is generated and the state of the light-emission is sustained in the light-emission sustain process Ic of the sub-field in which this selective write discharge is carried out and of the sub-fields (indicated by white circles) present thereafter.

As described above, even in cases where the selective write address method is employed as the pixel data write method, images can be displayed at a refresh rate in response to inputted video signals by reducing the number of sub-fields that should be executed within the second drive period in accordance with the vertical frequency signal VF.

In addition, in the light-emission drive patterns shown in FIG. 18 through FIG. 21 and FIG. 24 through FIG. 27, the selective erase (write) discharge is to be carried out once at a maximum within each of the first and second drive periods.

However, in order to make certain of writing pixel data, the selective erase (write) discharge may be carried out twice in succession within each of the first and second drive periods as shown FIG. 28 through FIG. 31 and FIG. 32 through FIG. 35. Moreover, FIGS. 28 to 31 show the conversion tables to be used in the second data conversion circuit 34 in cases where the selective erase address method is employed as the pixel data write method, and show all light-emission drive patterns within the display period of two fields to be carried out in response to the drive pixel data HD that has been converted to be outputted in accordance with the conversion tables. On the other hand, FIG. 32 through FIG. 35 show the conversion tables to be used in the second data conversion circuit 34 in cases where the selective write address method is employed as the pixel data write method, and show all light-emission drive patterns within the display period of two fields to be carried out in response to the drive pixel data HD that has been converted to be outputted in accordance with the conversion tables.

Figure 32:
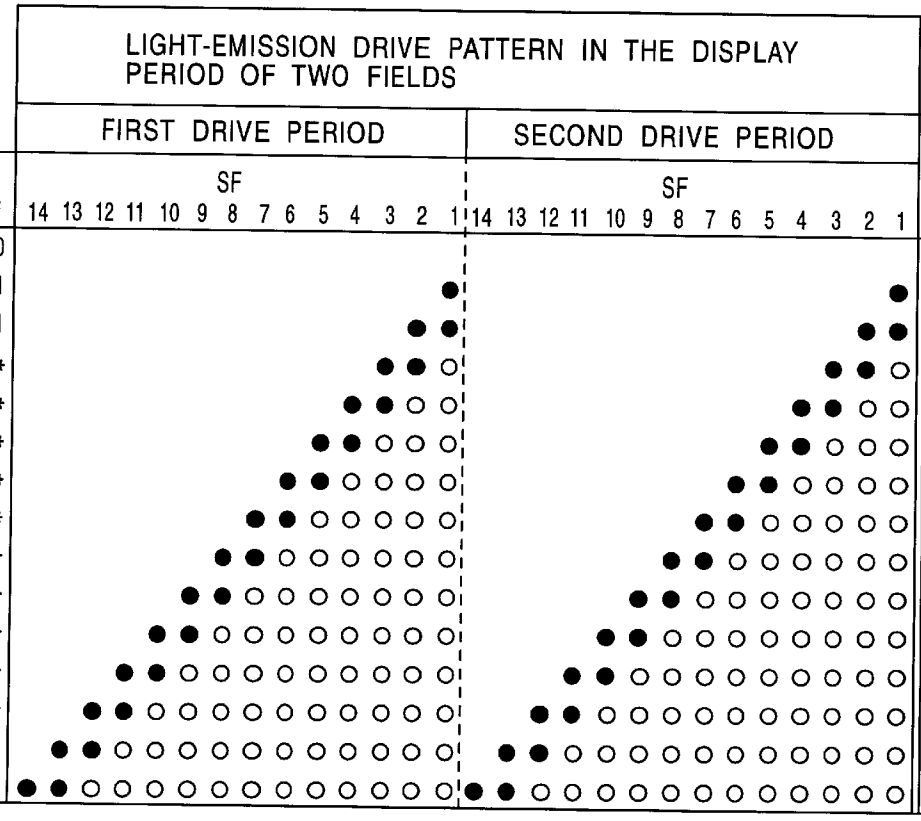
FIG. 32 is a view showing another example of the conversion table of the second data conversion circuit 34 and all light-emission drive patterns used during the display period of two fields, which are carried out at the time of the vertical synchronization frequency of a video signal being equal to 60 Hz or less, when the selective write address method is employed.

At this time, FIG. 28 and FIG. 32 show the respective light-emission drive patterns in a case where the vertical frequency signal VF shows that $$VF \leqq 60 \text{ Hz};$$

FIG. 29 and FIG. 33 show the respective light-emission drive patterns in a case where the vertical frequency signal VF shows that $$60 \text{ Hz} < VF \leqq 65 \text{ Hz};$$

FIG. 30 and FIG. 34 show the respective light-emission drive patterns in a case where the vertical frequency signal VF shows that $$65 \text{ Hz} < VF \leqq 75 \text{ Hz}; \text{ and}$$

FIG. 31 and FIG. 35 show the respective light-emission drive patterns in a case where the vertical frequency signal VF shows that $$75 \text{ Hz} < VF \leqq 85 \text{ Hz}.$$

In addition, in the light-emission drive formats shown in FIG. 16A through FIG. 16D and FIG. 22A through FIG. 22D, the reset process Rc is executed only once in each of the first and second drive periods, thereby carrying out the halftone drive of 15 levels. However, the number of levels of halftone drive may be increased by means of executing the simultaneous reset process Rc twice in each drive period.

Figures 36A, 36B, 36C, 36D:
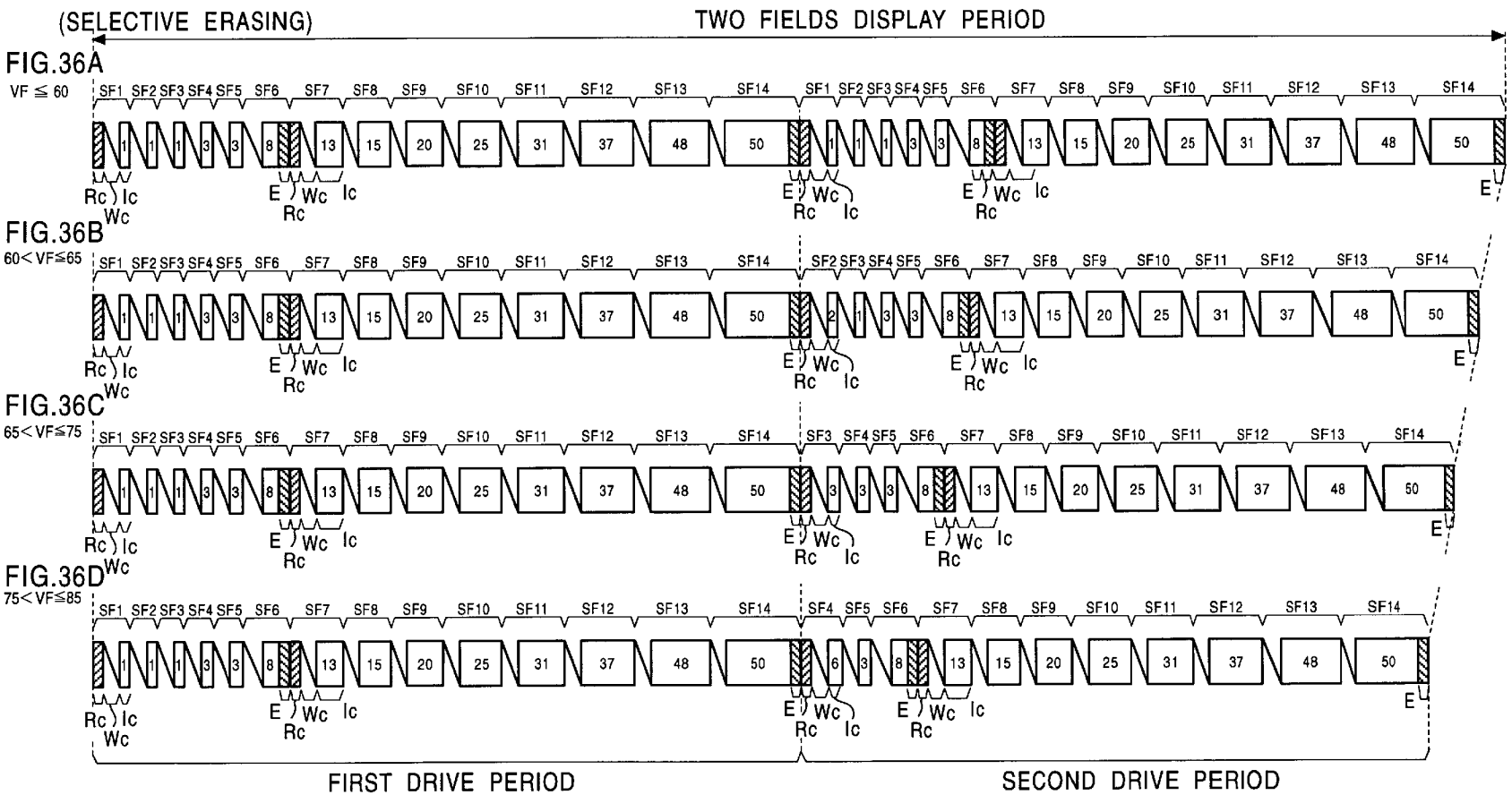
FIG. 36A through FIG. 36D show another example of a light-emission drive pattern used during the display period of two fields when the selective erase address method is employed.
Figures 37A, 37B, 37C, 37D:
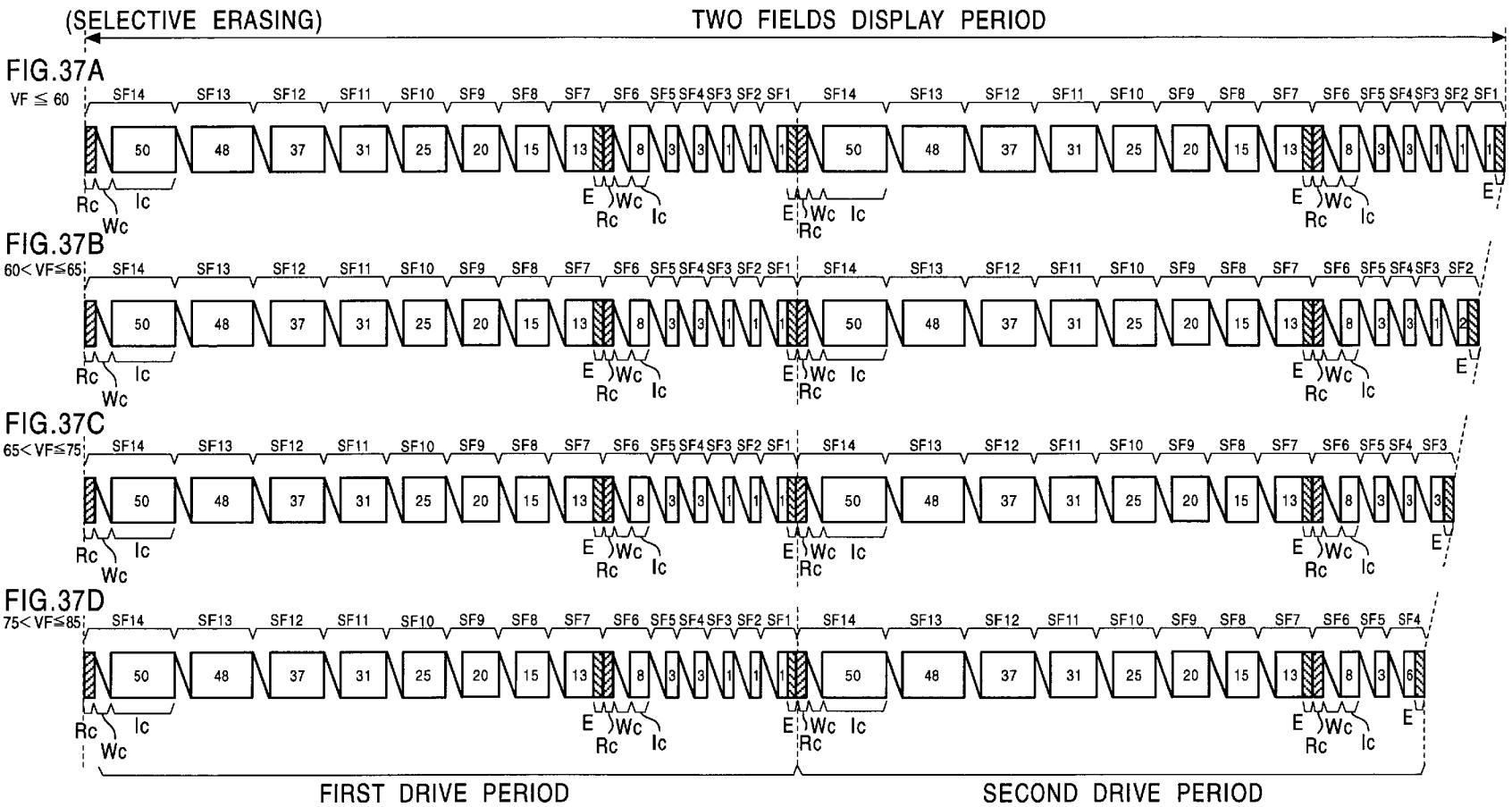
FIG. 37A through FIG. 37D show another example of a light-emission drive pattern used during the display period of two fields when the selective write address method is employed.

FIG. 36 through FIG. 37 show other examples of light-emission drive formats developed in view of such points. Moreover, FIG. 36 shows a light-emission drive format in cases where the selective erase address method is employed as the pixel data write method, while FIG. 37A through FIG. 37D show a light-emission drive format in cases where the selective erase address method is employed as the pixel data write method.

In the light-emission drive formats shown in FIG. 36A through FIG. 36D and FIG. 37A to FIG. 37D, like those shown in FIG. 16 and FIG. 22, the display period of two fields is regarded as one cycle and is divided into the former half first drive period and the latter half second drive period.

The first drive period consists of fourteen sub-fields SF1 through SF14. Within each of the sub-fields, carried out are the pixel data write process Wc for writing pixel data to each of discharge cells of the PDP 10 to set to a "light-emitting cell" and "non-light-emitting cell" , and the light-emission sustain process Ic for sustaining the light-emission state by allowing only the aforementioned "light-emitting cells" to perform sustain discharge for the frequencies (period) shown in the figures.

At this time, the frequencies of light emission in each light-emission sustain process Ic is as follows, assuming that the frequencies of light emission in the sub-field SF1 is equal to "1".

SF1: 1,
SF2: 1,
SF3: 1,
SF4: 3,
SF5: 3,
SF6: 8,
SF7: 13,
SF8: 15,
SF9: 20,
SF10: 25,
SF11: 31,
SF12: 37,
SF13: 48, and
SF14: 50.

Furthermore, the simultaneous reset process Rc is executed in the head sub-field and the intermediate sub-field out of these respective sub-fields.

That is, the simultaneous reset process Rc is executed in the sub-fields SF1 and SF7 within each of the first and second drive periods at the time of employing the selective erase address method shown in FIG. 36A through FIG. 36D, while the simultaneous reset process Rc is executed in the sub-fields SF14 and SF6 in the drive at the time of employing the selective write address method shown in FIG. 37A through FIG. 37D. In addition, as shown in FIG. 36A through FIG. 36D and FIG. 37A through FIG. 37D, the erase process E for erasing wall charges remaining in all discharge cells is executed in the last sub-field of each drive period and the sub-field immediately before the simultaneous reset process Rc is executed.

On the other hand, in the second drive period shown in the light-emission drive formats shown in FIG. 36A through FIG. 36D and FIG. 37A through FIG. 37D, like those shown in FIG. 16A through FIG. 16D and FIG. 22A through FIG. 22D, the number of sub-fields to be executed is reduced in response to the vertical frequency signal VF.

For example, as shown in the second drive period of FIG. 36B, in cases where the vertical frequency signal VF is $$60 \text{ Hz} < VF \leqq 65 \text{ Hz},$$

then, the sub-field SF1 is omitted, and the frequencies of sustain discharge that should have been originally executed in the light-emission sustain process Ic of SF1 is added to the light-emission sustain process Ic of sub-field SF2. Therefore, the number of frequencies of sustain discharge to be carried out in the light-emission sustain process Ic of sub-field SF2 in the second drive period of FIG. 36B becomes "2".

Moreover, as shown in the second drive period of FIG. 36C, in cases where the vertical frequency signal VF is $$65 \text{ Hz} < VF \leqq 75 \text{ Hz},$$

then, the sub-fields SF1 and SF2 are omitted, and the frequencies of sustain discharge that should have been originally executed in the light-emission sustain process Ic of SF1 and SF2 is added to the light-emission sustain process Ic of sub-field SF3. Therefore, the number of frequencies of sustain discharge to be carried out in the light-emission sustain process Ic of sub-field SF3 in the second drive period of FIG. 36C becomes "3".

Moreover, as shown in the second drive period of FIG. 36(D), in cases where the vertical frequency signal VF is $$75 \text{ Hz} < VF \leqq 85 \text{ Hz},$$

then, the sub-fields SF1 through SF3 are omitted, and the frequencies of sustain discharge that should have been originally executed in the light-emission sustain process Ic of SF1 through SF3 is added to the light-emission sustain process Ic of sub-field SF4. Therefore, the frequencies of sustain discharge to be carried out in the light-emission sustain process Ic of sub-field SF4 in the second drive period of FIG. 36(D) becomes "6".

Moreover, as shown in FIG. 36A, in cases where the vertical frequency signal VF is $$VF \leqq 60 \text{ Hz},$$

then, like the aforementioned first drive period, all sub-fields SF1 through SF14 are executed in the second drive period.

Figure 38:
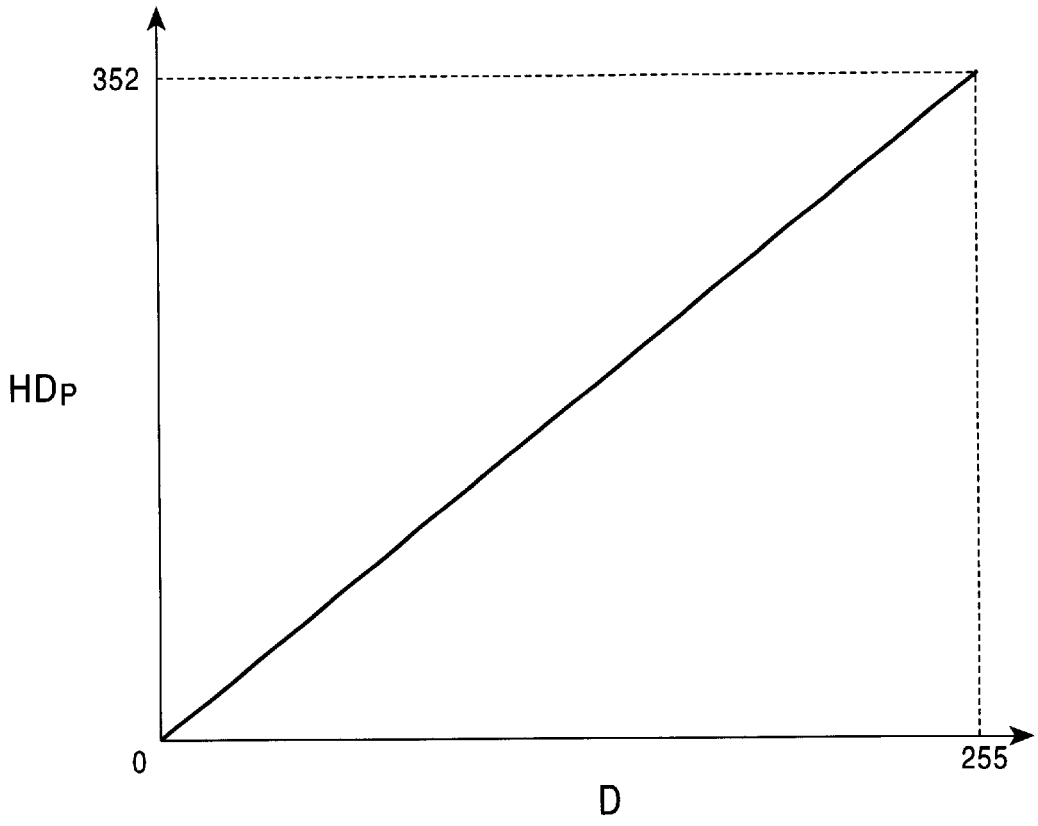
FIG. 38 is a view showing the conversion characteristics of the first data conversion circuit 32 in a case where the light-emission drive patterns shown in FIG. 36A through FIG. 36D and FIG. 37A through FIG. 37D.

FIG. 38 shows the conversion characteristics to be used in the first data conversion circuit 32 shown in FIG. 3 at the time of performing light emission drive in accordance with the light-emission drive formats shown in FIG. 36A through FIG. 36D and FIG. 37A through FIG. 37D. FIG. 39 and FIG. 40 show the conversion tables based on the conversion characteristics.

That is, in cases where light-emission drive is carried out in accordance with the light-emission drive formats shown in FIG. 36A through FIG. 36D and FIG. 37A through FIG. 37D, the first data conversion circuit 32 multiplies an input pixel data D of 256 levels of gray-scale (8 bits) by 22×16/255 (352/255) to convert the data D into conversion pixel data $HD_p$ of 9 bits (0 through 352), in accordance with the conversion tables shown in FIG. 39 and FIG. 40, and then supplies the data $HD_p$ to the multi-level gray scale processing circuit 33. The multi-level gray scale processing circuit 33 applies the aforementioned error diffusion processing and dither processing to the conversion pixel data $HD_p$ to compress four bits thereof and thus determines multi-level gray scale pixel data $D_s$ of 5 bits (0 through 22) to supply the data $D_s$ to the second data conversion circuit 34.

FIG. 41 through FIG. 44 show the conversion tables to be used in the aforementioned second data conversion circuit 34 in cases where the light emission is carried out in accordance with the light-emission drive formats (by the selective erase address method) shown in FIG. 36A through FIG. 36D, and show all light-emission drive patterns within the display period of two fields to be carried out in response to the drive pixel data HD that has been converted to be outputted in accordance with the conversion tables.

FIG. 45 through FIG. 48 show the conversion tables to be used in the aforementioned second data conversion circuit 34 in cases where the light emission drive is carried out in accordance with the light-emission drive formats (by the selective write address method) shown in FIG. 37A through FIG. 37D, and show all light-emission drive patterns within the display period of two fields to be carried out in response to the drive pixel data HD that has been converted to be outputted in accordance with the conversion tables.

At this time, FIG. 41 and FIG. 45 show the respective light-emission drive patterns in a case where the vertical frequency signal VF shows that $$VF \leqq 60 \text{ Hz};$$

FIG. 42 and FIG. 46 show the respective light-emission drive patterns in a case where the vertical frequency signal VF shows that $$60 \text{ Hz} < VF \leqq 65 \text{ Hz};$$

FIG. 43 and FIG. 47 show the respective light-emission drive patterns in a case where the vertical frequency signal VF shows that $$65 \text{ Hz} < VF \leqq 75 \text{ Hz}; \text{ and}$$

FIG. 44 and FIG. 48 show the respective light-emission drive patterns in a case where the vertical frequency signal VF shows that $$75 \text{ Hz} < VF \leqq 85 \text{ Hz}.$$

As detailed above, the present invention is adapted to change the number of executions of the division light-emission drive (sub-fields) to be executed within a unit display period (two fields) in response to the vertical synchronization frequency of inputted video signals.

This allows for displaying images at a refresh rate in response to the vertical synchronization frequency of inputted video signals.

What is claimed is:

1. A method of driving a display panel for performing gray-scale drive of a display panel employing a matrix display scheme, the display panel having a plurality of pixel cells each formed at an intersection of a plurality of electrode rows arranged for each of the scanning lines and a plurality of electrode columns arranged so as to intersect said electrode rows, comprising a step of:

executing a division light-emission drive process for causing selected ones of said pixel cells to emit light for a number of light emissions assigned to each of a plurality of divided display periods forming a unit display period of an input video signal, wherein a number of executions of said division light emission drive process within said unit display period is changed in response to a vertical synchronization frequency of said input video display, and wherein said unit display period corresponds to a display period of two fields of said input video signal, and the number of execution of said division light-emission drive process is changed in one of said two fields of said input video signal.

2. The method for driving a display panel according to claim 1, comprising the steps of:

executing an initializing process for simultaneously initializing, to either one of the states of light-emitting cells or non-light-emitting cells, all said pixel cells only in said division light-emission drive process to be executed first among executions of said division light-emission drive process within said unit display period;

executing a write process for setting said pixel cells to either one of light-emitting cells or non-light-emitting cells in response to said input video signal in either one of executions of said respective division light-emission drive process within said unit display period; and executing a light-emission sustain process for allowing said light emitting cells to emit light for the frequencies of light emission assigned to each of said divided display periods in each of executions of said division light-emission drive process within said unit display period.

3. The method for driving a display panel according to claim 2, wherein said write process sets said pixel cells to either one of the states of light-emitting cells or non-light-emitting cells in response to said input video signal in either one of executions of said division light-emission drive process in each of said divided display periods of said unit display period, and sets said pixel cells again to said one of the states at least in one of said subsequent executions of said division light-emission drive process.

4. A method of driving a display panel for performing gray-scale drive of a display panel employing a matrix display scheme, the display panel having a plurality of pixel cells each formed at an intersection of a plurality of electrode rows arranged for each of the scanning lines and a plurality of electrode columns arranged so as to intersect said electrode rows, comprising the steps of:

executing a division light-emission drive process for causing selected ones of said pixel cells to emit light for a number of light emissions assigned to each of a plurality of divided display periods forming a unit display period of an input video signal, wherein a number of executions of said division light-emission drive process within said unit display period is changed in response to a vertical synchronization frequency of said input video signal, and wherein said unit display period comprises N of said divided display period and M ($2 \leqq M \leqq N$) consecutive divided display periods of said respective divided display periods are a group of divided display periods;

executing an initializing process for simultaneously initializing, to either one of the states of light-emitting cells or non-light-emitting cells, all said pixel cells only in said division light-emission drive process to be executed first among executions of said division light-emission drive process in each of said divided display periods of said group of divided display periods;

executing a write process for setting said pixel cells to either one of light-emitting cells or non-light-emitting cells in response to said input video signal in either one of executions of said division light-emission drive process in each of said divided display periods of said group of divided display periods; and executing a light-emission sustain process for allowing said light emitting cells to emit light for the number of light emissions assigned to each of said divided display periods in each of executions of said division light-emission drive process in each of said divided display periods of said group of divided display periods.

5. The method for driving a display panel according to claim 4, wherein said write process sets said pixel cells to either one of the states of light-emitting cells or non-light-emitting cells in response to said input video signal in either one of executions of said division light-emission drive process in each of said divided display periods of said group of divided display periods, and sets said pixel cells again to said one of the states at least in one of subsequent executions of said division light-emission drive process.

6. A method for driving a display panel for performing gray-scale drive of a display panel employing a matrix display scheme, the display panel having a plurality of pixel cells each formed at an intersection of a plurality of electrode rows arranged for each of scanning lines and a plurality of electrode columns arranged so as to intersect said electrode rows, comprising the step of:

executing a division light-emission drive process for causing selected ones of said pixel cells to emit light for a number of light emissions assigned to each of a plurality of divided display periods forming a unit display period of an input video signal, wherein a number of executions of said division light-emission drive process within said unit display period is made smaller as a vertical synchronization frequency of said input video signal increases, wherein said unit display period corresponds to a display period of two fields of said input video signal, and the number of executions of said division light-emission drive process is reduced by eliminating, in one of said two fields of said input video signal, at least one execution of said division light-emission drive process in which a number of light emissions is smaller than a number of light emissions in another execution of said division light-emission drive process.

7. The method for driving a display panel according to claim 6, comprising the steps of:

executing an initializing process for simultaneously initializing, to either one of the states of light-emitting cells or non-light-emitting cells, all said pixel cells only in said division light-emission drive process to be executed first among executions of said respective division light-emission drive process within said unit display period;

executing a write process for setting said pixel cells to either one of light-emitting cells or non-light-emitting cells in response to said input video signal in said division light-emission drive process in either one of executions of said division light-emission drive process within said unit display period; and executing a light-emission sustain process for allowing said light emitting cells to emit light for the frequencies of light emission assigned to each of said divided display periods in each of executions of said division light-emission drive process within said unit display period.

8. The method for driving a display panel according to claim 7, wherein said write process sets said pixel cells to either one of the states of light-emitting cells or non-light-emitting cells in response to said input video signal in either one of said division light-emission drives executed in each of said divided display periods of said unit display period, and sets said pixel cells again to said one of the states at least in one of subsequent executions of said division light-emission drive process.

9. A method for driving a display panel for performing gray-scale drive of a display panel employing a matrix display scheme, the display panel having a plurality of pixel cells each formed at an intersection of a plurality of electrode rows arranged for each of scanning lines and a plurality of electrode columns arranged so as to intersect said electrode rows, comprising the steps of:

executing a division light-emission drive process for causing selected ones of said pixel cells to emit light for a number of light emissions assigned to each of a plurality of divided display periods forming a unit display period of an input video signal, wherein a number of executions of said division light-emission drive process within said unit display period is made smaller as a vertical synchronization frequency of said input video signal increases, wherein said unit display period comprises N of said divided display periods and M ($2 \leqq M \leqq N$) consecutive divided display periods of said respective divided display periods are a group of divided display periods;

executing an initializing process for simultaneously initializing, to either one of the states of light-emitting cells or non-light-emitting cells, all said pixel cells only in said division light-emission drive process to be executed first among executions of said division light-emission drive process in each of said divided display periods in said group of divided display periods;

executing a write process for setting said pixel cells to either one of the light-emitting cells or non-light-emitting cells in response to said input video signal in either one of executions of said division light-emission drive process in each of said divided display periods in said group of divided display periods; and executing a light-emission sustain process for allowing said light emitting cells to emit light for the number of light emissions assigned to each of said divided display periods in each of executions of said division light-emission drive process in each of said divided display periods of said group of divided display periods.

10. The method for driving a display panel according to claim 9, wherein said write process sets said pixel cells to either one of the states of light-emitting cells or non-light-emitting cells in response to said input video signal in either one of executions of said division light-emission drive process in each of said divided display periods of said group of divided display periods, and sets said pixel cells again to said one of the states at least in one of subsequent executions of said division light-emission drive processs.

11. A method of driving a display panel, having at least one pixel, comprising:

(a) providing a first unit display period for an input video signal, wherein said first unit display period is divided into a number of sub-periods; and (b) selectively driving said pixel to emit light based on a number of light emissions assigned to each of said sub-periods;

wherein said number of said sub-periods within said first unit display period is changed according to a vertical synchronization frequency of said input video signal;

wherein a second unit display period precedes said first unit display period and is divided into a number of sub-periods, and wherein said pixel is selectively driven to emit light based on a number of light emissions assigned to each of said sub-periods of said second unit display period, wherein the number of sub-fields of said second unit display period does not change according to the vertical synchronization frequency of said input video signal.

12. The method of driving a display panel according to claim 11, wherein a sum of all said light emissions assigned to each of said sub-fields is constant regardless of said vertical synchronization frequency of said video input signal.

13. The method of driving a display panel according to claim 11 wherein said number of said sub-periods within said first unit display period is reduced according to an increase in the vertical synchronization frequency of said input video signal.

* * * * *